US009063505B2

(12) United States Patent
Sekiya et al.

(10) Patent No.: US 9,063,505 B2
(45) Date of Patent: Jun. 23, 2015

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Michiyo Sekiya, Atami (JP); Kunihiko Sekido, Suntou-gun (JP); Atsushi Okuda, Yokohama (JP); Hiroyuki Tomono, Numazu (JP); Nobuhiro Nakamura, Mishima (JP); Yota Ito, Mishima (JP); Kenichi Kaku, Newcastle Upon Tyne (GB); Yuka Ishiduka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/930,341

(22) Filed: Jun. 28, 2013

(65) Prior Publication Data

US 2014/0004452 A1 Jan. 2, 2014

(30) Foreign Application Priority Data

Jun. 29, 2012 (JP) ..... 2012-147159
Apr. 25, 2013 (JP) ..... 2013-093091
Jun. 20, 2013 (JP) ..... 2013-130015

(51) Int. Cl.
*G03G 5/047* (2006.01)
*G03G 15/00* (2006.01)

(Continued)

(52) U.S. Cl.
CPC ..... *G03G 15/751* (2013.01); *G03G 5/0648* (2013.01); *G03G 5/0607* (2013.01);

(Continued)

(58) Field of Classification Search
CPC ... G03G 5/0651; G03G 5/065; G03G 5/0648; G03G 5/607; G03G 5/605; G03G 5/055
USPC ..... 430/60, 63, 65, 58.25, 58.5
See application file for complete search history.

(56) References Cited

U.S. PATENT DOCUMENTS 4,442,193 A 4/1984 Chen et al.
4,562,132 A 12/1985 Ong et al.

(Continued)

FOREIGN PATENT DOCUMENTS

EP 2 317 393 A1 5/2011
JP 1-206349 A 8/1989

(Continued)

OTHER PUBLICATIONS

English language machine translation of JP 2004-093801 (Mar. 2004).*

(Continued)

*Primary Examiner* — Christopher Rodee
(74) *Attorney, Agent, or Firm* — Fitzpatrick, Cella, Harper and Scinto

(57) ABSTRACT

An electrophotographic photosensitive member has a laminated body and a hole transporting layer formed on the laminated body, wherein the laminated body has a support, an electron transporting layer and a charge generating layer in this order, and satisfies the following expressions (2) and (4):

$$|Vl2-Vl1|\leq 0.35 \quad (2)$$

$$0.10\leq|(Vd2-Vl3)/Vd2|\leq 0.20 \quad (4).$$

9 Claims, 6 Drawing Sheets

(51) Int. Cl.

| | |
|---|---|
| ***G03G 5/06*** | (2006.01) |
| ***G03G 5/05*** | (2006.01) |
| ***G03G 5/07*** | (2006.01) |
| ***G03G 5/14*** | (2006.01) |

(52) U.S. Cl.

CPC ..... *G03G5/0605* (2013.01); *G03G 5/055* (2013.01); *G03G 5/0542* (2013.01); *G03G 5/0546* (2013.01); *G03G 5/0575* (2013.01); *G03G 5/0589* (2013.01); *G03G 5/0592* (2013.01); *G03G 5/065* (2013.01); *G03G 5/0651* (2013.01); *G03G 5/0657* (2013.01); *G03G 5/076* (2013.01); *G03G 5/142* (2013.01); *G03G 15/00* (2013.01)

(56) References Cited

U.S. PATENT DOCUMENTS

| | | | | |
|---|---|---|---|---|
| 4,992,349 | A | | 2/1991 | Chen et al. |
| 5,455,135 | A | | 10/1995 | Maruyama et al. |
| 5,468,583 | A | | 11/1995 | Gruenbaum et al. |
| 5,604,061 | A | | 2/1997 | Sekido et al. |
| 5,641,599 | A | * | 6/1997 | Markovics et al. ..... 430/58.25 |
| 5,693,443 | A | | 12/1997 | Nakamura et al. |
| 5,863,688 | A | | 1/1999 | Watanabe et al. |
| 6,110,628 | A | | 8/2000 | Sekiya et al. |
| 6,228,546 | B1 | | 5/2001 | Kashizaki et al. |
| 6,372,397 | B1 | | 4/2002 | Maruyama et al. |
| 6,436,597 | B2 | | 8/2002 | Maruyama et al. |
| 6,664,014 | B1 | | 12/2003 | Kikuchi et al. |
| 6,991,881 | B2 | | 1/2006 | Ogaki et al. |
| 6,994,941 | B2 | | 2/2006 | Tanaka et al. |
| 7,001,699 | B2 | | 2/2006 | Tanaka et al. |
| 7,045,261 | B2 | | 5/2006 | Tanaka et al. |
| 7,141,341 | B2 | | 11/2006 | Sekido et al. |
| 7,171,142 | B2 | | 1/2007 | Kawakami et al. |
| 7,378,205 | B2 | | 5/2008 | Sekiya et al. |
| 7,541,124 | B2 | | 6/2009 | Molaire et al. |
| 7,585,604 | B2 | | 9/2009 | Ogaki et al. |
| 7,645,547 | B2 | | 1/2010 | Okuda et al. |
| 7,655,370 | B2 | | 2/2010 | Kitamura et al. |
| 7,702,256 | B2 | | 4/2010 | Nukada et al. |
| 7,910,274 | B2 | | 3/2011 | Tanaka et al. |
| 7,927,774 | B2 | | 4/2011 | Ogaki et al. |
| 8,088,541 | B2 | | 1/2012 | Tanaka et al. |
| 8,343,699 | B2 | | 1/2013 | Nagasaka et al. |
| 8,465,889 | B2 | | 6/2013 | Sekido et al. |
| 8,481,236 | B2 | | 7/2013 | Tanaka et al. |
| 8,524,430 | B2 | | 9/2013 | Takagi et al. |
| 8,546,050 | B2 | | 10/2013 | Maruyama et al. |
| 2007/0026332 | A1 | | 2/2007 | Ferrar et al. |
| 2008/0280220 | A1 | | 11/2008 | Chen et al. |
| 2010/0062171 | A1 | | 3/2010 | Kaku et al. |
| 2011/0143273 | A1 | | 6/2011 | Sekido et al. |
| 2011/0158683 | A1 | | 6/2011 | Okuda et al. |
| 2012/0033994 | A1 | | 2/2012 | Tanaka et al. |
| 2012/0230727 | A1 | | 9/2012 | Sekido et al. |
| 2012/0301181 | A1 | | 11/2012 | Ogaki et al. |
| 2012/0301182 | A1 | | 11/2012 | Anezaki et al. |
| 2013/0202326 | A1 | | 8/2013 | Shida et al. |
| 2013/0202327 | A1 | | 8/2013 | Murai et al. |
| 2013/0236823 | A1 | | 9/2013 | Noguchi et al. |

FOREIGN PATENT DOCUMENTS

| | | | | |
|---|---|---|---|---|
| JP | 5-279582 | A | | 10/1993 |
| JP | 7-70038 | A | | 3/1995 |
| JP | 9-151157 | A | | 6/1997 |
| JP | 11-119458 | A | | 4/1999 |
| JP | 2003-330209 | A | | 11/2003 |
| JP | 2004-93801 | A | | 3/2004 |
| JP | 2004093801 | A | * | 3/2004 |
| JP | 2005-189764 | A | | 7/2005 |
| JP | 2006-30698 | A | | 2/2006 |
| JP | 2009-505156 | A | | 2/2009 |
| JP | 2010-145506 | A | | 7/2010 |
| JP | 4594444 | B2 | | 12/2010 |
| WO | WO 2012002516 | A1 | * | 1/2012 |

OTHER PUBLICATIONS

Jones, et al., "Cyanonaphthalene Diimide Semiconductors for Air-Stable, Flexible, and Optically Transparent n-Channel Field-Effect Transistors", Chemistry of Materials, vol. 19, No. 11, May 29, 2007, pp. 2703-2705.

Callahan, et al., "Syntheses of Phencyclone Analogues. Applications for NMR Studies of Hindered Rotations and Magnetic Anisotropy in Crowded Diels-Alder Adducts", Chem. Educator, vol. 6, 2001, pp. 227-234.

Kato, et al., "Nitration of Phenanthrenequinone", Journal of Synthetic Organic Chemistry, Japan, vol. 15, 1957, pp. 29-32.

Kato, et al., "Syntheses of Amino-phenanthrenequinones by the Reduction of Nitro Compounds", Journal of Synthetic Organic Chemistry, Japan, vol. 15, 1957, pp. 32-34.

Yamada, et al., "Synthesis and Properties of Diamino-Substituted Dipyrido [3,2-a: 2',3'-c]phenazine", Bulletin of the Chemical Society of Japan, vol. 65, No. 4, 1992, pp. 1006-1011.

Qian, et al., "4-Amino-1, 8-dicyanonaphthalene derivatives as novel fluorophore and fluorescence switches: efficient synthesis and fluorescence enhancement induced by transition metal ions and protons", Tetrahedron Letters, vol. 43, 2002, pp. 2991-2994.

Xiao, et al., "Novel highly efficient fluoroionophores with a peri-effect and strong electron-donating receptors: TICT-promoted PET and signaling response to transition metal cations with low background emission", Tetrahedron Letters, vol. 44, 2003, pp. 2087-2091.

Miyamura, et al., "Polymer Incarcerated Gold Catalyzed Aerobic Oxidation of Hydroquinones and Their Derivatives", Chemistry Letters, vol. 37, No. 3, 2008, pp. 360-361.

Okada, et al., "Synthesis and Properties of a Novel Electron Transporting Compound, 3, 3'-dialky1-4,4'-bisnaphthylquinone (DBNQ)", PPCI/Japan Hardcopy '98 Papers, 1998, pp. 207-210.

Jones, et al., "Tuning Orbital Energetics in Arylene Diimide Semiconductors. Materials Design for Ambient Stability of n-Type Charge Transport", J. Am. Chem. Soc., vol. 129, 2007, pp. 15259-15278.

Okuda, et al., U.S. Appl. No. 14/009,723, 371(c) Date: Oct. 3, 2013.

Okuda, et al., U.S. Appl. No. 14/009,721, 371(c) Date: Oct. 3, 2013.

Tokimitsu, et al., U.S. Appl. No. 13/913,910, filed Jun. 10, 2013.

Okuda, et al., U.S. Appl. No. 13/930,383, filed Jun. 28, 2013.

Kaku, et al., U.S. Appl. No. 13/930,368, filed Jun. 28, 2013.

Fujii, et al., U.S. Appl. No. 13/972,688, filed Aug. 21, 2013.

Yamashita, et al., "Crosslinking Agent Handbook", 1981, pp. 536-605.

European Search Report dated Oct. 23, 2013 in European Application No. 13174207.4.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus having an electrophotographic photosensitive member.

2. Description of the Related Art

As electrophotographic photosensitive members used for process cartridges and electrophotographic apparatuses, electrophotographic photosensitive members containing an organic photoconductive substance mainly prevail at present. The electrophotographic photosensitive member generally has a support and a photosensitive layer formed on the support. Then, an undercoating layer is provided between the support and the photosensitive layer in order to suppress the charge injection from the support side to the photosensitive layer (charge generating layer) side and to suppress the generation of image defects such as fogging.

Charge generating substances having a higher sensitivity have recently been used. However, such a problem arises that a charge is liable to be retained in a photosensitive layer due to that the amount of charge generated becomes large along with making higher the sensitivity of the charge generating substance, and the ghost is liable to occur. Specifically, a phenomenon of a so-called positive ghost, in which the density of only portions irradiated with light in the preceding rotation time becomes high, is liable to occur in a printed-out image.

A technology of suppressing (reducing) such a ghost phenomenon is disclosed in which an undercoating layer is made to be a layer (hereinafter, also referred to as an electron transporting layer) having an electron transporting capability by incorporating an electron transporting substance in the undercoating layer. National Publication of International Patent Application No. 2009-505156 discloses a condensed polymer (electron transporting substance) having an aromatic tetracarbonylbisimide skeleton and a crosslinking site, and an electron transporting layer containing a polymer with a crosslinking agent. Japanese Patent Application Laid-Open No. 2003-330209 discloses that a polymer of an electron transporting substance having a non-hydrolyzable polymerizable functional group is incorporated in an undercoating layer. Japanese Patent Application Laid-Open No. 2005-189764 discloses a technology of making the electron mobility of an undercoating layer to be $10^{-7}$ $cm^2/V\cdot sec$ or more in order to improve the electron transporting capability.

The requirement for the quality of electrophotographic images has recently been raised increasingly, and the allowable range to the positive ghost has become strict remarkably. A result of studies by the present inventors has revealed that the technologies of suppression (reduction) of the positive ghost disclosed in National Publication of International Patent Application No. 2009-505156 and Japanese Patent Application Laid-Open Nos. 2003-330209 and 2005-189764 provide insufficient reduction of the positive ghost in some cases, where there is still room for improvement. Simultaneously, if an undercoating layer is made to be an electron transporting layer, and in the case where the electron transporting layer has insufficient uniformity, since the charging capability after repeated use is liable to decrease, the decrease in the charging capability needs to be suppressed.

SUMMARY OF THE INVENTION

It is an object of the present invention to provide an electrophotographic photosensitive member suppressed in the positive ghost and suppressed in the decrease in the charging capability after repeated use, and a process cartridge and an electrophotographic apparatus having the electrophotographic photosensitive member.

The present invention relates to an electrophotographic photosensitive member including a laminated body, and a hole transporting layer formed on the laminated body, wherein the laminated body includes a support, an electron transporting layer having a thickness of d1 [μm], formed on the support, and a charge generating layer having a thickness of d2 [μm], formed on the electron transporting layer, and wherein the laminated body satisfies the following expressions (2) and (4).

$$|Vl2-Vl1|\leq 0.35 \quad (2)$$

$$0.10\leq|(Vd2-Vl3)/Vd2|\leq 0.20 \quad (4)$$

In the expressions (2) and (4),

Vl1 represents a potential of a surface of the charge generating layer when charging the surface of the charge generating layer so that the surface has a potential of Vd1 [V] represented by the following expression (1):

$$Vd1=-50\times(d1+d2) \quad (1),$$

and irradiating the surface of the charge generating layer having a potential of Vd1 with a light, followed by an interval of 0.18 seconds after the irradiation, wherein the intensity of the light is adjusted so that the potential of the surface decays by 20% with respect to Vd1 [V] when irradiating the surface of the charge generation layer, followed by an interval of 0.20 seconds after the irradiation.

Vl2 represents a potential of a surface of the charge generating layer when charging the surface of the charge generating layer so that a potential of the surface is the Vd1 [V], and irradiating the surface of the charge generating layer having a potential of Vd1 with the light, followed by an interval of 0.22 seconds after the irradiation.

Vl3 represents a potential of a surface of the charge generating layer when charging the surface of the charge generating layer so that the surface has a potential of Vd2 [V] represented by the following expression (3):

$$Vd2=-30\times(d1+d2) \quad (3),$$

and irradiating the surface of the charge generating layer having a potential of Vd2 with the light, followed by an interval of 0.20 seconds after the irradiation.

The present invention relates also to a process cartridge including the above electrophotographic photosensitive member and at least one unit selected from the group consisting of a charging unit, a developing unit, a transfer unit and a cleaning unit, integrally supported therein, wherein the process cartridge is attachable to and detachable from an electrophotographic apparatus body.

The present invention relates also to an electrophotographic apparatus including the above electrophotographic photosensitive member, a charging unit, a light irradiation unit, a developing unit and a transfer unit.

The present invention can provide an electrophotographic photosensitive member suppressed in the positive ghost and suppressed in the decrease in the charging capability after repeated use, and a process cartridge and an electrophotographic apparatus having the electrophotographic photosensitive member.

Further features of the present invention will become apparent from the following description of exemplary embodiments with reference to the attached drawings.

DESCRIPTION OF THE EMBODIMENTS

Figure 1:
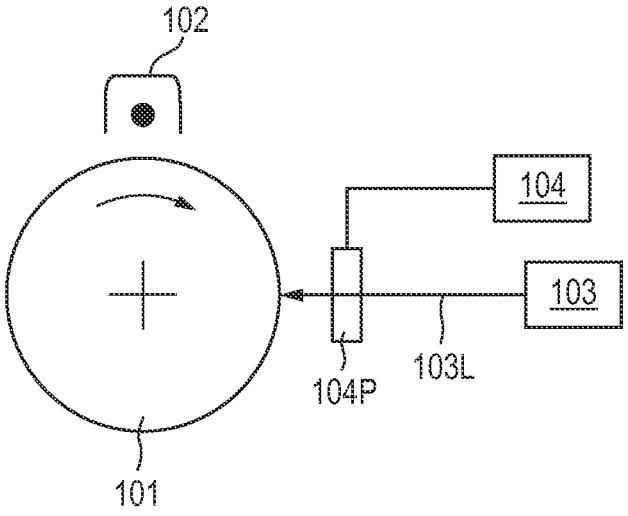
FIG. 1 is a diagram illustrating one example of an outline constitution of a determination apparatus to carry out a determination method according to the present invention.

Preferred embodiments of the present invention will now be described in detail in accordance with the accompanying drawings.

First, a determination method (hereinafter, also referred to as "determination method according to the present invention") for determining whether or not an electrophotographic photosensitive member satisfies the above expressions (1) to (4) according to the present invention will be described.

The temperature and humidity conditions when the determination method according to the present invention is carried out may be an environment under which an electrophotographic apparatus having an electrophotographic photosensitive member is used, and can be an environment of normal temperature and normal humidity (23±3° C., 50±2% RH).

The measuring method involves a measurement using a laminated body (hereinafter, also referred to as "electrophotographic photosensitive member for determination") having a support, an electron transporting layer formed on the support, and a charge generating layer formed on the electron transporting layer.

At this time, a hole transporting layer is peeled off an electrophotographic photosensitive member having a laminated body and the hole transporting layer formed on the laminated body, and the laminated body can be used as a determination object. A method of peeling a hole transporting layer includes a method in which an electrophotographic photosensitive member is immersed in a solvent which dissolves the hole transporting layer and hardly dissolves an electron transporting layer and a charge generating layer, and a method in which the hole transporting layer is ground.

As the solvent which dissolves a hole transporting layer and hardly dissolves an electron transporting layer and a charge generating layer, a solvent used for a coating liquid for the hole transporting layer can be used. The kinds of the solvent will be described later. An electrophotographic photosensitive member is immersed in the solvent for a hole transporting layer to be dissolved in the solvent, and thereafter dried to thereby obtain an electrophotographic photosensitive member for determination. That a hole transporting layer may have been peeled off can be confirmed, for example, by that no resin components of the hole transporting layer cannot be observed by the ATR method (total reflection method) in the FTIR measuring method.

A method of grinding a hole transporting layer involves, for example, using a drum grinding apparatus made by Canon Inc. and using a lapping tape (C2000, made by Fujifilm Corp.). At this time, the measurement can be carried out at the time when the hole transporting layer all disappears while the thickness of the hole transporting layer is successively measured so as not to be ground up to a charge generating layer due to excessive grinding of the hole transporting layer and the surface of an electrophotographic photosensitive member is being observed. The case where a thickness of the charge generating layer of 0.10 μm or more is left after the grinding is carried out up to the charge generating layer has been verified to give nearly the same value by the above-mentioned determination method as the case where the grinding is carried out not up to the charge generating layer. Therefore, even if not only a hole transporting layer but also up to a charge generating layer is ground, in the case where the thickness of the charge generating layer is 0.10 μm or more, the above-mentioned determination method can be used.

FIG. 1 illustrates one example of an outline constitution of a determining apparatus to carry out the determination method according to the present invention.

In FIG. 1, reference numeral 101 denotes an electrophotographic photosensitive member for determination (cylindrical laminated body), and reference numeral 102 denotes a corona charger of a charging apparatus. Reference numeral 103 denotes an apparatus to oscillate pulse laser light (image-light irradiation oscillation apparatus); reference character 103L denotes pulse light (image-irradiation light); reference character 104P denotes a transparent probe to transmit the pulse light 103L; and reference numeral 104 denotes an electrometer to measure a surface potential of a charge generating layer of the laminated body from the transparent probe. The electrophotographic photosensitive member for determination 101 is rotationally driven in the arrow direction, and is stopped at the position of the transparent probe 104P. The surface potential of the electrophotographic photosensitive member for determination 101 is measured by the electrometer 104 and the transparent probe 104P from the timepoint of the stopping. Thereafter, the electrophotographic photosensitive member for determination 101 is irradiated with the pulse light 103L oscillated from the apparatus 103 to oscillate pulse laser light and having passed through the transparent probe 104P, and the change with time of the surface potential is then measured.

Figure 2:
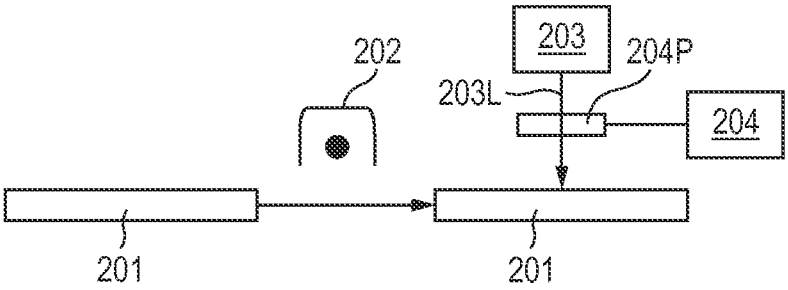
FIG. 2 is a diagram illustrating another example of an outline constitution of a determination apparatus to carry out the determination method according to the present invention.

FIG. 2 illustrates another example of an outline constitution of a determining apparatus to carry out the determination method according to the present invention. Reference numeral 201 denotes an electrophotographic photosensitive member for determination (sheet-shaped laminated body); reference numeral 202 denotes a corona charger of a charging apparatus; reference numeral 203 denotes an apparatus to oscillate pulse laser light (image-light irradiation oscillation apparatus); reference character 203L denotes pulse light (image-irradiation light); reference character 204P denotes a transparent probe to transmit the pulse light 203L; and reference numeral 204 denotes an electrometer to measure a surface potential of a charge generating layer of the laminated body from the transparent probe. The electrophotographic photosensitive member for determination 201 is driven in the arrow direction, and is stopped at the position of the transparent probe 204P. The surface potential of the electrophotographic photosensitive member for determination 201 is measured by the electrometer 204 and the transparent probe 204P from the timepoint of the stopping. Thereafter, the electrophotographic photosensitive member for determination 201 is irradiated with the pulse light 203L oscillated from the apparatus 203 to oscillate pulse laser light and having passed through the transparent probe 204P, and the change with time of the surface potential is then measured.

The position of the corona charger 102 (202), the position of light irradiation, and the moving velocity of the electrophotographic photosensitive member for determination are adjusted so that the time between the charging of the corona charger and the light irradiation (also referred to as exposure) of the pulse light 103L (203L) becomes 1.00 sec. As the corona charger 102 (202), a scorotron charger having a property of giving a constant potential can be used. As the pulse light 103L (203L), laser pulse light of 780 nm in wavelength and 10 microseconds in pulse width can be used, and the regulation of the light intensity can be carried out using an ND filter.

The above expressions (1) to (4) will be described.

Figure 3A:
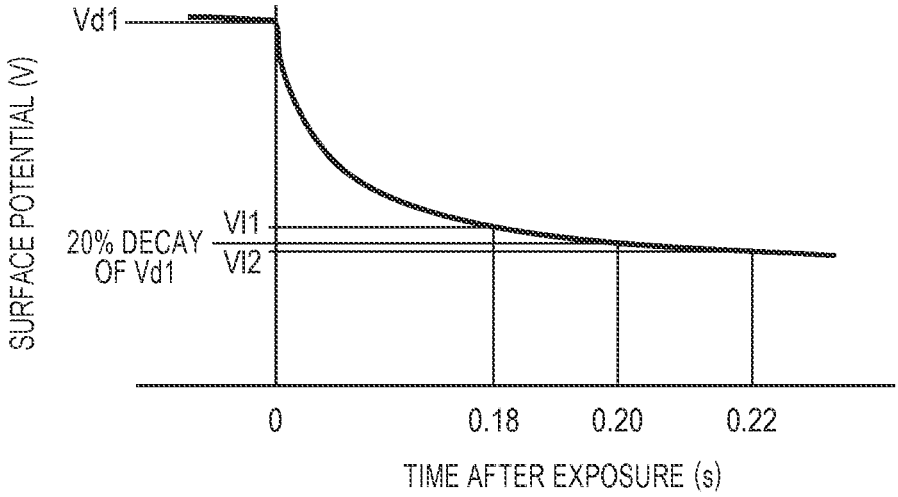
FIG. 3A is a diagram to describe Vd1, Vl1 and Vl2.
Figure 3B:
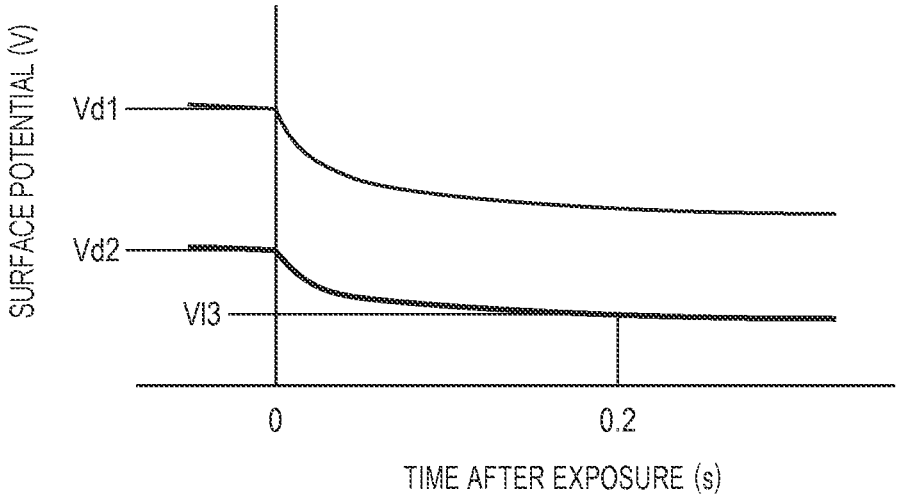
FIG. 3B is a diagram to describe Vd2 and Vl3.

FIG. 3A is a diagram to describe Vd1, Vl1 and Vl2 of the above expressions (1) and (2), and FIG. 3B is a diagram to describe Vd2 and Vl3 of the above expressions (3) and (4).

The charging conditions C1 and C2 and the light intensity E described below are determined before the determination of whether or not an electrophotographic photosensitive member satisfies the above expressions (1) to (4).

<Charging Condition C1>

The value of a grid voltage impressed on a corona charger and the value of a current of a discharge wire are regulated so that the surface potential of a charge generating layer at 1.00 sec after the charging by the corona charger becomes Vd1 (V) represented by the following expression (1) as a result of the charging of a surface of an electrophotographic photosensitive member for determination (a charge generating layer of a laminated body). The value of a grid voltage and the value of a current of a discharge wire are taken to be a charging condition C1.

$$Vd1=-50\times(d1+d2) \quad (1)$$

<Charging Condition C2>

The value of a grid voltage impressed on a corona charger and the value of a current of a discharge wire are regulated so that the surface potential of a charge generating layer at 1.00 sec after the charging by the corona charger becomes Vd2 (V) represented by the following expression (3) as a result of the charging of a surface of an electrophotographic photosensitive member for determination.

$$Vd2=-30\times(d1+d2) \quad (3)$$

<Light Intensity E>

A surface of an electrophotographic photosensitive member for determination is charged under the charging condition C1 so that the surface potential thereof becomes Vd1 (V) represented by the above expression (1), and the light intensity is regulated by an ND filter so that the surface potential at an interval of 0.20 sec after light irradiation or exposure of the surface of the charge generating layer decays by 20% with respect to Vd1 (V). The light intensity is taken to be a light intensity E.

FIG. 3A is a diagram illustrating the change with time of the surface potential of the electrophotographic photosensitive member for determination 101 when the electrophotographic photosensitive member for determination is charged under the above charging condition C1, and is irradiated with light of the above light intensity E at 1.00 sec after the charging. Vl1 is the surface potential at an interval of 0.18 sec after light irradiation with the light intensity E, and Vl2 is the surface potential at an interval of 0.22 sec after light irradiation with the light intensity E.

FIG. 3B is a diagram illustrating the change with time of the surface potential of the electrophotographic photosensitive member for determination 101 when the electrophotographic photosensitive member for determination is charged under the above charging condition C2, and is irradiated with light of the above light intensity E at 1.00 sec after the charging. Vl3 is the surface potential at an interval of 0.20 sec after light irradiation with the light intensity E.

Vl1, Vl2 and Vl3 are thus measured.

Figure 4A:
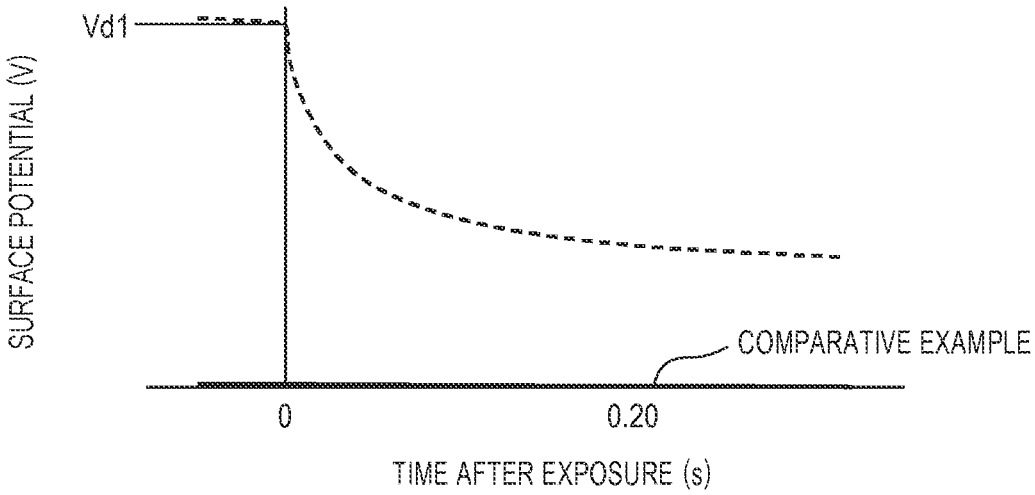
FIG. 4A and FIG. 4B are diagrams illustrating Comparative Examples in which the charging cannot be established by the determination method according to the present invention.

The case where the charging condition C1 and the light intensity E cannot be established cannot satisfy the determination method according to the present invention. FIG. 4A is a diagram illustrating an example in which the charging condition C1 cannot be established, and the example in which the charging condition C1 cannot be established is the solid line illustrated as Comparative Example. The example is an example in which since the charging capability is not sufficient, the charging cannot be carried out so that the surface potential at 1.00 sec after the charging becomes Vd1 (V) represented by the above expression (1).

Figure 4B:
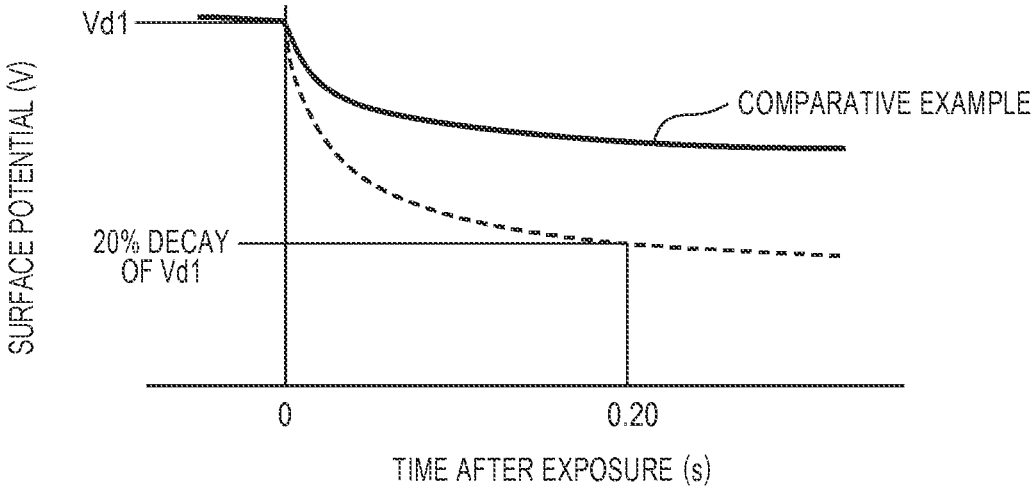

FIG. 4B is a diagram illustrating an example in which the light intensity E cannot be established, and the example in which the light intensity E cannot be established is the solid line illustrated as Comparative Example. The example is an example in which since the electron mobile capability is not sufficient, even if the light intensity is made high, the surface potential at an interval of 0.20 sec after light irradiation cannot decay by 20% with respect to Vd1 (V).

Vd1 (V) represented by the above expression (1) means adjusting the surface potential so that the potential becomes −50 V per unit thickness (μm) with respect to the total thickness (μm) of an electron transporting layer of d1 in thickness and a charge generating layer of d2 in thickness.

Figure 5:
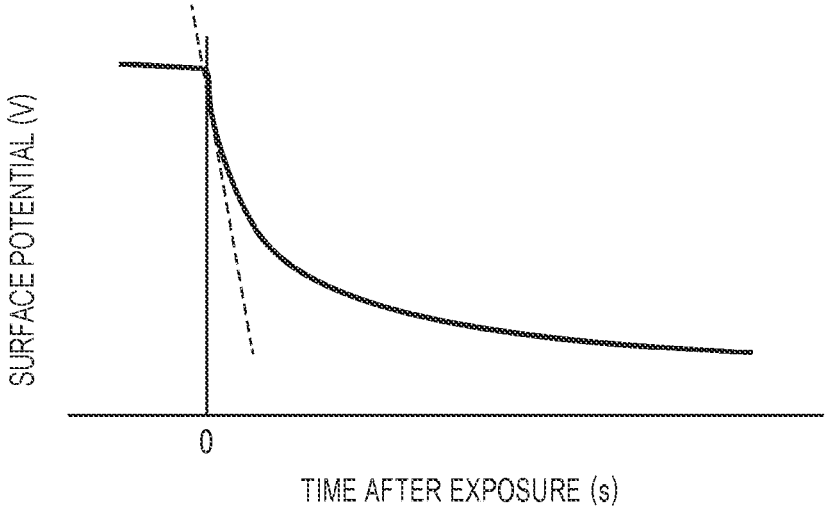
FIG. 5 is a diagram to describe a conventional measuring method.

|Vl2-Vl1| in the following expression (2) indicates a change in the surface potential not due to electrons in the region where the electron mobility linearly decaying right after light irradiation is calculated, but due to electrons in the slow region thereafter not contributing to the calculation of the electron mobility, out of electrons generated in a charge generating layer injected in an electron transporting layer and moving in the electron transporting layer. The region linearly decaying right after light irradiation is a region overlapping the straight line illustrated as a dotted line in FIG. 5, and the electron mobility is generally calculated from the region linearly decaying right after light irradiation.

$$|Vl2-Vl1|\leq 0.35 \quad (2)$$

That the surface potential at an interval of 0.20 sec after light irradiation with the light intensity E is adjusted so as to decay by 20% with respect to Vd1 (V) means that the amount of charge generated in a charge generating layer is made a constant amount; and the value of 20% means that the light intensity is such that a generated charge itself does not disturb the electric field, and is a satisfiable value as a decaying amount in which the potential change can be observed distinguishably from noises. An interval of 0.20 sec after light irradiation which has been established as a time in which the surface potential decays by 20% corresponds to a time from light irradiation to the following charging in the assumption of an electrophotographic apparatus having a fast process speed, and is a time at which the decay of electrons in the slow region is observed. The specification of |Vl2−Vl1| as an amount of change of the surface potential between ±0.02 sec of 0.20 sec later (0.18 sec later, 0.22 sec later) is a specification as a decaying amount which can be observed, not in the region linearly decaying right after light irradiation, but by distinguishing the potential change in the slow region from noises. If |Vl2−Vl1| is 0.35 or less as seen in the above expression (2), the movement of electrons in the slow region is reduced, thus meaning that the change of the surface potential becomes small. At the time of the following charging after light irradiation, the movement of electrons is conceivably reduced.

Vd2 (V) represented by the above expression (3) means adjusting the surface potential so that the potential becomes −30 V per unit thickness (μm) with respect to the total thickness (μm) of an electron transporting layer of d1 in thickness and a charge generating layer of d2 in thickness.

|(Vd2−Vl3)/Vd2| in the following expression (4) indicates a decay rate from Vd2 where Vl3 represents the surface potential at an interval of 0.20 sec after light irradiation with the same light intensity as a light intensity with which the surface potential at an interval of 0.20 sec after light irradiation decays by 20% with respect to Vd1 (V). A change in the proportion of electrons generated in a charge generating layer being injected in an electron transporting layer in the case where the surface potential at the start of light irradiation is lowered from Vd1 to Vd2 is observed. That the surface potential is adjusted so that Vd2 (V) becomes −30 V per unit thickness (μm) is because the difference in the efficiency of electrons generated in the charge generating layer being injected in the electron transporting layer is easily observed by adjusting the surface potential at the start of light irradiation from Vd1 to a lowered value of Vd2. The value is also because of being capable of observing the decay of the surface potential by distinguishing from noises. If |(Vd2−Vl3)/Vd2| is 0.10 or more, it is conceivable that electrons generated in the charge generating layer are sufficiently injected in the electron transporting layer, and the retention of electrons in the interior of the electron transporting layer and at the interface between the charge generating layer and a hole transporting layer is suppressed. Since the light irradiation is carried out at the same light intensity as a light intensity with which the surface potential at an interval of 0.20 sec after light irradiation decays by 20% with respect to Vd1 (V), the upper limit of |(Vd2−Vl3)/Vd2| is 0.20.

$$0.10 \leq |(Vd2-Vl3)/Vd2| \leq 0.20 \quad (4)$$

The present inventors presume the reason of the suppression of the positive ghost and the suppression of the decrease in the charging capability by satisfying both of the above expression (2) and the above expression (4), as follows.

That is, in the case of an electrophotographic photosensitive member provided with a support, and an electron transporting layer (undercoating layer), a charge generating layer and a hole transporting layer on the support in this order, it is believed that in portions on which irradiation light (image-irradiation light) has fallen, out of charges (holes, electrons) generated in the charge generating layer, holes are injected in the hole transporting layer, and electrons are injected in the electron transporting layer and transfer to the support. However, if electrons generated in the charge generating layer cannot completely move in the electron transporting layer before the following charging, the movement of electrons still occurs during the following charging. Electrons are thereby retained in the interior of the electron transporting layer and at the interface between the charge generating layer and the electron transporting layer, and holes are liable to be injected from the support to the electron transporting layer and the charge generating layer in the following charging time. These conceivably cause the occurrence of the positive ghost.

With respect to these causes, an electrophotographic photosensitive member in which electrons generated in the charge generating layer cannot sufficiently move in the electron transporting layer before the following charging cannot satisfy the above expression (2). Further an electrophotographic photosensitive member in which the retention of electrons occurs in the interior of the electron transporting layer and at the interface between the charge generating layer and the electron transporting layer cannot satisfy the above expression (4). It is presumed that in an electrophotographic photosensitive member satisfies both of the above expression (2) and the above expression (4), since the above-mentioned electrons can sufficiently move in the electron transporting layer before the following charging and the retention of the electrons is suppressed, the positive ghost is suppressed.

The technology of Japanese Patent Application Laid-Open No. 2005-189764 in which the electron mobility of an undercoating layer (electron transporting layer) is made to be $10^{-7}$ $cm^2/V \cdot sec$ or more has an object to improve the region linearly decaying right after light irradiation. However, the technology does not solve such a cause of generating the positive ghost that electrons generated in a charge generating layer cannot sufficiently move in an electron transporting layer before the following charging. That is, the technology does not control the movement of electrons in the slow region. Japanese Patent Application Laid-Open No. 2010-145506 discloses that the charge mobility of a hole transporting layer and an electron transporting layer (undercoating layer) are made to be in specific ranges, but does not solve the cause of generating the positive ghost as in Japanese Patent Application Laid-Open No. 2005-189764. Additionally, in these Patent Literatures, the measurement of the electron mobility of an electron transporting layer is carried out by using a constitution in which an electron transporting layer is formed on a charge generating layer, which constitution is reverse to the layer constitution used in an electrophotographic photosensitive member. However, such a measurement cannot be said to be able to sufficiently evaluate the movement of electrons in an electron transporting layer of an electrophotographic photosensitive member.

For example, in the case where an electron transporting layer is made by incorporating an electron transporting substance in an undercoating layer, when coating liquids for a charge generating layer and a hole transporting layer as upper layers are applied to form the charge generating layer and the hole transporting layer, the electron transporting substance elutes in some cases. It is conceivable in this case that even if the electron mobility is measured by making the electron transporting layer and the charge generating layer as reversed layers as described above, since the electron transporting substance elutes in an electrophotographic photosensitive member, the movement of electrons of the electron transporting layer of the electrophotographic photosensitive member cannot sufficiently be evaluated. Therefore, the determination needs to be carried out using an electron transporting layer from which a hole transporting layer has been peeled and a charge generating layer after the charge generating layer and the hole transporting layer are formed on the electron transporting layer.

In the case of an electrophotographic photosensitive member provided with an electron transporting layer, a charge generating layer and a hole transporting layer in this order on a support, an electrophotographic photosensitive member having a low charging capability in the early stage is conceivably made mainly by injection of holes from the support to the electron transporting layer side and the charge generating layer side. The decrease of the charging capability in repeated use conceivably occurs by more promoted hole injection due to the retention of charges in the interior of an undercoating layer and at the interface of a charge generating layer and an electron transporting layer. An electron transporting layer having low uniformity, such as an electron transporting layer containing an electron transporting substance as a pigment or an electron transporting layer containing a metal oxide particle dispersed and an electron transporting substance, has a low charging capability in the early stage, and causes a decrease in the charging capability in repeated use in many cases. Such an electron transporting layer having a low charging capability cannot be charged to Vd1 in the determination method according to the present invention in some cases. It is conceivable from this fact that if an electrophotographic photosensitive member after a hole transporting layer has been peeled off can be charged to Vd1, the charging capability in the early stage is sufficient, and a decrease in the charging capability in repeated use can be suppressed.

The thickness d1 of an electron transporting layer can be 0.2 μm or more and 0.7 μm or less.

In the above expression (2), from the viewpoint of more reducing the positive ghost, the following expression (9) can be satisfied.

$$|Vl2-Vl1|\leq 0.28 \quad (9)$$

In the above expression (4), the following expression (10) is more preferably satisfied.

$$0.10\leq|(Vd2-Vl3)/Vd2|\leq 0.16 \quad (10)$$

The electrophotographic photosensitive member according to the present invention has a laminated body and a hole transporting layer formed on the laminated body. The laminated body has a support, an electron transporting layer formed on the support, and a charge generating layer formed on the electron transporting layer.

Figure 8:
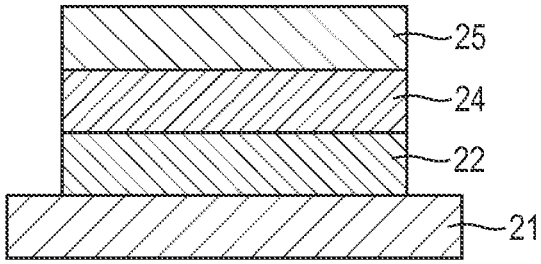
FIG. 8 is a diagram illustrating one example of a layer constitution of the electrophotographic photosensitive member according to the present invention.

FIG. 8B is a diagram illustrating one example of a layer constitution of the electrophotographic photosensitive member according to the present invention. In FIG. 8B, reference numeral 21 denotes a support; reference numeral 22 denotes an electron transporting layer; reference numeral 24 denotes a charge generating layer; and reference numeral 25 denotes a hole transporting layer.

As a usual electrophotographic photosensitive member, a cylindrical electrophotographic photosensitive member in which a photosensitive layer (a charge generating layer, a hole transporting layer) are formed on a cylindrical support is broadly used, but an otherwise shaped one such as a belt-shaped or sheet-shaped one may be used.

Electron Transporting Layer

The constitution of an electron transporting layer will be described.

An electron transporting layer can contain an electron transporting substance or a polymer of an electron transporting substance. The electron transporting layer can further contain a polymer obtained by polymerizing a composition of an electron transporting substance having polymerizable functional groups, a thermoplastic resin having polymerizable functional groups and a crosslinking agent.

Electron Transporting Substance

Examples of electron transporting substances include quinone compounds, imide compounds, benzimidazole compounds and cyclopentadienylidene compounds.

An electron transporting substance can be an electron transporting substance having polymerizable functional groups. The polymerizable functional group includes a hydroxy group, a thiol group, an amino group, a carboxyl group and a methoxy group.

Hereinafter, specific examples of the electron transporting substance are shown. The electron transporting substance includes compounds represented by one of the following formulae (A1) to (A9).

(A1)

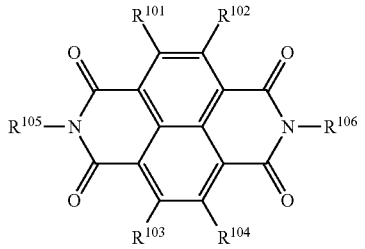

(A2)

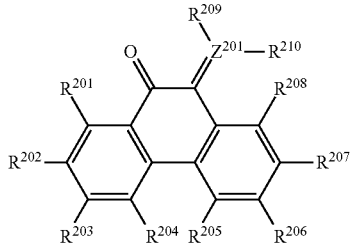

(A3)

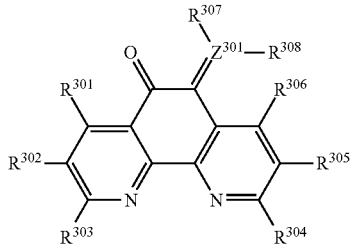

(A4)

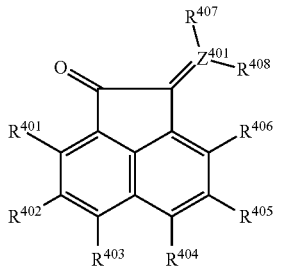

(A5)

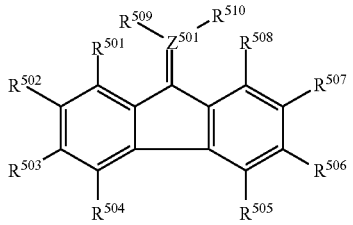

-continued (A6)

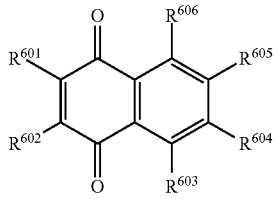

(A7)

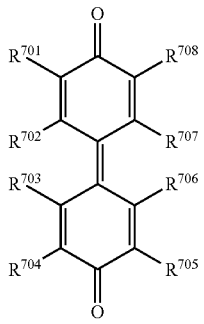

(A8)

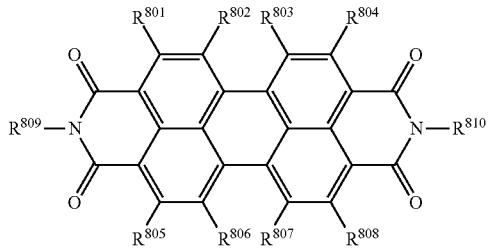

(A9)

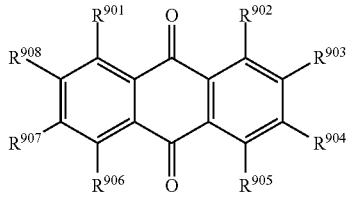

In the formulae (A1) to (A9), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$ and $R^{901}$ to $R^{908}$ each independently represent a monovalent group represented by the following formula (A), a hydrogen atom, a cyano group, a nitro group, a halogen atom, an alkoxycarbonyl group, a substituted or unsubstituted alkyl group which may be interrupted by O, S, NH and $NR^{1001}$ ($R^{1001}$ is an alkyl group), a substituted or unsubstituted aryl group or a substituted or unsubstituted heterocyclic group. The substituent of the substituted alkyl group includes an alkyl group, an aryl group, an alkoxycarbonyl group and a halogen atom. The substituent of the substituted aryl group and the substituent of the substituted heterocyclic group include a halogen atom, a nitro group, a cyano group, an alkyl group and an alkyl halide group. $Z^{201}$, $Z^{301}$, $Z^{401}$ and $Z^{501}$ each independently represent a carbon atom, a nitrogen atom or an oxygen atom. In the case where $Z^{201}$ is an oxygen atom, $R^{209}$ and $R^{210}$ are not present, and in the case where $Z^{201}$ is a nitrogen atom, $R^{210}$ is not present. In the case where $Z^{301}$ is an oxygen atom, $R^{307}$ and $R^{308}$ are not present, and in the case where $Z^{301}$ is a nitrogen atom, $R^{308}$ is not present. In the case where $Z^{401}$ is an oxygen atom, $R^{407}$ and $R^{408}$ are not present, and in the case where $Z^{401}$ is a nitrogen atom, $R^{408}$ is not present. In the case where $Z^{501}$ is an oxygen atom, $R^{509}$ and $R^{510}$ are not present, and in the case where $Z^{501}$ is a nitrogen atom, $R^{510}$ is not present.

$$-(\alpha)_l-(\beta)_m-\gamma \quad \text{(A)}$$

In the formula (A), at least one of α, β and γ is a group having a substituent, and the substituent is at least one group selected from the group consisting of a hydroxy group, a thiol group, an amino group, a carboxyl group and a methoxy group. l and m are each independently 0 or 1, and the sum of l and m is 0 to 2.

α represents an alkylene group having 1 to 6 atoms in the main chain, an alkylene group having 1 to 6 atoms in the main chain and being substituted with an alkyl group having 1 to 6 carbon atoms, an alkylene group having 1 to 6 atoms in the main chain and being substituted with a benzyl group, an alkylene group having 1 to 6 atoms in the main chain and being substituted with an alkoxycarbonyl group, or an alkylene group having 1 to 6 atoms in the main chain and being substituted with a phenyl group, and these groups may have at least one substituent selected from the group consisting of a hydroxy group, a thiol group, an amino group and a carboxyl group. One of carbon atoms in the main chain of the alkylene group may be replaced by O, S, NH or $NR^{1002}$ ($R^{1002}$ is an alkyl group).

β represents a phenylene group, a phenylene group substituted with an alkyl group having 1 to 6 carbon atoms, a nitro group-substituted phenylene group, a halogen group-substituted phenylene group or an alkoxy group-substituted phenylene group, and these groups may have at least one substituent selected from the group consisting of a hydroxy group, a thiol group, an amino group and a carboxyl group.

γ represents a hydrogen atom, an alkyl group having 1 to 6 atoms in the main chain, or an alkyl group having 1 to 6 atoms in the main chain and being substituted with an alkyl group having 1 to 6 carbon atoms, and these groups may have at least one substituent selected from the group consisting of a hydroxy group, a thiol group, an amino group and a carboxyl group. One of carbon atoms in the main chain of the alkyl group may be replaced by O, S, NH or $NR^{1003}$ ($R^{1003}$ is an alkyl group).

Among electron transporting substances represented by one of the above formulae (A-1) to (A-9), electron transporting substances are more preferable which have a polymerizable functional group being a monovalent group represented by the above formula (A) for at least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, at least one of $R^{801}$ to $R^{810}$ and at least one of $R^{901}$ to $R^{908}$.

An electron transporting substance having polymerizable functional groups can form a polymer obtained by polymerizing a composition of a thermoplastic resin having polymerizable functional groups and a crosslinking agent. A method for forming an electron transporting layer involves forming a coating film of a coating liquid for the electron transporting layer containing a composition of a thermoplastic resin having polymerizable functional groups and a crosslinking agent, and drying the coating film by heating to polymerize the composition to thereby form the electron transporting layer. After the formation of the coating film, the crosslinking agent and the polymerizable functional groups of the thermoplastic resin and the electron transporting substance are polymerized by the chemical reaction, and the chemical reaction is promoted by heating at this time to thereby promote the polymerization.

Hereinafter, specific examples of electron transporting substances having polymerizable functional groups will be described.

The heating temperature when the coating film of a coating liquid for an electron transporting layer is dried by heating can be 100 to 200° C.

In the Tables, the symbol A' is represented by the same structure as the symbol A, specific examples of the monovalent group are shown in the columns of A and A'.

Specific examples of compounds represented by the above formula (A1) are shown in Table 1-1, Table 1-2, Table 1-3, Table 1-4, Table 1-5 and Table 1-6. In the Tables, the case where γ is "-" indicates a hydrogen atom, and the hydrogen atom for the γ is incorporated into the structure given in the column of α or β.

TABLE 1-1

| Compound | | | | | | | A | | |
|---|---|---|---|---|---|---|---|---|---|
| Example | $R^{101}$ | $R^{102}$ | $R^{103}$ | $R^{104}$ | $R^{105}$ | $R^{106}$ | α | β | γ |
| A101 | H | H | H | H | 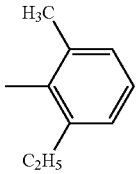 | A | 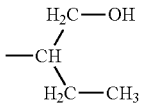 | — | — |
| A102 | H | H | H | H | 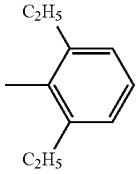 | A | 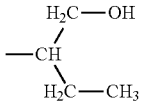 | — | — |
| A103 | H | H | H | H | 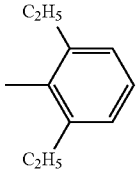 | A | — | 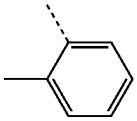 | 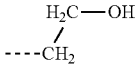 |
| A104 | H | H | H | H | 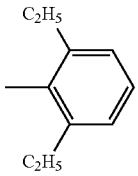 | A | — | 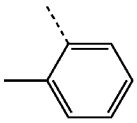 | 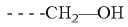 |
| A105 | H | H | H | H | 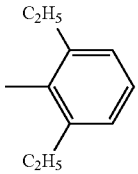 | A | — | 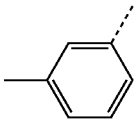 | 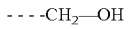 |
| A106 | H | H | H | H | 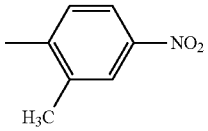 | A | 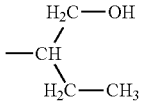 | — | — |
| A107 | H | H | H | H | 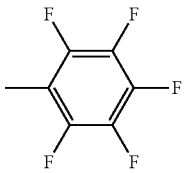 | A | 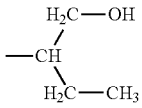 | — | — |

TABLE 1-1-continued
| Compound Example | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A108 | H | H | H | H | 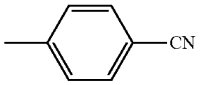 | A | 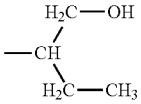 | — | — |
| A109 | H | H | H | H | 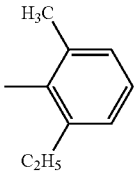 | A | $—C_6H_{10}—OH$ | — | — |
| A110 | H | H | H | H | $—C_6H_{13}$ | A | 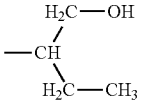 | — | — |
| A111 | H | H | H | H | 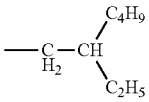 | A | — | 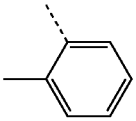 | 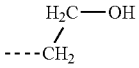 |
| A112 | H | H | H | H | 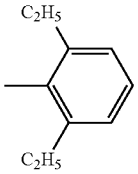 | A | — | 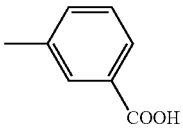 | — |
| A113 | H | H | H | H | 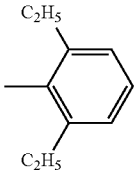 | A | — | 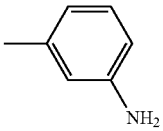 | — |
| A114 | H | H | H | H | 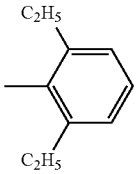 | A | — | 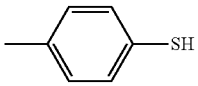 | — |
| A115 | H | H | H | H | 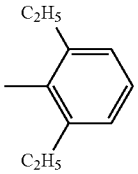 | A | — | 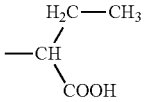 | — |
| A116 | H | H | H | H | 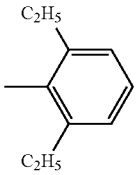 | A | — | 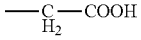 | — |

TABLE 1-2
| Compound Example | $R^{101}$ | $R^{102}$ | $R^{103}$ | $R^{104}$ | $R^{105}$ | $R^{106}$ |
|---|---|---|---|---|---|---|
| A117 | H | H | H | H | 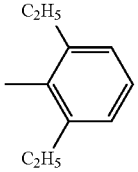 | A |
| A118 | H | H | H | H | 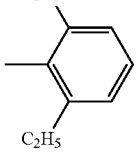 | A |
| A119 | 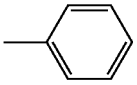 | H | H | 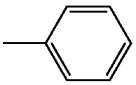 | 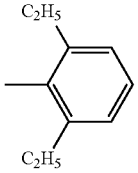 | A |
| A120 | CN | H | H | CN | 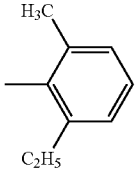 | A |
| A121 | A | H | H | H | 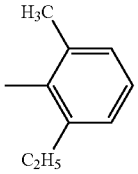 | 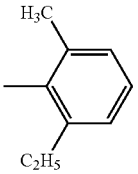 |
| A122 | H | NO2 | H | NO2 | 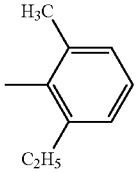 | A |
| A123 | H | H | H | H | 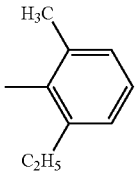 | A |
| A124 | H | H | H | H | A | A |
| A125 | H | H | H | H | A | A |
| A126 | H | H | H | H | A | A |
| A127 | H | H | H | H | A | A |
| A128 | H | H | H | H | A | A |
| A129 | H | H | H | H | A | A |
| A130 | H | H | H | H | A | A |

TABLE 1-2-continued
| | | | | | | |
|---|---|---|---|---|---|---|
| A131 | H | H | H | H | $H_3C$ 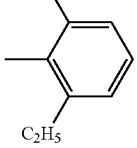 $C_2H_5$ | A |
| A132 | H | H | H | H | $H_3C$ 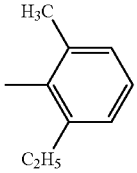 $C_2H_5$ | A |
| A133 | H | H | H | H | $H_3C$ 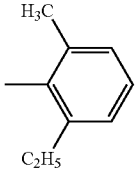 $C_2H_5$ | A |
| Compound | A | | |
|---|---|---|---|
| Example | α | β | γ |
| A117 | — | 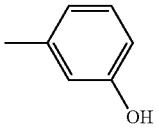 OH | — |
| A118 | — | 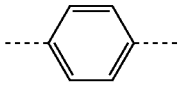 | ----C—COOH $H_2$ |
| A119 | $H_2C$—OH / —CH \ $H_2C$—$CH_3$ | — | — |
| A120 | $H_2C$—OH / —CH \ $H_2C$—$CH_3$ | — | — |
| A121 | — | — | —COOH |
| A122 | $H_2C$—OH / —CH \ $H_2C$—$CH_3$ | — | — |
| A123 | $H_2C$—OH / —CH \ $H_2C$—OH | — | — |
| A124 | $H_2C$—OH / —CH \ $H_2C$—$CH_3$ | — | — |

TABLE 1-2-continued
| | | | |
|---|---|---|---|
| A125 | — | 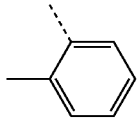 | ----$CH_2$—OH |
| A126 | — | 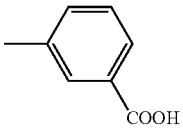 | — |
| A127 | — | 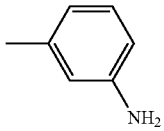 | — |
| A128 | — | 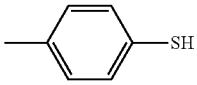 | — |
| A129 | — | 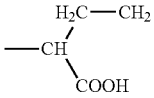 | — |
| A130 | — | 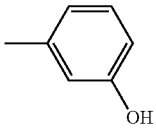 | — |
| A131 | 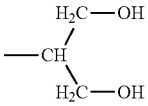 | — | — |
| A132 | 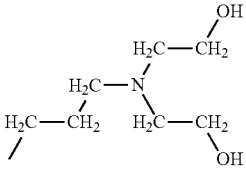 | — | — |
| A133 | 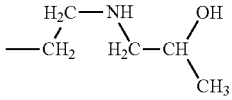 | — | — |
TABLE 1-3
| Compound Example | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A134 | H | H | H | H | 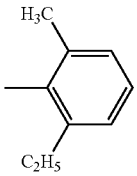 | A | 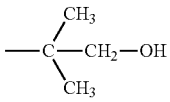 | — | — |

TABLE 1-3-continued
| Compound Example | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A135 | H | H | H | H | A | A | 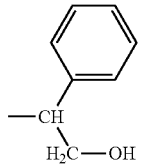 | — | — |
| A136 | H | H | H | H | A | A | 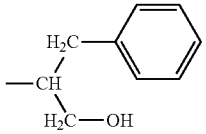 | — | — |
| A137 | H | H | H | H | A | A | 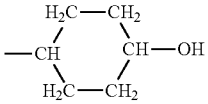 | — | — |
| A138 | H | H | H | H | A | A | — | 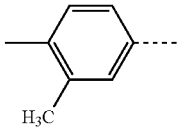 | 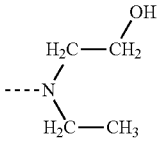 |
| A139 | H | H | H | H | 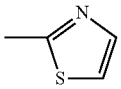 | A | 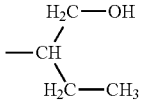 | — | — |
| A140 | H | H | H | H | 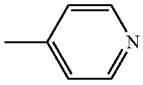 | A | 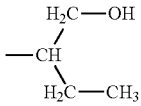 | — | — |
| A141 | H | H | H | H | 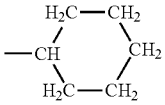 | A | 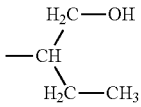 | — | — |
| A142 | H | H | H | H | A | A | 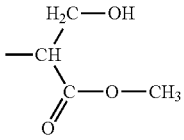 | — | — |
| A143 | CN | H | H | CN | 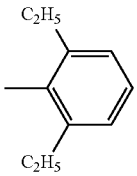 | A | 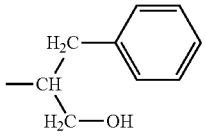 | — | — |
| A144 | H | H | H | H | $—C_2H_4—O—C_2H_5$ | A | 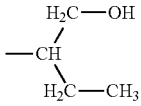 | — | — |
| A145 | H | H | H | H | 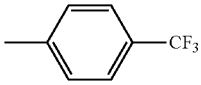 | A | $—C_2H_4—O—C_2H_4—OH$ | — | — |

TABLE 1-3-continued
| Compound Example | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A146 | H | H | H | H | A | A | 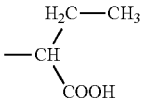 | — | — |
| A147 | H | H | H | H | 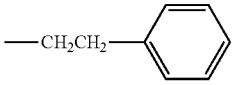 | A | 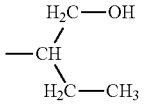 | — | — |
| A148 | H | H | H | H | 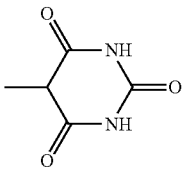 | A | $—C_2H_4—O—C_2H_4—OH$ | — | — |
| A149 | H | H | H | H | 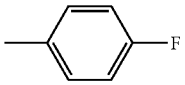 | A | $—CH_2CH_2$- - - - | 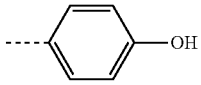 | — |
| A150 | H | H | H | H | 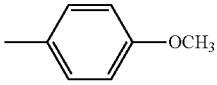 | A | — | 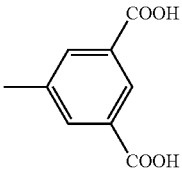 | — |
| A151 | H | H | H | H | A | A | — | 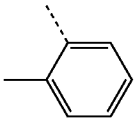 | - - - -$CH_2$—OH |
TABLE 1-4
| Compound Example | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A152 | H | H | H | H | A | A' | 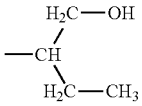 | — | — |
| A153 | H | H | H | H | A | A' | — | 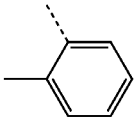 | - - - -$CH_2$—OH |
| A154 | H | H | H | H | A | A' | — | 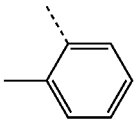 | - - - -C(H$_2$)—COOH |
| A155 | H | H | H | H | A | A' | — | 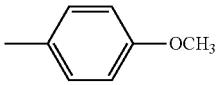 | — |

TABLE 1-4-continued

| | | | | | | | | | |
|---|---|---|---|---|---|---|---|---|---|
| A156 | H | H | H | H | A | A' | $H_2C—OH$ / —CH \ $H_2C—CH_3$ | — | — |

| Compound Example | A' α | β | γ |
|---|---|---|---|
| A152 | $—(CH_2)_5—OH$ | — | — |
| A153 | $—(CH_2)_5—OH$ | — | — |
| A154 | ----$C_{H_2}$—COOH | — | — |
| A155 | 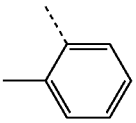 | ----$CH_2$—OH | — |
| A156 | 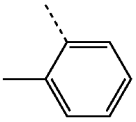 | ----$CH_2$—OH | — |

TABLE 1-5

| Compound Example | $R^{101}$ | $R^{102}$ | $R^{103}$ | $R^{104}$ | $R^{105}$ | $R^{106}$ | A α | β | γ |
|---|---|---|---|---|---|---|---|---|---|
| A157 | H | H | H | H | A | A | $H_2C—OH$ / —HC \ $H_2C—CH$ (/ $CH_3$, \ $CH_3$) | — | — |
| A158 | H | H | H | H | A | A | $H_2C—OH$ / —HC \ CH—$CH_3$ (/ $H_3C$, \ $CH_3$) | — | — |
| A159 | H | H | H | H | A | A | $H_2C—OH$ / ----HC \ CH—$CH_3$ (/ $H_3C$) | — | — |
| A160 | H | H | H | H | —$C_6H_{12}$—OH | A | $H_2C—OH$ / —HC \ $H_2C—CH$ (/ $CH_3$, \ $CH_3$) | — | — |
| A161 | H | H | H | H | 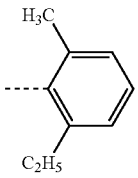 | A | $H_2C—OH$ / —HC \ $H_2C—CH$ (/ $CH_3$, \ $CH_3$) | — | — |

TABLE 1-5-continued
| Compound Example | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A162 | H | H | H | H | A | A | 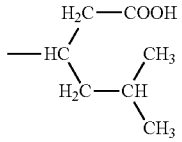 | — | — |
| A163 | H | H | H | H | 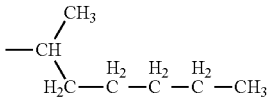 | A | $—C_2H_4—S—C_2H_4—OH$ | — | — |
| A164 | H | H | H | H | A | A | 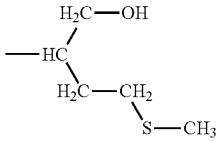 | — | — |
| A165 | H | H | H | H | A | A | 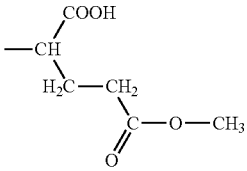 | — | — |
| A166 | H | H | H | H | $—C_2H_4—O—C_2H_5$ | A | 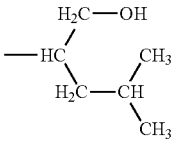 | — | — |
| A167 | H | H | H | H | $—C_2H_4—S—C_2H_5$ | A | 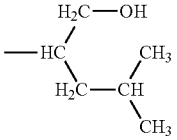 | — | — |
| A168 | H | H | H | H | 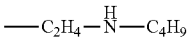 | A | 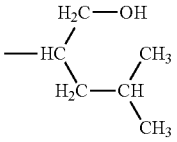 | — | — |
| A169 | H | H | H | H | 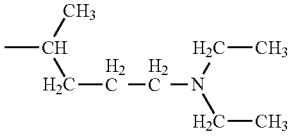 | A | 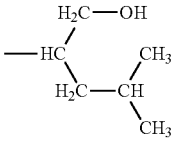 | — | — |
| A170 | H | H | H | H | 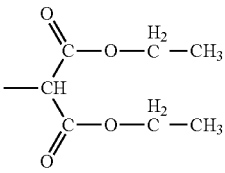 | A | 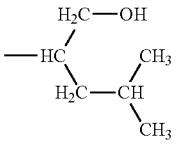 | — | — |

TABLE 1-6
| Compound | | | | | | | A | | | A' | | |
|---|---|---|---|---|---|---|---|---|---|---|---|---|
| Example | $R^{101}$ | $R^{102}$ | $R^{103}$ | $R^{104}$ | $R^{105}$ | $R^{106}$ | α | β | γ | α | β | γ |
| A171 | H | H | H | H | A | A' | 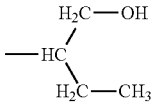 | — | — | 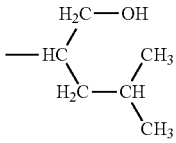 | — | — |
| A172 | H | H | H | H | A | A' | $—C_2H_4—O—C_2H_4—OH$ | — | — | 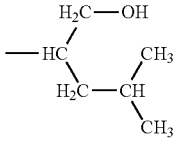 | — | — |
| A173 | H | H | H | H | A | A' | $—C_6H_{12}—OH$ | — | — | 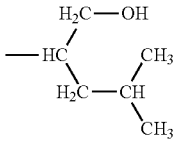 | — | — |
| A174 | H | H | H | H | A | A' | 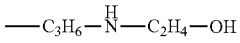 | — | — | 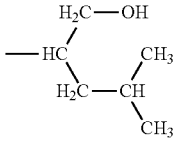 | — | — |
| A175 | H | H | H | H | A | A' | $—C_2H_4—O—C_2H_4—OH$ | — | — | 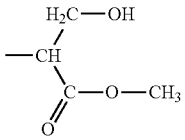 | — | — |
| A176 | H | H | H | H | A | A' | $—C_2H_4—O—C_2H_4—OH$ | — | — | 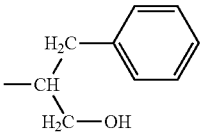 | — | — |
| A177 | H | H | H | H | A | A' | $—C_2H_4—S—C_2H_4—OH$ | — | — | 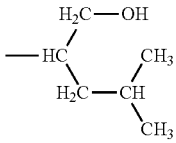 | — | — |
| A178 | H | H | H | H | A | A' | 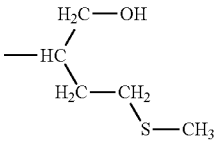 | — | — | 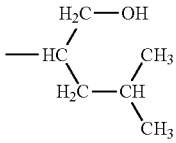 | — | — |
| A179 | H | H | H | H | A | A' | 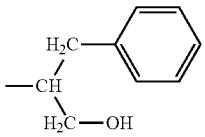 | — | — | 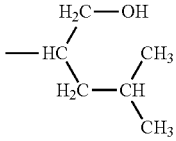 | — | — |
| A180 | H | H | H | H | A | A' | 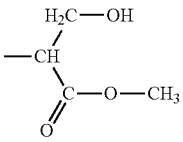 | — | — | 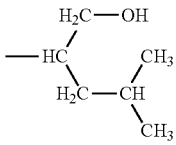 | — | — |

TABLE 1-6-continued

| Compound Example | $R^{101}$ | $R^{102}$ | $R^{103}$ | $R^{104}$ | $R^{105}$ | $R^{106}$ | A α | A β | A γ | A' α | A' β | A' γ |
|---|---|---|---|---|---|---|---|---|---|---|---|---|
| A181 | H | H | H | H | A | A' | $—C_2H_4—S—C_2H_4—OH$ | — | — | 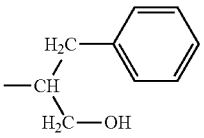 | — | — |

Specific examples of compounds represented by the above formula (A2) are shown in Table 2-1, Table 2-2 and Table 2-3. In the Tables, the case where γ is "-" indicates a hydrogen atom, and the hydrogen atom for the γ is incorporated into the structure given in the column of α or β.

TABLE 2-1

| Compound Example | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ |
|---|---|---|---|---|---|---|---|---|---|---|---|
| A201 | H | H | A | H | H | H | H | H | — | — | O |
| A202 | H | H | A | H | H | H | H | H | — | — | O |
| A204 | H | H | A | H | H | H | H | H | — | — | O |
| A205 | H | H | A | H | H | H | H | H | — | — | O |
| A206 | H | H | A | H | H | H | H | H | — | — | O |
| A207 | H | H | H | H | H | H | H | H | A | — | N |
| A208 | H | H | H | H | H | H | H | H | A | — | N |
| A209 | H | H | H | H | H | H | H | H | A | — | N |
| A210 | H | H | H | H | H | H | H | H | A | — | N |
| A211 | CH3 | H | H | H | H | H | H | $CH_3$ | A | — | N |
| A212 | H | Cl | H | H | H | H | Cl | H | A | — | N |
| A213 | H | H | 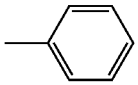 | H | H | 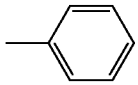 | H | H | A | — | N |
| A214 | H | H | 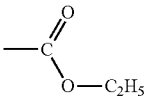 | H | H | 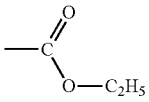 | H | H | A | — | N |
| A215 | H | H | H | $NO_2$ | $NO_2$ | H | H | H | A | — | N |
| A216 | H | H | A | H | H | A | H | H | — | — | O |
| A217 | H | H | A | H | H | A | H | H | — | — | O |

| Compound Example | A α | A β | A γ |
|---|---|---|---|
| A201 | — | 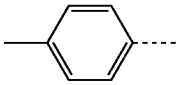 | - - - -$CH_2$—OH |
| A202 | — | 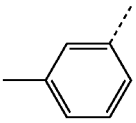 | - - - -$CH_2$—OH |
| A204 | — | 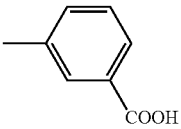 | — |

TABLE 2-1-continued
| | | | |
|---|---|---|---|
| A205 | — | 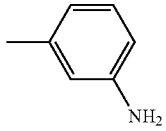 | — |
| A206 | — | 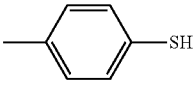 | — |
| A207 | — | 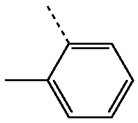 | 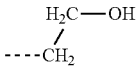 |
| A208 | — | 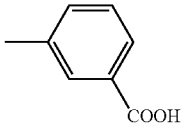 | — |
| A209 | — | 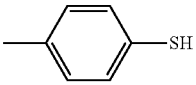 | — |
| A210 | 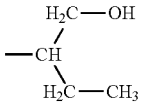 | — | — |
| A211 | — | 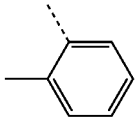 | 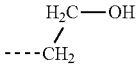 |
| A212 | — | 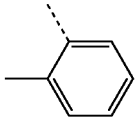 | 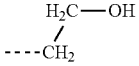 |
| A213 | — | 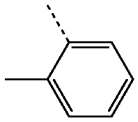 | 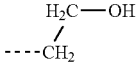 |
| A214 | — | 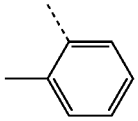 | 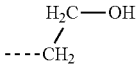 |
| A215 | — | 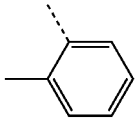 | 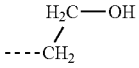 |
| A216 | — | 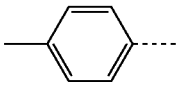 | 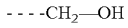 |
| A217 | — | 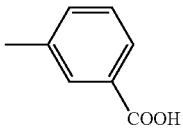 | — |

TABLE 2-1-continued

TABLE 2-2

| Compound Example | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ |
|---|---|---|---|---|---|---|---|---|---|---|---|
| A218 | H | H | A | H | H | A | H | H | — | — | O |
| A219 | H | H | A | H | H | A | H | H | — | — | O |
| A220 | H | H | A | H | H | A | H | H | — | — | O |
| A221 | H | H | A | H | H | A | H | H | — | — | O |
| A222 | H | H | A | H | H | A | H | H | — | — | O |
| A223 | H | H | A | H | H | A | H | H | — | — | O |
| A224 | H | A | H | H | H | H | A | H | — | — | O |
| A225 | H | H | A | H | H | A | H | H | CN | CN | C |
| A226 | H | H | A | H | H | A | H | H | CN | CN | C |
| A227 | H | H | A | H | H | A | H | H | CN | CN | C |
| A228 | H | H | A | H | H | A | H | H | CN | CN | C |
| A229 | H | H | A | H | H | A | H | H | CN | 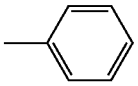 | C |
| A230 | H | H | A | H | H | A | H | H | 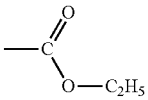 | 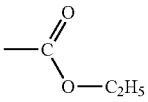 | C |
| A231 | H | H | H | H | H | H | H | H | A | A | C |
| A232 | H | $NO_2$ | H | H | H | H | $NO_2$ | H | A | — | N |
| A233 | H | H | | H | H | A | H | H | — | — | O |

| Compound Example | A α | A β | A γ |
|---|---|---|---|
| A218 | — | 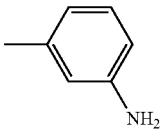 | — |
| A219 | — | 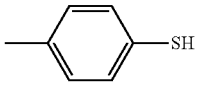 | — |
| A220 | 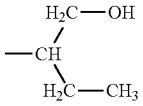 | — | — |
| A221 | 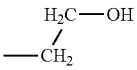 | — | — |
| A222 | — | — | COOH |
| A223 | — | — | $NH_2$ |
| A224 | — | 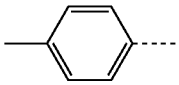 | - - - -$CH_2$—OH |
| A225 | — | 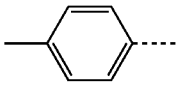 | - - - -$CH_2$—OH |

TABLE 2-2-continued
| | | | |
|---|---|---|---|
| A226 | — | 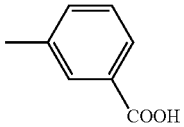 | — |
| A227 | — | 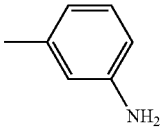 | — |
| A228 | — | 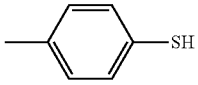 | — |
| A229 | — | 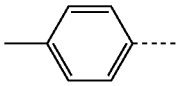 | ----$CH_2$—OH |
| A230 | — | 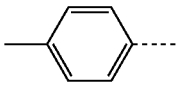 | ----$CH_2$—OH |
| A231 | — | — | COOH |
| A232 | — | 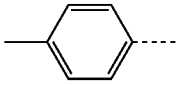 | $H_2C$—OH / ----$CH_2$ |
| A233 | — | 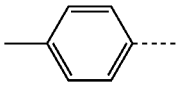 | ----$CH_2$—OH |
TABLE 2-3
| Compound Example | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A234 | H | A | H | H | H | H | A' | H | — | — | O | $H_2C$—OH / —CH \ $H_2C$—$CH_3$ | — | — |
| A235 | H | A | H | H | H | H | A' | H | — | — | O | — | 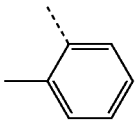 | ----$CH_2$—OH |
| A236 | H | A' | H | H | H | H | A' | H | — | — | O | — | 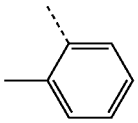 | ----C—COOH $H_2$ |
| Compound Example | A' α | A' β | A' γ |
|---|---|---|---|
| A234 | — | 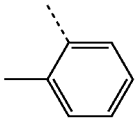 | ----$CH_2$—OH |

TABLE 2-3-continued

| | | | |
|---|---|---|---|
| A235 | —$(CH_2)_5$—OH | — | — |
| A236 | ----C($H_2$)—COOH | — | — |

Specific examples of compounds represented by the above formula (A3) are shown in Table 3-1, Table 3-2 and Table 3-3. In the Tables, the case where γ is "-" indicates a hydrogen atom, and the hydrogen atom for the γ is incorporated into the structure given in the column of α or β.

TABLE 3-1

| Compound Example | $R^{301}$ | $R^{302}$ | $R^{303}$ | $R^{304}$ | $R^{305}$ | $R^{306}$ | $R^{307}$ | $R^{308}$ | $Z^{301}$ |
|---|---|---|---|---|---|---|---|---|---|
| A301 | H | A | H | H | H | H | — | — | O |
| A302 | H | A | H | H | H | H | — | — | O |
| A303 | H | A | H | H | H | H | — | — | O |
| A304 | H | A | H | H | H | H | — | — | O |
| A305 | H | A | H | H | H | H | — | — | O |
| A306 | H | H | H | H | H | H | A | — | N |
| A307 | H | H | H | H | H | H | A | — | N |
| A308 | H | H | H | H | H | H | A | — | N |
| A309 | $CH_3$ | H | H | H | H | $CH_3$ | A | — | N |
| A310 | H | H | Cl | Cl | H | H | A | — | N |
| A311 | H | 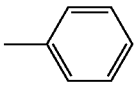 | H | H | 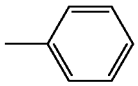 | H | A | — | N |
| A312 | H | 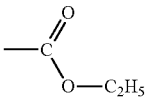 | H | H | 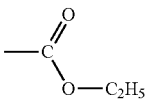 | H | A | — | N |
| A313 | H | H | H | H | H | H | A | — | N |
| A314 | H | A | H | H | A | H | — | — | O |
| A315 | H | A | H | H | A | H | — | — | O |

| Compound Example | A α | A β | A γ |
|---|---|---|---|
| A301 | — | 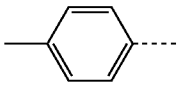 | ----$CH_2$—OH |
| A302 | — | 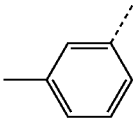 | ----$CH_2$—OH |
| A303 | — | 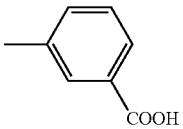 | — |
| A304 | — | 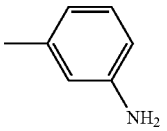 | — |
| A305 | — | 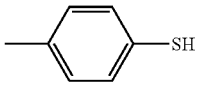 | — |

TABLE 3-1-continued
| | | | |
|---|---|---|---|
| A306 | — | 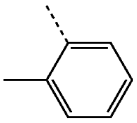 | 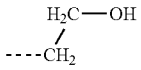 |
| A307 | — | 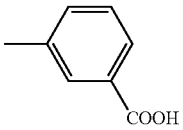 | — |
| A308 | 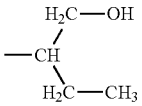 | — | — |
| A309 | — | 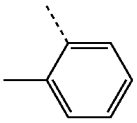 | 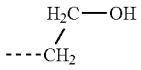 |
| A310 | — | 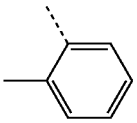 | 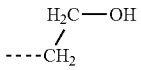 |
| A311 | — | 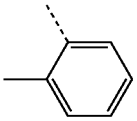 | 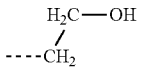 |
| A312 | — | 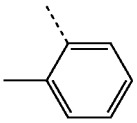 | 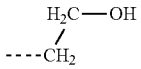 |
| A313 | — | 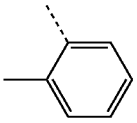 | 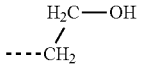 |
| A314 | — | 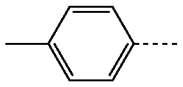 | 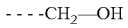 |
| A315 | — | 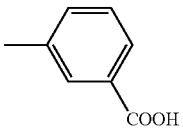 | — |
TABLE 3-2
| Compound Example | $R^{301}$ | $R^{302}$ | $R^{303}$ | $R^{304}$ | $R^{305}$ | $R^{306}$ | $R^{307}$ | $R^{308}$ | $Z^{301}$ |
|---|---|---|---|---|---|---|---|---|---|
| A316 | H | A | H | H | A | H | — | — | O |
| A317 | H | A | H | H | A | H | — | — | O |
| A318 | H | A | H | H | A | H | — | — | O |
| A319 | H | A | H | H | A | H | — | — | O |
| A320 | H | A | H | H | A | H | — | — | O |
| A321 | H | A | H | H | A | H | — | — | O |
| A322 | H | H | A | A | H | H | — | — | O |

TABLE 3-2-continued
| | | | | | | | | | |
|---|---|---|---|---|---|---|---|---|---|
| A323 | H | A | H | H | A | H | CN | CN | C |
| A324 | H | A | H | H | A | H | CN | CN | C |
| A325 | H | A | H | H | A | H | CN | CN | C |
| A326 | H | A | H | H | A | H | CN | CN | C |
| A327 | H | A | H | H | A | H | CN | 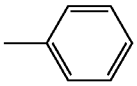 | C |
| A328 | H | A | H | H | A | H | 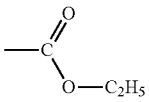 | 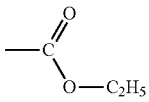 | C |
| A329 | H | H | H | H | H | H | A | A | C |
| A330 | H | H | H | H | H | H | A | — | N |
| Compound Example | A α | A β | A γ |
|---|---|---|---|
| A316 | — | 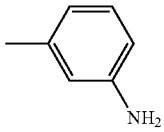 | — |
| A317 | — | 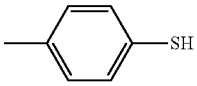 | — |
| A318 | 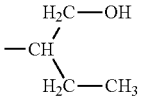 | — | — |
| A319 | 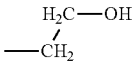 | — | — |
| A320 | — | — | COOH |
| A321 | — | — | $NH_2$ |
| A322 | — | 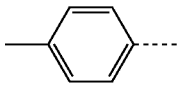 | ----$CH_2$—OH |
| A323 | — | 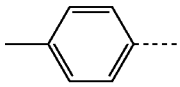 | ----$CH_2$—OH |
| A324 | — | 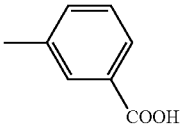 | — |
| A325 | — | 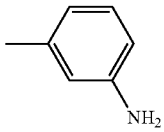 | — |
| A326 | — | 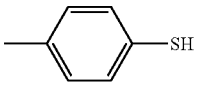 | — |
| A327 | — | 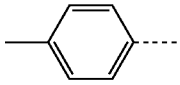 | ----$CH_2$—OH |

TABLE 3-2-continued

| | | | |
|---|---|---|---|
| A328 | — | 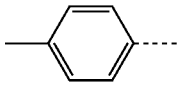 | ----$CH_2$—OH |
| A329 | — | — | COOH |
| A330 | — | 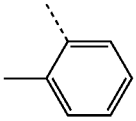 | $H_2C$—OH<br>----$CH_2$ |

TABLE 3-3

| Compound Example | $R^{301}$ | $R^{302}$ | $R^{303}$ | $R^{304}$ | $R^{305}$ | $R^{306}$ | $R^{307}$ | $R^{308}$ | $Z^{301}$ | A α | A β |
|---|---|---|---|---|---|---|---|---|---|---|---|
| A331 | H | A | H | H | A' | H | H | H | O | $H_2C$—OH<br>—CH<br>$H_2C$—$CH_3$ | — |
| A332 | H | A' | H | H | A | H | H | H | O | — | 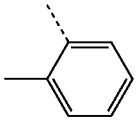 |
| A333 | H | A | H | H | A' | H | H | H | O | — | 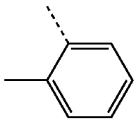 |

| Compound Example | A γ | A' α | A' β | A' γ |
|---|---|---|---|---|
| A331 | — | — | 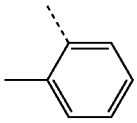 | ----$CH_2$—OH |
| A332 | ----$CH_2$—OH | —$(CH_2)_5$—OH | — | — |
| A333 | ----C($H_2$)—COOH | ----C($H_2$)—COOH | — | — |

Specific examples of compounds represented by the above formula (A4) are shown in Table 4-1 and Table 4-2. In the Tables, the case where γ is "-" indicates a hydrogen atom, and the hydrogen atom for the γ is incorporated into the structure given in the column of α or β.

TABLE 4-1

| Compound Example | $R^{401}$ | $R^{402}$ | $R^{403}$ | $R^{404}$ | $R^{405}$ | $R^{406}$ | $R^{407}$ | $R^{408}$ | $Z^{401}$ |
|---|---|---|---|---|---|---|---|---|---|
| A401 | H | H | A | H | H | H | CN | CN | C |
| A402 | H | H | A | H | H | H | CN | CN | C |
| A403 | H | H | A | H | H | H | CN | CN | C |
| A404 | H | H | A | H | H | H | CN | CN | C |
| A405 | H | H | A | H | H | H | CN | CN | C |
| A406 | H | H | H | H | H | H | A | — | N |
| A407 | H | H | H | H | H | H | A | — | N |
| A408 | H | H | H | H | H | H | A | — | N |

TABLE 4-1-continued
| | | | | | | | | | |
|---|---|---|---|---|---|---|---|---|---|
| A409 | H | H | H | H | H | H | A | — | N |
| A410 | $CH_3$ | H | H | H | H | $CH_3$ | A | — | N |
| A411 | H | Cl | H | H | Cl | H | A | — | N |
| A412 | H | H | 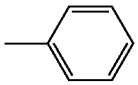 | 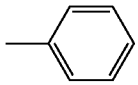 | H | H | A | — | N |
| A413 | H | H | 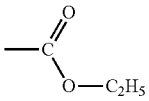 | 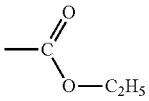 | H | H | A | — | N |
| A414 | H | H | H | H | H | H | A | — | N |
| A415 | H | H | A | A | H | H | CN | CN | C |
| Compound Example | A α | A β | A γ |
|---|---|---|---|
| A401 | — | 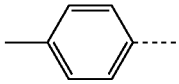 | ----$CH_2$—OH |
| A402 | — | 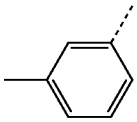 | ----$CH_2$—OH |
| A403 | — | 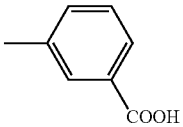 | — |
| A404 | — | 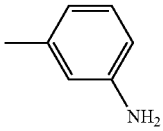 | — |
| A405 | — | 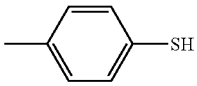 | — |
| A406 | — | 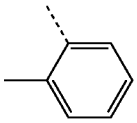 | 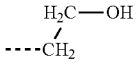 |
| A407 | — | 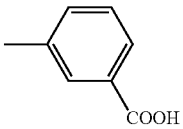 | — |
| A408 | — | 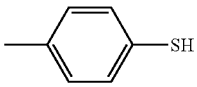 | — |
| A409 | 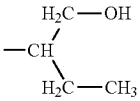 | — | — |

TABLE 4-1-continued
| | | | |
|---|---|---|---|
| A410 | — | 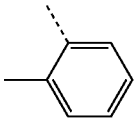 | 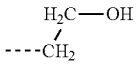 |
| A411 | — | 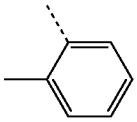 | 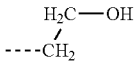 |
| A412 | — | 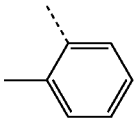 | 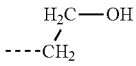 |
| A413 | — | 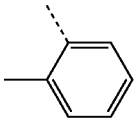 | 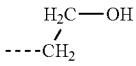 |
| A414 | — | 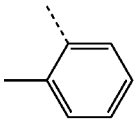 | 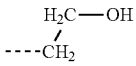 |
| A415 | — | 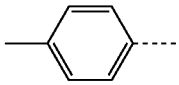 | 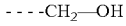 |
TABLE 4-2
| Compound Example | $R^{401}$ | $R^{402}$ | $R^{403}$ | $R^{404}$ | $R^{405}$ | $R^{406}$ | $R^{407}$ |
|---|---|---|---|---|---|---|---|
| A416 | H | H | A | A | H | H | CN |
| A417 | H | H | A | A | H | H | CN |
| A418 | H | H | A | A | H | H | CN |
| A419 | H | H | A | A | H | H | CN |
| A420 | H | H | A | A | H | H | CN |
| A421 | H | H | A | A | H | H | CN |
| A422 | H | H | A | A | H | H | CN |
| A423 | H | A | H | H | A | H | CN |
| A423 | H | H | A | A | H | H | — |
| A424 | H | H | A | A | H | H | — |
| A425 | H | H | A | A | H | H | — |
| A426 | H | H | A | A | H | H | — |
| A427 | H | H | A | A | H | H | CN |
| A428 | H | H | A | A | H | H | 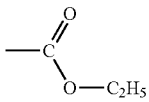 |
| A429 | H | H | H | H | H | H | A |
| A430 | H | H | H | A | H | H | CN |
| A431 | H | H | 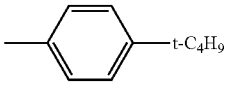 | A | H | H | 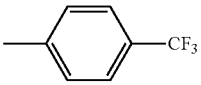 |

TABLE 4-2-continued
| Compound Example | $R^{408}$ | $Z^{401}$ | A α | A β | A γ |
|---|---|---|---|---|---|
| A416 | CN | C | — | 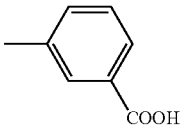 | — |
| A417 | CN | C | — | 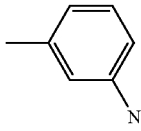 | — |
| A418 | CN | C | — | 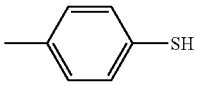 | — |
| A419 | CN | C | 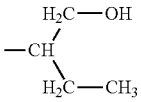 | — | — |
| A420 | CN | C | 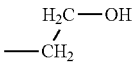 | — | — |
| A421 | CN | C | — | — | COOH |
| A422 | CN | C | — | — | $NH_2$ |
| A423 | CN | C | — | 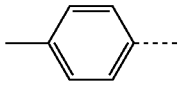 | ----$CH_2$—OH |
| A424 | — | O | — | 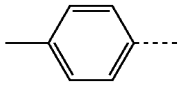 | ----$CH_2$—OH |
| A425 | — | O | — | 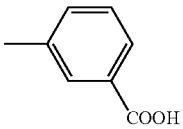 | — |
| A426 | — | O | — | 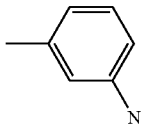 | — |
| A427 | — | O | — | 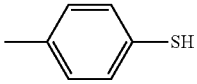 | — |
| A428 | 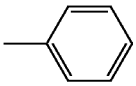 | C | — | 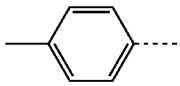 | ----$CH_2$—OH |
| A429 | 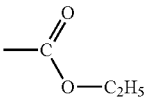 | C | — | 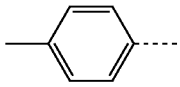 | ----$CH_2$—OH |
| A430 | A | C | — | — | COOH |

TABLE 4-2-continued

| | | | | | |
|---|---|---|---|---|---|
| A431 | CN | C | — | 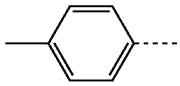 | 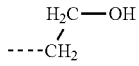 |
| A432 | — | N | — | 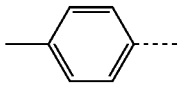 | 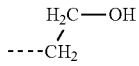 |

Specific examples of compounds represented by the above formula (A5) are shown in Table 5-1 and Table 5-2. In the Tables, the case where γ is "-" indicates a hydrogen atom, and the hydrogen atom for the γ is incorporated into the structure given in the column of α or β.

TABLE 5-1

| Compound Example | $R^{501}$ | $R^{502}$ | $R^{503}$ | $R^{504}$ | $R^{505}$ | $R^{506}$ | $R^{507}$ | $R^{508}$ | $R^{509}$ |
|---|---|---|---|---|---|---|---|---|---|
| A501 | H | A | H | H | H | H | H | H | CN |
| A502 | H | A | H | H | H | H | H | H | CN |
| A503 | H | A | H | H | H | H | H | H | CN |
| A504 | H | A | H | H | H | H | H | H | CN |
| A505 | H | A | H | H | H | H | H | H | CN |
| A506 | H | $NO_2$ | H | H | $NO_2$ | H | $NO_2$ | H | A |
| A507 | H | H | H | H | H | H | H | H | A |
| A508 | H | H | H | H | H | H | H | H | A |
| A509 | H | H | H | H | H | H | H | H | A |
| A510 | $CH_3$ | H | H | H | H | H | H | $CH_3$ | A |
| A511 | H | H | Cl | H | H | Cl | H | H | A |
| A512 | H | 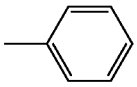 | H | H | H | H | 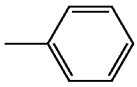 | H | A |
| A513 | H | 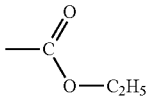 | H | H | H | H | 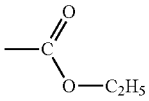 | H | A |
| A514 | H | $NO_2$ | H | H | $NO_2$ | H | $NO_2$ | H | A |
| A515 | H | A | H | H | H | H | A | H | CN |
| A516 | H | A | H | H | H | H | A | H | CN |

| Compound Example | $R^{510}$ | $Z^{501}$ | A α | A β | A γ |
|---|---|---|---|---|---|
| A501 | CN | C | — | 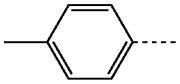 | ----$CH_2$—OH |
| A502 | CN | C | — | 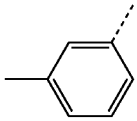 | ----$CH_2$—OH |
| A503 | CN | C | — | 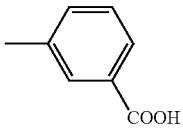 | — |
| A504 | CN | C | — | 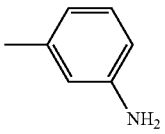 | — |

TABLE 5-1-continued
| | | | | | |
|---|---|---|---|---|---|
| A505 | CN | C | — | 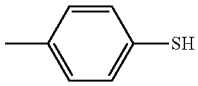 | — |
| A506 | — | N | — | 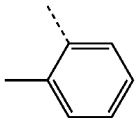 | 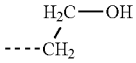 |
| A507 | — | N | — | 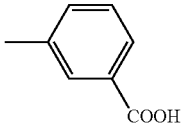 | — |
| A508 | — | N | — | 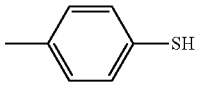 | — |
| A509 | — | N | 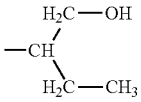 | — | — |
| A510 | — | N | — | 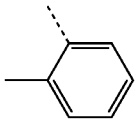 | 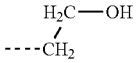 |
| A511 | — | N | — | 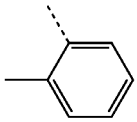 | 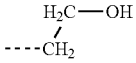 |
| A512 | — | N | — | 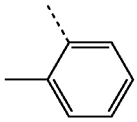 | 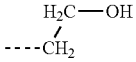 |
| A513 | — | N | — | 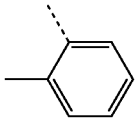 | 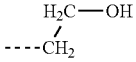 |
| A514 | — | N | — | 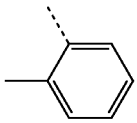 | 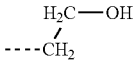 |
| A515 | CN | C | — | 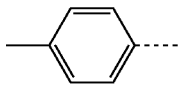 | 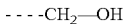 |
| A516 | CN | C | — | 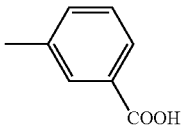 | — |

TABLE 5-2
| Compound Example | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ |
|---|---|---|---|---|---|---|---|---|---|---|
| A517 | H | A | H | H | H | H | A | H | CN | CN |
| A518 | H | A | H | H | H | H | A | H | CN | CN |
| A519 | H | A | H | H | H | H | A | H | CN | CN |
| A520 | H | A | H | H | H | H | A | H | CN | CN |
| A521 | H | A | H | H | H | H | A | H | CN | CN |
| A522 | H | A | H | H | H | H | A | H | CN | CN |
| A523 | H | H | A | H | H | A | H | H | CN | CN |
| A524 | H | A | H | H | H | H | A | H | — | — |
| A525 | H | A | H | H | H | H | A | H | — | — |
| A526 | H | A | H | H | H | H | A | H | — | — |
| A527 | H | A | H | H | H | H | A | H | — | — |
| A528 | H | A | H | H | H | H | A | H | CN | 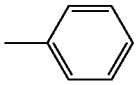 |
| A529 | H | A | H | H | H | H | A | H | 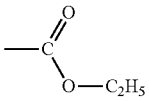 | 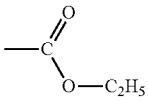 |
| A530 | H | H | H | H | H | H | H | H | A | A |
| A531 | H | A | H | H | H | H | A | H | CN | CN |
| A532 | H | A | H | H | H | H | — | — | 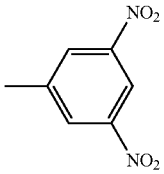 | — |
| Compound Example | $Z^{501}$ | A α | A β | A γ |
|---|---|---|---|---|
| A517 | C | — | 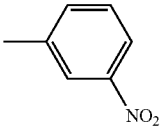 | — |
| A518 | C | — | 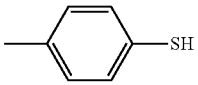 | — |
| A519 | C | 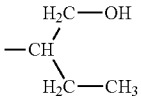 | — | — |
| A520 | C | 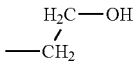 | — | — |
| A521 | C | — | — | COOH |
| A522 | C | — | — | NH2 |
| A523 | C | — | 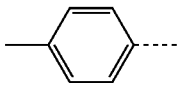 | ----$CH_2$—OH |
| A524 | O | — | 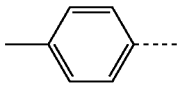 | ----$CH_2$—OH |

TABLE 5-2-continued

| | | | | |
|---|---|---|---|---|
| A525 | O | — | COOH | — |
| A526 | O | — | $NH_2$ | — |
| A527 | O | — | SH | — |
| A528 | C | — | | ----$CH_2$—OH |
| A529 | C | — | | ----$CH_2$—OH |
| A530 | C | — | — | COOH |
| A531 | C | — | | ----$CH_2$—OH |
| A532 | N | — | | ----$CH_2$—OH |

Specific examples of compounds represented by the above formula (A6) are shown in Table 6. In the Table, the case where γ is "-" indicates a hydrogen atom, and the hydrogen atom for the γ is incorporated into the structure given in the column of α or β.

TABLE 6

| Compound | | | | | | | A | | |
|---|---|---|---|---|---|---|---|---|---|
| Example | $R^{601}$ | $R^{602}$ | $R^{603}$ | $R^{604}$ | $R^{605}$ | $R^{606}$ | α | β | γ |
| A601 | A | H | H | H | H | H | — | | ----$CH_2$—OH |
| A602 | A | H | H | H | H | H | — | | ----$CH_2$—OH |
| A603 | A | H | H | H | H | H | — | COOH | — |
| A604 | A | H | H | H | H | H | — | $NH_2$ | — |

TABLE 6-continued

| Compound Example | $R^{601}$ | $R^{602}$ | $R^{603}$ | $R^{604}$ | $R^{605}$ | $R^{606}$ | A α | A β | A γ |
|---|---|---|---|---|---|---|---|---|---|
| A605 | A | H | H | H | H | H | — | 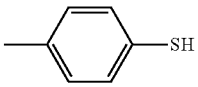 | — |
| A606 | A | H | H | H | H | H | $H_2C—OH$ / —CH \ $H_2C—CH_3$ | — | — |
| A607 | A | H | H | H | H | H | $H_2C—OH$ / —$CH_2$ | — | — |
| A608 | A | H | H | H | H | H | — | — | COOH |
| A609 | A | H | H | H | H | H | — | — | NH2 |
| A610 | A | CN | H | H | H | H | — | — | NH2 |
| A611 | CN | CN | A | H | H | H | — | — | NH2 |
| A612 | A | H | H | H | H | H | — | — | OH |
| A613 | H | H | A | H | H | H | — | — | OH |
| A614 | CH3 | H | A | H | H | H | — | — | OH |
| A615 | H | H | A | H | H | A | — | — | OH |
| A616 | A | A | H | H | H | H | — | 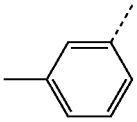 | - - - -$CH_2$—OH |
| A617 | A | A | H | H | H | H | $H_2C—OH$ / —$CH_2$ | — | — |
| A618 | A | A | H | H | H | H | $H_2C—OH$ / —CH \ $H_2C—CH_3$ | — | — |
| A619 | A | A | H | H | H | H | — | — | COOH |

Specific examples of compounds represented by the above formula (A7) are shown in Table 7-1, Table 7-2 and Table 7-3. In the Tables, the case where γ is "-" indicates a hydrogen atom, and the hydrogen atom for the γ is incorporated into the structure given in the column of α or β.

TABLE 7-1

| Compound Example | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A701 | A | H | H | H | H | H | H | H | — | 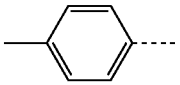 | - - - -$CH_2$—OH |
| A702 | A | H | H | H | H | H | H | H | — | 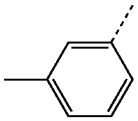 | - - - -$CH_2$—OH |

TABLE 7-1-continued
| Compound Example | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A703 | A | H | H | H | H | H | H | $NO_2$ | — | 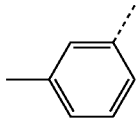 | ----$CH_2$—OH |
| A704 | A | H | H | H | H | H | H | H | — | 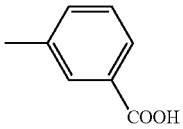 | — |
| A705 | A | H | H | H | H | H | H | H | — | 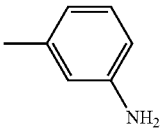 | — |
| A706 | A | H | H | H | H | H | H | H | — | 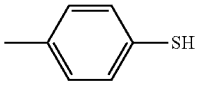 | — |
| A707 | A | H | H | H | H | H | H | H | 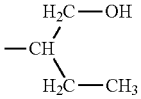 | — | — |
| A708 | A | H | H | H | H | H | H | H | — | — | COOH |
| A709 | A | H | H | H | 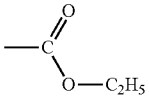 | H | H | H | — | — | COOH |
| A710 | A | H | H | H | A | H | H | H | — | 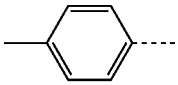 | ----$CH_2$—OH |
| A711 | A | H | H | H | A | H | H | H | — | 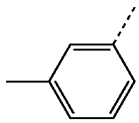 | ----$CH_2$—OH |
| A712 | A | H | H | $NO_2$ | A | H | H | $NO_2$ | — | 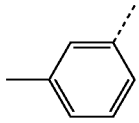 | ----$CH_2$—OH |
| A713 | A | H | F | H | A | H | F | H | — | 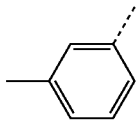 | ----$CH_2$—OH |
| A714 | A | H | H | H | A | H | H | H | — | 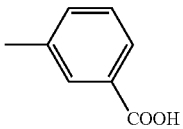 | — |

TABLE 7-1-continued

| Compound Example | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A715 | A | H | H | H | A | H | H | H | — | 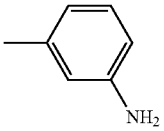 | — |

TABLE 7-2

| Compound Example | $R^{701}$ | $R^{702}$ | $R^{703}$ | $R^{704}$ | $R^{705}$ | $R^{706}$ | $R^{707}$ | $R^{708}$ |
|---|---|---|---|---|---|---|---|---|
| A716 | A | H | H | H | A | H | H | H |
| A717 | A | H | H | H | A | H | H | H |
| A718 | A | H | H | H | A | H | H | H |
| A719 | H | A | H | H | H | A | H | H |
| A720 | A | H | H | H | A | F | H | H |
| A721 | A | H | H | $CH_3$ | $CH_3$ | H | H | H |
| A722 | A | H | H | $C_4H_9$ | $C_4H_9$ | H | H | H |
| A723 | A | H | H | 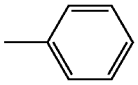 | 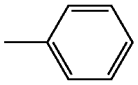 | H | H | H |
| A724 | A | H | H | $CH_3$ | $CH_3$ | H | H | H |
| A725 | A | H | H | $C_4H_9$ | $C_4H_9$ | H | H | H |
| A726 | A | H | H | 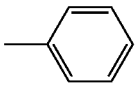 | 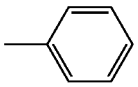 | H | H | H |
| A727 | A | H | H | $C_4H_9$ | $C_4H_9$ | H | H | H |
| A728 | A | H | H | $C_4H_9$ | $C_4H_9$ | H | H | H |
| A729 | A | H | H | $C_4H_9$ | $C_4H_9$ | H | H | H |

| Compound Example | A α | A β | A γ |
|---|---|---|---|
| A716 | — | 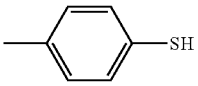 | — |
| A717 | 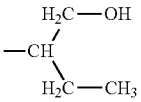 | — | — |
| A718 | — | — | COOH |
| A719 | — | — | COOH |
| A720 | — | — | COOH |
| A721 | — | — | COOH |
| A722 | — | — | COOH |
| A723 | — | — | COOH |
| A724 | — | 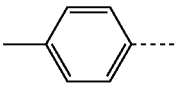 | - - - -$CH_2$—OH |

TABLE 7-2-continued
| | | | |
|---|---|---|---|
| A725 | — | 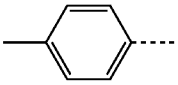 | - - - -$CH_2$—OH |
| A726 | — | 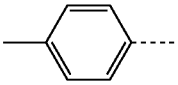 | - - - -$CH_2$—OH |
| A727 | — | 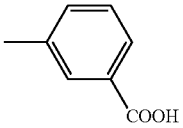 | — |
| A728 | — | 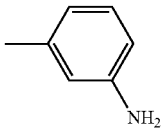 | — |
| A729 | — | 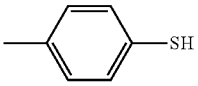 | — |
TABLE 7-3
| Compound | | | | | | | | | A | |
|---|---|---|---|---|---|---|---|---|---|---|
| Example | $R^{701}$ | $R^{702}$ | $R^{703}$ | $R^{704}$ | $R^{705}$ | $R^{706}$ | $R^{707}$ | $R^{708}$ | α | β |
| A730 | A | H | H | H | A' | H | H | H | 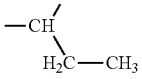 | — |
| A731 | A | H | H | H | A' | H | H | H | — | 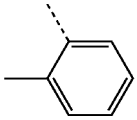 |
| A733 | A | H | H | H | A' | H | H | H | — | 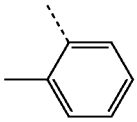 |
| Compound | A | A' | | |
|---|---|---|---|---|
| Example | γ | α | β | γ |
| A730 | — | — | 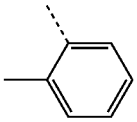 | - - - -$CH_2$—OH |

TABLE 7-3-continued

| | | | | |
|---|---|---|---|---|
| A731 | ----$CH_2$—OH | —($CH_2$)$_5$—OH | — | — |
| A732 | ----C($H_2$)—COOH | ----C($H_2$)—COOH | — | — |

Specific examples of compounds represented by the above formula (A8) are shown in Table 8-1, Table 8-2 and Table 8-3. In the Tables, the case where γ is "-" indicates a hydrogen atom, and the hydrogen atom for the γ is incorporated into the structure given in the column of α or β.

TABLE 8-1

| Compound Example | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ |
|---|---|---|---|---|---|---|---|---|---|---|
| A801 | H | H | H | H | H | H | H | H | 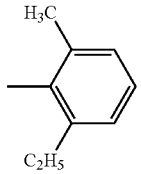 | A |
| A802 | H | H | H | H | H | H | H | H | 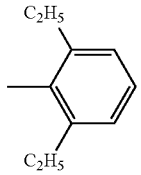 | A |
| A803 | H | H | H | H | H | H | H | H | 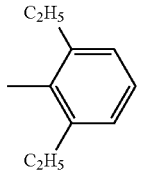 | A |
| A804 | H | H | H | H | H | H | H | H | 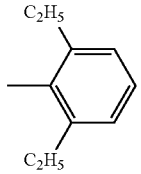 | A |
| A805 | H | H | H | H | H | H | H | H | 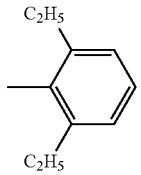 | A |
| A806 | H | H | H | H | H | H | H | H | 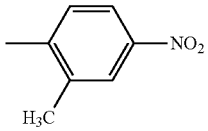 | A |
| A807 | H | H | H | H | H | H | H | H | 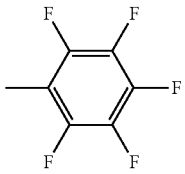 | A |

TABLE 8-1-continued
| | | | | | | | | | | |
|---|---|---|---|---|---|---|---|---|---|---|
| A808 | H | H | H | H | H | H | H | H | 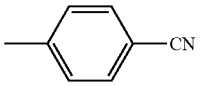 | A |
| A809 | H | H | H | H | H | H | H | H | 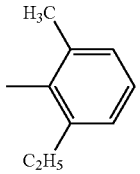 | A |
| A810 | H | H | H | H | H | H | H | H | $—C_6H_{13}$ | A |
| A811 | H | H | H | H | H | H | H | H | 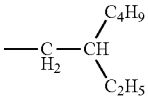 | A |
| A812 | H | H | H | H | H | H | H | H | 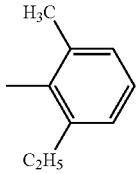 | A |
| A813 | H | H | H | H | H | H | H | H | 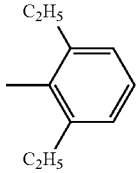 | A |
| A814 | H | H | H | H | H | H | H | H | 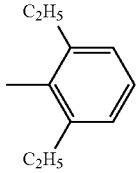 | A |
| A815 | H | H | H | H | H | H | H | H | 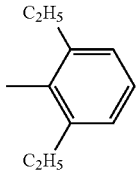 | A |
| Compound | A | | |
|---|---|---|---|
| Example | α | β | γ |
| A801 | 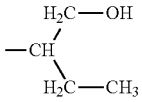 | — | — |
| A802 | 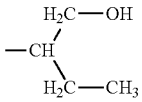 | — | — |
| A803 | — | 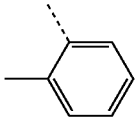 | 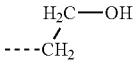 |

TABLE 8-1-continued
| | | | |
|---|---|---|---|
| A804 | — | 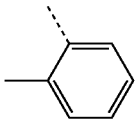 | ----$CH_2$—OH |
| A805 | — | 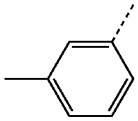 | ----$CH_2$—OH |
| A806 | 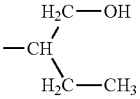 | — | — |
| A807 | 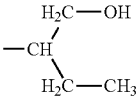 | — | — |
| A808 | 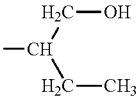 | — | — |
| A809 | —$C_5H_{10}$—OH | — | — |
| A810 | 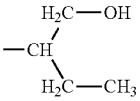 | — | — |
| A811 | — | 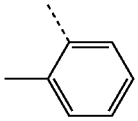 | 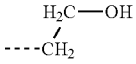 |
| A812 | — | 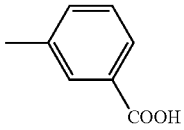 | — |
| A813 | — | 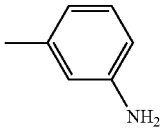 | — |
| A814 | — | 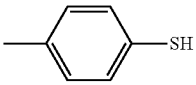 | — |
| A815 | — | 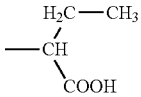 | — |

TABLE 8-2
| Compound Example | $R^{801}$ | $R^{802}$ | $R^{803}$ | $R^{804}$ | $R^{805}$ | $R^{806}$ | $R^{807}$ | $R^{808}$ | $R^{809}$ |
|---|---|---|---|---|---|---|---|---|---|
| A816 | H | H | H | H | H | H | H | H | 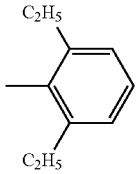 |
| A817 | H | H | H | H | H | H | H | H | 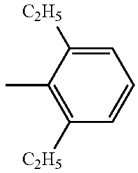 |
| A818 | H | H | H | H | H | H | H | H | 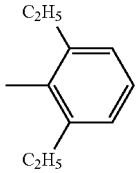 |
| A819 | H | CN | H | H | H | H | CN | H | 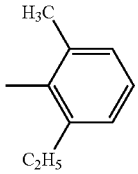 |
| A820 | H | 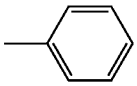 | H | H | H | H | 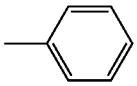 | H | 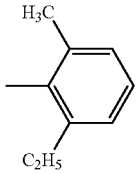 |
| A821 | H | A | H | H | H | H | H | H | 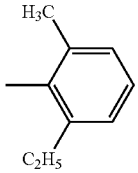 |
| A822 | H | Cl | Cl | H | H | Cl | Cl | H | 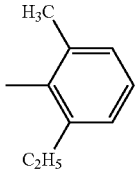 |
| A823 | H | H | H | H | H | H | H | H | 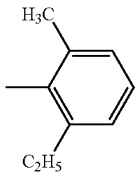 |
| A824 | H | H | H | H | H | H | H | H | A |
| A825 | H | H | H | H | H | H | H | H | A |
| A826 | H | H | H | H | H | H | H | H | A |
| A827 | H | H | H | H | H | H | H | H | A |

TABLE 8-2-continued
| | | | | | | | | | |
|---|---|---|---|---|---|---|---|---|---|
| A828 | H | H | H | H | H | H | H | H | A |
| A829 | H | H | H | H | H | H | H | H | A |
| A830 | H | H | H | H | H | H | H | H | A |
| A831 | H | 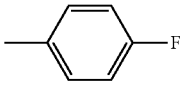 | H | H | H | H | 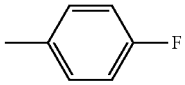 | H | 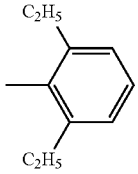 |
| Compound Example | $R^{810}$ | A α | A β | A γ |
|---|---|---|---|---|
| A816 | A | — | 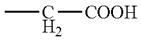 | — |
| A817 | A | — | 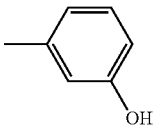 | — |
| A818 | A | — | 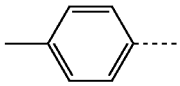 | 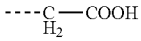 |
| A819 | A | 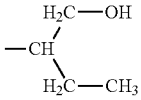 | — | — |
| A820 | A | 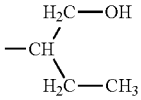 | — | — |
| A821 | 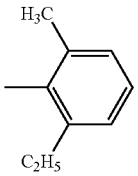 | — | — | —COOH |
| A822 | A | 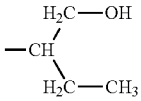 | — | — |
| A823 | A | 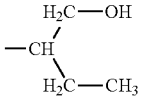 | — | — |
| A824 | A | 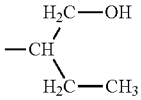 | — | — |
| A825 | A | — | 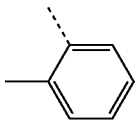 | 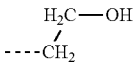 |

TABLE 8-2-continued
| | | | | |
|---|---|---|---|---|
| A826 | A | — | 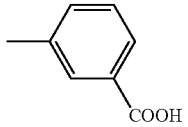 | — |
| A827 | A | — | 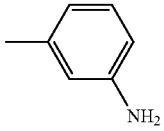 | — |
| A828 | A | — | 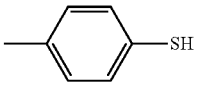 | — |
| A829 | A | — | 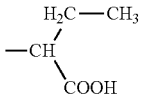 | — |
| A830 | A | — | 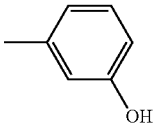 | — |
| A831 | A | — | 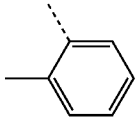 | 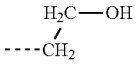 |
TABLE 8-3
| Compound | | | | | | | | | | | A | |
|---|---|---|---|---|---|---|---|---|---|---|---|---|
| Example | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | α | β |
| A832 | H | H | H | H | H | H | H | H | A | A' | 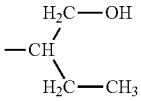 | — |
| A833 | H | H | H | H | H | H | H | H | A | A' | — | 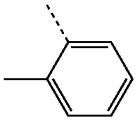 |
| A834 | H | H | H | H | H | H | H | H | A | A' | — | 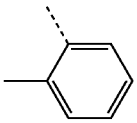 |
| A835 | H | H | H | H | H | H | H | H | A | A' | — | 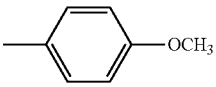 |
| Compound | A | A' | | |
|---|---|---|---|---|
| Example | γ | α | β | γ |
| A832 | — | $-(CH_2)_5-OH$ | — | — |
| A833 | $----CH_2-OH$ | $-(CH_2)_5-OH$ | — | — |

TABLE 8-3-continued

| | | | | |
|---|---|---|---|---|
| A834 | ----C—COOH<br>H2 | ----C—COOH<br>H2 | — | — |
| A835 | — | 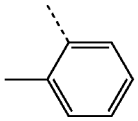 | ----CH2—OH | — |

Specific examples of compounds represented by the above formula (A9) are shown in Table 9-1 and Table 9-2. In the Tables, the case where γ is "-" indicates a hydrogen atom, and the hydrogen atom for the γ is incorporated into the structure given in the column of α or β.

TABLE 9-1

| Compound Example | $R^{901}$ | $R^{902}$ | $R^{903}$ | $R^{904}$ | $R^{905}$ | $R^{906}$ | $R^{907}$ | $R^{908}$ |
|---|---|---|---|---|---|---|---|---|
| A901 | A | H | H | H | H | H | H | H |
| A902 | A | H | H | H | H | H | H | H |
| A903 | A | H | H | H | 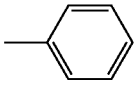 | H | H | H |
| A904 | A | 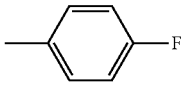 | H | H | 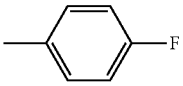 | H | H | H |
| A905 | A | $NO_2$ | H | H | H | $NO_2$ | H | H |
| A906 | A | H | H | H | H | A | H | H |
| A907 | A | H | H | H | A | H | H | H |
| A908 | A | H | H | H | A | H | H | H |
| A909 | A | H | H | A | H | H | H | H |
| A910 | A | H | H | A | H | H | H | H |
| A911 | H | H | H | H | H | H | H | A |
| A912 | H | H | H | H | H | H | H | A |
| A913 | H | $NO_2$ | H | H | H | $NO_2$ | H | A |
| A914 | H | H | H | H | H | H | H | A |
| A915 | H | H | H | H | H | H | H | A |
| A916 | H | H | H | H | H | H | H | A |
| A917 | H | H | H | H | H | H | H | A |
| A918 | H | H | H | H | H | H | H | A |
| A919 | H | CN | H | H | H | H | CN | A |
| A920 | A | A | H | H | H | H | H | H |
| A921 | A | A | H | $NO_2$ | H | H | $NO_2$ | H |
| A922 | H | A | A | H | H | H | H | H |
| A923 | H | H | A | H | H | H | H | H |
| A924 | H | H | A | H | H | H | H | A |

| Compound Example | A | | |
|---|---|---|---|
| | α | β | γ |
| A901 | —$CH_2$—OH | — | — |
| A902 | —$(CH_2)_2$—OH | — | — |
| A903 | —$(CH_2)_2$—OH | — | — |
| A904 | —$(CH_2)_2$—OH | — | — |
| A905 | —$(CH_2)_2$—OH | — | — |
| A906 | —$(CH_2)_2$—OH | — | — |
| A907 | —$(CH_2)_2$—OH | — | — |

TABLE 9-1-continued
| | | | |
|---|---|---|---|
| A908 | — | 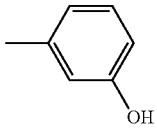 | — |
| A909 | $-(CH_2)_2-OH$ | — | — |
| A910 | — | 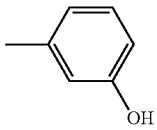 | — |
| A911 | $-CH_2-OH$ | — | — |
| A912 | $-(CH_2)_2-OH$ | — | — |
| A913 | $-(CH_2)_2-OH$ | — | |
| A914 | — | 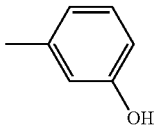 | — |
| A915 | — | 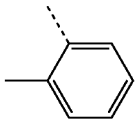 | 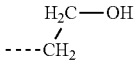 |
| A916 | — | 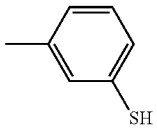 | — |
| A917 | — | 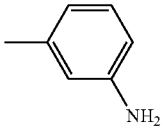 | — |
| A918 | — | 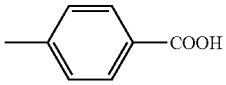 | — |
| A919 | — | 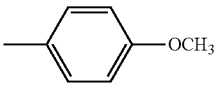 | — |
| A920 | $-(CH_2)_2-OH$ | — | — |
| A921 | $-(CH_2)_2-OH$ | — | — |
| A922 | — | — | OH |
| A923 | $-(CH_2)_6-OH$ | — | — |

TABLE 9-1-continued

| | | | |
|---|---|---|---|
| A924 | — | 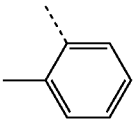 | 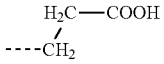 |

TABLE 9-2

| Compound | | | | | | | | | A | | | A' | | |
|---|---|---|---|---|---|---|---|---|---|---|---|---|---|---|
| Example | $R^{901}$ | $R^{902}$ | $R^{903}$ | $R^{904}$ | $R^{905}$ | $R^{906}$ | $R^{907}$ | $R^{908}$ | α | β | γ | α | β | γ |
| A925 | A | H | H | H | A' | H | H | H | $-(CH_2)_2-OH$ | — | — | — | 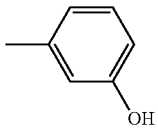 | — |
| A926 | A | H | H | A' | H | H | H | H | $-(CH_2)_2-OH$ | — | — | — | 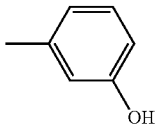 | — |
| A927 | H | A' | H | H | H | H | H | A | $-(CH_2)_6-OH$ | — | — | — | 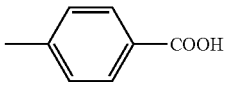 | — |

A derivative (derivative of an electron transporting substance) having a structure of (A1) can be synthesized by a well-known synthesis method described, for example, in U.S. Pat. Nos. 4,442,193, 4,992,349 and 5,468,583 and Chemistry of Materials, Vol. 19, No. 11, 2703-2705 (2007). The derivative can also be synthesized by a reaction of a naphthalenetetracarboxylic dianhydride and a monoamine derivative, which are commercially available from Tokyo Chemical Industry Co., Ltd., Sigma-Aldrich Japan Co., Ltd. and Johnson Matthey Japan Inc.

A compound represented by (A1) has polymerizable functional groups (a hydroxy group, a thiol group, an amino group, a carboxyl group and a methoxy group) polymerizable with a crosslinking agent. A method for incorporating these polymerizable functional groups in a derivative having an (A1) structure includes a method of directly incorporating the polymerizable functional groups, and a method of incorporating structures having the polymerizable functional groups or functional groups capable of becoming precursors of polymerizable functional groups. Examples of the latter method include, based on a halide of a naphthylimide derivative, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation. There is a method of using a naphthalenetetracarboxylic dianhydride derivative or a monoamine derivative having the polymerizable functional groups or functional groups capable of becoming precursors of polymerizable functional groups as a raw material for synthesis of the naphthylimide derivative.

Derivatives having an (A2) structure are commercially available, for example, from Tokyo Chemical Industry Co., Ltd., Sigma-Aldrich Japan Co., Ltd. and Johnson Matthey Japan Inc. The derivatives can also be synthesized based on a phenanthrene derivative or a phenanthroline derivative by synthesis methods described in Chem. Educator No. 6, 227-234 (2001), Journal of Synthetic Organic Chemistry, Japan, vol. 15, 29-32 (1957) and Journal of Synthetic Organic Chemistry, Japan, vol. 15, 32-34 (1957). A dicyanomethylene group can also be incorporated by a reaction with malononitrile.

A compound represented by (A2) has polymerizable functional groups (a hydroxy group, a thiol group, an amino group, a carboxyl group and a methoxy group) polymerizable with a crosslinking agent. A method for incorporating these polymerizable functional groups in a derivative having an (A2) structure includes a method of directly incorporating the polymerizable functional groups, and a method of incorporating structures having the polymerizable functional groups or functional groups capable of becoming precursors of polymerizable functional groups. Examples of the latter method include, based on a halide of phenathrenequinone, a method of incorporating a functional group-containing aryl group by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives having an (A3) structure are commercially available from Tokyo Chemical Industry Co., Ltd., Sigma-Aldrich Japan Co., Ltd. and Johnson Matthey Japan Inc. The derivatives can also be synthesized based on a phenanthrene derivative or a phenanthroline derivative by a synthesis method described in Bull. Chem. Soc., Jpn., Vol. 65, 1006-1011 (1992). A dicyanomethylene group can also be incorporated by a reaction with malononitrile.

A compound represented by (A3) has polymerizable functional groups (a hydroxy group, a thiol group, an amino group, a carboxyl group and a methoxy group) polymerizable with a crosslinking agent. A method for incorporating these polymerizable functional groups in a derivative having the structure of the above formula (A3) includes a method of directly incorporating the polymerizable functional groups, and a method of incorporating structures having the polymerizable functional groups or functional groups capable of becoming precursors of polymerizable functional groups. There are methods including, for example, based on a halide of phenathrolinequinone, a method of incorporating a functional group-containing aryl group by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives having an (A4) structure are commercially available, for example, from Tokyo Chemical Industry Co., Ltd., Sigma-Aldrich Japan Co., Ltd. and Johnson Matthey Japan Inc. The derivatives can also be synthesized based on an acenaphthenequinone derivative by synthesis methods described in Tetrahedron Letters, 43 (16), 2991-2994 (2002) and Tetrahedron Letters, 44 (10), 2087-2091 (2003). A dicyanomethylene group can also be incorporated by a reaction with malononitrile.

A compound represented by the formula (A4) has polymerizable functional groups (a hydroxy group, a thiol group, an amino group, a carboxyl group and a methoxy group) polymerizable with a crosslinking agent. A method for incorporating these polymerizable functional groups in a derivative having an (A4) structure includes a method of directly incorporating the polymerizable functional groups, and a method of incorporating structures having the polymerizable functional groups or functional groups capable of becoming precursors of polymerizable functional groups. Examples of the latter method include, based on a halide of acenaphthenequinone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives having an (A5) structure are commercially available, for example, from Tokyo Chemical Industry Co., Ltd., Sigma-Aldrich Japan Co., Ltd. and Johnson Matthey Japan Inc. The derivatives can also be synthesized using a fluorenone derivative and malononitrile by a synthesis method described in U.S. Pat. No. 4,562,132. The derivatives can also be synthesized using a fluorenone derivative and an aniline derivative by synthesis methods described in Japanese Patent Application Laid-Open Nos. H5-279582 and H7-70038.

A compound represented by the formula (A5) has polymerizable functional groups (a hydroxy group, a thiol group, an amino group, a carboxyl group and a methoxy group) polymerizable with a crosslinking agent. A method for incorporating these polymerizable functional groups in a derivative having an (A5) structure includes a method of directly incorporating the polymerizable functional groups, and a method of incorporating structures having the polymerizable functional groups or functional groups capable of becoming precursors of polymerizable functional groups. Examples of the latter method include, based on a halide of fluorenone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives having an (A6) structure can be synthesized by synthesis methods described in, for example, Chemistry Letters, 37(3), 360-361 (2008) and Japanese Patent Application Laid-Open No. H9-151157. The derivatives are commercially available from Tokyo Chemical Industry Co., Ltd., Sigma-Aldrich Japan Co., Ltd. and Johnson Matthey Japan Inc.

A compound represented by the formula (A6) has polymerizable functional groups (a hydroxy group, a thiol group, an amino group, a carboxyl group and a methoxy group) polymerizable with a crosslinking agent. A method for incorporating these polymerizable functional groups in a derivative having an (A6) structure includes a method of directly incorporating the polymerizable functional groups in a naphthoquinone derivative, and a method of incorporating structures having the polymerizable functional groups or functional groups capable of becoming precursors of polymerizable functional groups in a naphthoquinone derivative. Examples of the latter method include, based on a halide of naphthoquinone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives having an (A7) structure can be synthesized by synthesis methods described in Japanese Patent Application Laid-Open No. H1-206349 and Proceedings of PPCI/Japan Hard Copy '98, Proceedings, p. 207 (1998). The derivatives can be synthesized, for example, using phenol derivatives commercially available from Tokyo Chemical Industry Co., Ltd., or Sigma-Aldrich Japan Co., Ltd., as a raw material.

A compound represented by (A7) has polymerizable functional groups (a hydroxy group, a thiol group, an amino group, a carboxyl group and a methoxy group) polymerizable with a crosslinking agent. A method for incorporating these polymerizable functional groups in a derivative having an (A7) structure includes a method of incorporating structures having the polymerizable functional groups or functional groups capable of becoming precursors of polymerizable functional groups. Examples of the method include, based on a halide of diphenoquinone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives having an (A8) structure can be synthesized by a well-known synthesis method described in, for example, Journal of the American Chemical Society, Vol. 129, No. 49, 15259-78 (2007). The derivatives can also be synthesized by a reaction of perylenetetracarboxylic dianhydride and a monoamine derivative commercially available from Tokyo Chemical Industry Co., Ltd., Sigma-Aldrich Japan Co., Ltd. and Johnson Matthey Japan Inc.

A compound represented by the formula (A8) has polymerizable functional groups (a hydroxy group, a thiol group, an amino group, a carboxyl group and a methoxy group) polymerizable with a crosslinking agent. A method for incorporating these polymerizable functional groups in a derivative having an (A8) structure includes a method of directly incorporating the polymerizable functional groups, and a method of incorporating structures having the polymerizable functional groups or functional groups capable of becoming precursors of polymerizable functional groups. Examples of the latter method include, based on a halide of a peryleneimide derivative, a method of using a cross coupling reaction using a palladium catalyst and a base and a method of using a cross coupling reaction using an $FeCl_3$ catalyst and a base. There is a method of using perylenetetracarboxylic dianhydride derivative or a monoamine derivative having the polymerizable functional groups or functional groups capable of becoming precursors of polymerizable functional groups as a raw material for synthesis of the peryleneimide derivative.

Derivatives having an (A9) structure are commercially available, for example, from Tokyo Chemical Industry Co., Ltd., Sigma-Aldrich Japan Co., Ltd. and Johnson Matthey Japan Inc.

A compound represented by the formula (A9) has polymerizable functional groups (a hydroxy group, a thiol group, an amino group, a carboxyl group and a methoxy group) polymerizable with a crosslinking agent. A method for incorporating these polymerizable functional groups in a derivative having an (A9) structure includes a method of incorporating structures having the polymerizable functional groups or functional groups capable of becoming precursors of polymerizable functional groups, in an anthraquinone derivative commercially available. Examples of the method include, based on a halide of anthraquinone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Crosslinking Agent

Then, a crosslinking agent will be described.

As a crosslinking agent, a compound can be used which polymerizes with or crosslinks with an electron transporting substance having polymerizable functional groups and a thermoplastic resin having polymerizable functional groups. Specifically, compounds described in "Crosslinking Agent Handbook", edited by Shinzo Yamashita, Tosuke Kaneko, published by Taiseisha Ltd. (1981) (in Japanese), and the like can be used.

Crosslinking agents used for an electron transporting layer can be isocyanate compounds and amine compounds. The crosslinking agents are more preferably crosslinking agents (isocyanate compounds, amine compounds) having 3 to 6 groups of an isocyanate group, a blocked isocyanate group or a monovalent group represented by $—CH_2—OR^1$ from the viewpoint of providing a uniform layer of a polymer.

As the isocyanate compound, an isocyanate compound having a molecular weight in the range of 200 to 1,300 can be used. An isocyanate compound having 3 to 6 isocyanate groups or blocked isocyanate groups can further be used. Examples of the isocyanate compound include isocyanurate modifications, biuret modifications, allophanate modifications and trimethylolpropane or pentaerythritol adduct modifications of triisocyanatobenzene, triisocyanatomethylbenzene, triphenylmethane triisocyanate, lysine triisocyanate, and additionally, diisocyanates such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate and norbornane diisocyanate. Above all, the modified isocyanurate and the modified adducts are more preferable.

A blocked isocyanate group is a group having a structure of $—NHCOX^1$ ($X^1$ is a blocking group). $X^1$ may be any blocking group as long as $X^1$ can be incorporated to an isocyanate group, but is more preferably a group represented by one of the following formulae (H1) to (H7).

(H1)

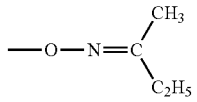

(H2)

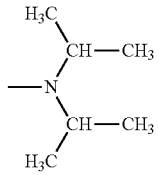

(H3)

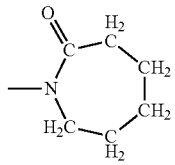

(H4)

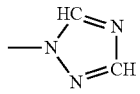

(H5)

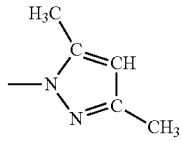

(H6)

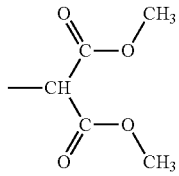

(H7)

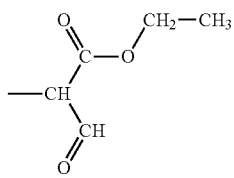

Hereinafter, specific examples of isocyanate compounds will be described.

(B1)
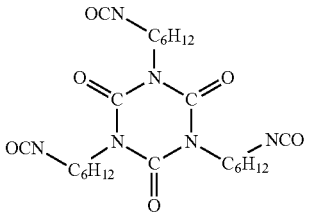
(B2)
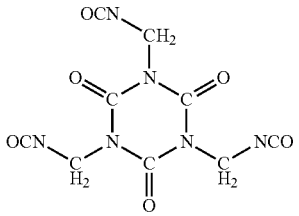
(B3)
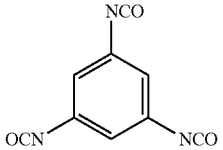
(B4)
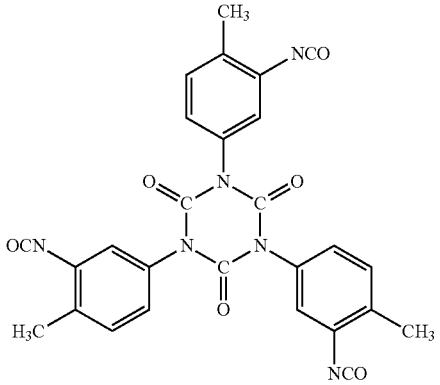
(B5)
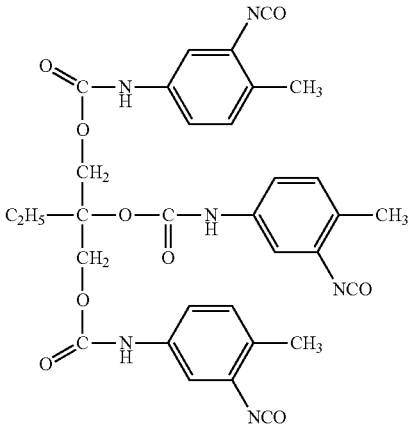
(B6)
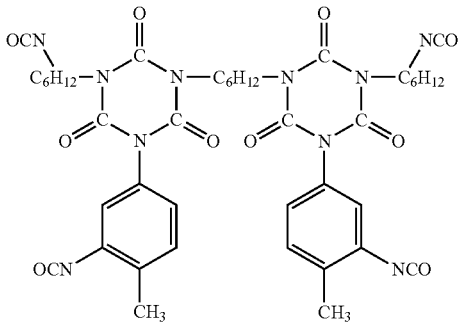
(B7)
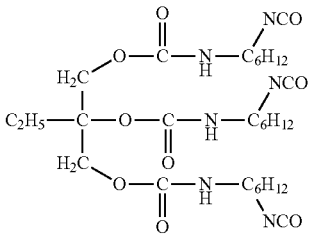
(B8)
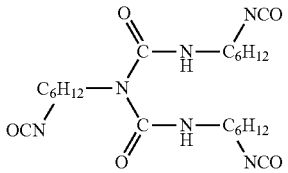
(B9)
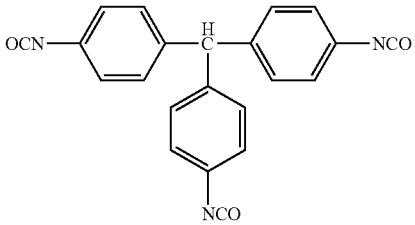
(B10)
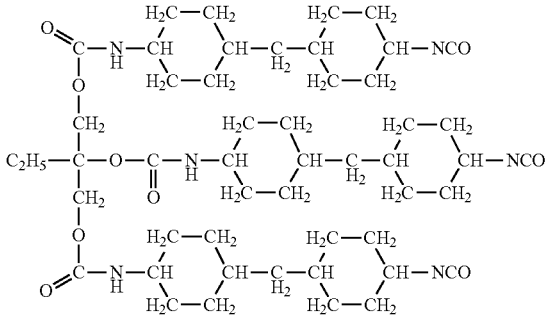

-continued
(B11)
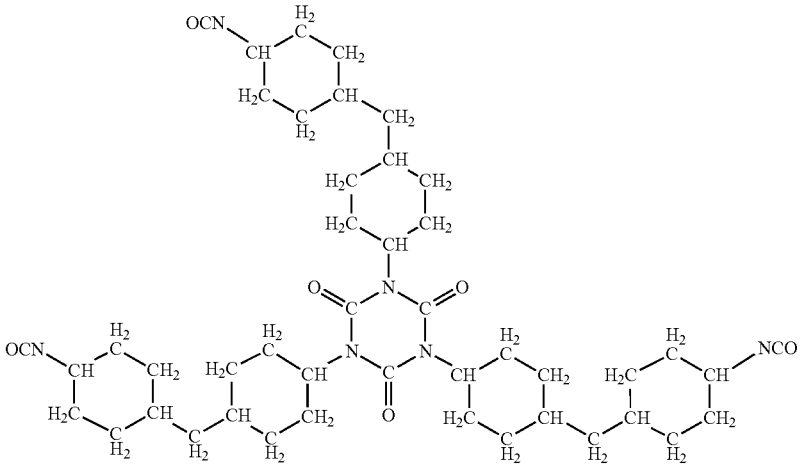
(B12)
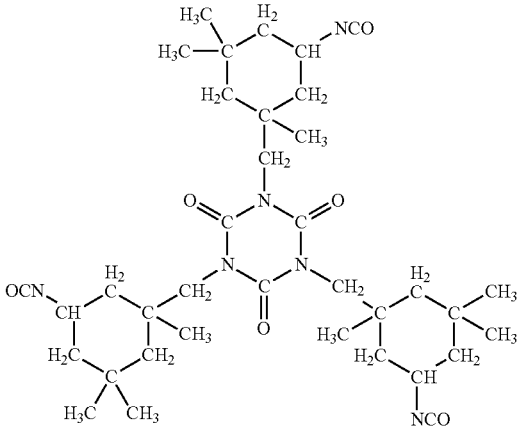
(B13)
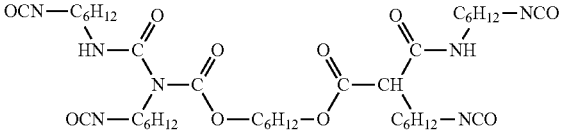
(B14)
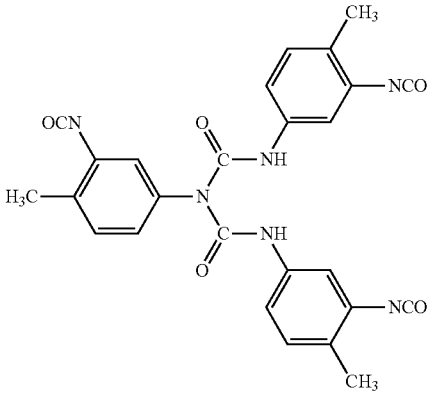
(B15)
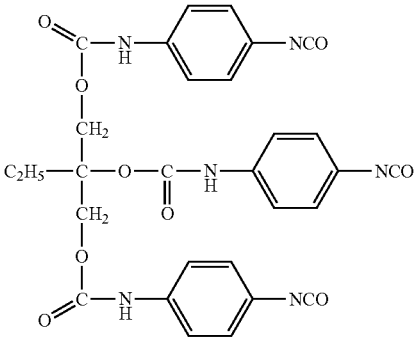

-continued (B16)

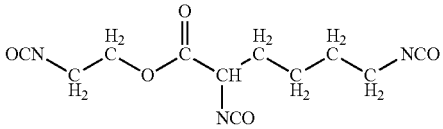

(B17)

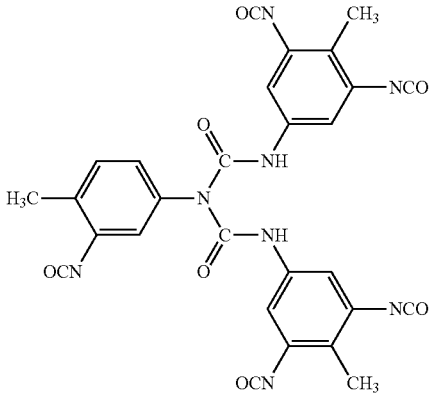

(B18)

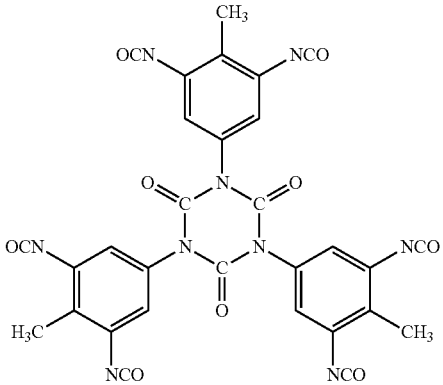

(B19)

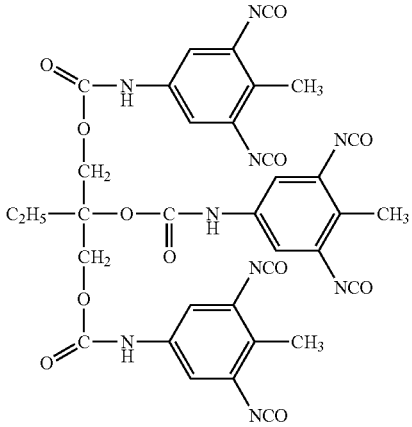

(B20)

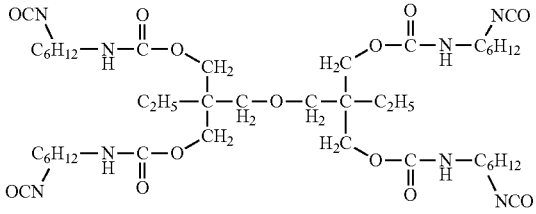

(B21)

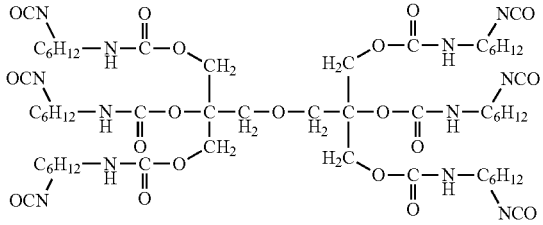

The amine compound can be at least one selected from the group consisting of compounds represented by the following formula (C1), oligomers of compounds represented by the following formula (C1), compounds represented by the following formula (C2), oligomers of compounds represented by the following formula (C2), compounds represented by the following formula (C3), oligomers of compounds represented by the following formula (C3), compounds represented by the following formula (C4), oligomers of compounds represented by the following formula (C4), compounds represented by the following formula (C5), and oligomers of compounds represented by the following formula (C5).

(C1)

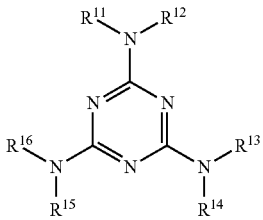

-continued (C2)

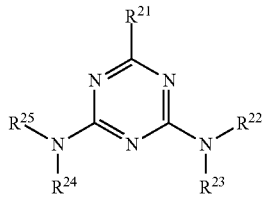

(C3)

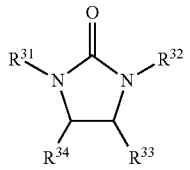

(C4)

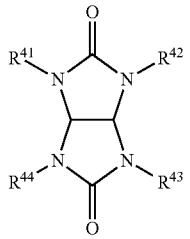

(C5)

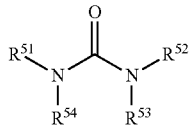

In the formulae (C1) to (C5), $R^{11}$ to $R^{16}$, $R^{22}$ to $R^{25}$, $R^{31}$ to $R^{34}$, $R^{41}$ to $R^{44}$ and $R^{51}$ to $R^{54}$ each independently represent a hydrogen atom, a hydroxy group, an acyl group or a monovalent group represented by $—CH_2—OR^1$; at least one of $R^{11}$ to $R^{16}$, at least one of $R^{22}$ to $R^{25}$, at least one of $R^{31}$ to $R^{34}$, at least one of $R^{41}$ to $R^{44}$, and at least one of $R^{51}$ to $R^{54}$ are a monovalent group represented by $—CH_2—OR^1$; $R^1$ represents a hydrogen atom or an alkyl group having 1 to 10 carbon atoms; the alkyl group can be a methyl group, an ethyl group, a propyl group (n-propyl group, iso-propyl group) or a butyl group (n-butyl group, iso-butyl group, tert-butyl group) from the viewpoint of the polymerizability; $R^{21}$ represents an aryl group, an alkyl group-substituted aryl group, a cycloalkyl group or an alkyl group-substituted cycloalkyl group.

Hereinafter, specific examples of compounds represented by one of formulae (C1) to (C5) will be described. Oligomers (multimers) of compounds represented by one of formulae (C1) to (C5) may be contained. Compounds (monomers) represented by one of formulae (C1) to (C5) can be contained in 10% by mass or more in the total mass of the amine compounds from the viewpoint of providing a uniform layer of a polymer.

The degree of polymerization of the above-mentioned multimer can be 2 or more and 100 or less. The above-mentioned multimer and monomer may be used as a mixture of two or more.

Examples of compounds represented by the above formula (C1) usually commercially available include Supermelami No. 90 (made by NOF Corp.), Superbekamine® TD-139-60, L-105-60, L127-60, L110-60, J-820-60 and G-821-60 (made by DIC Corporation), Yuban 2020 (made by Mitsui Chemicals Inc.), Sumitex Resin M-3 (made by Sumitomo Chemical Co., Ltd.), and Nikalac MW-30, MW-390 and MX-750LM (Nihon Carbide Industries, Co., Inc.). Examples of compounds represented by the above formula (C2) usually commercially available include Superbekamine® L-148-55, 13-535, L-145-60 and TD-126 (made by Dainippon Ink and Chemicals, Inc,), and Nikalac BL-60 and BX-4000 (Nihon Carbide Industries, Co., Inc.). Examples of compounds represented by the above formula (C3) usually commercially available include Nikalac MX-280 (Nihon Carbide Industries, Co., Inc.). Examples of compounds represented by the above formula (C4) usually commercially available include Nikalac MX-270 (Nihon Carbide Industries, Co., Inc.). Examples of compounds represented by the above formula (C5) usually commercially available include Nikalac MX-290 (Nihon Carbide Industries, Co., Inc.).

Hereinafter, specific examples of compounds of the formula (C1) will be described.

(C1-1)

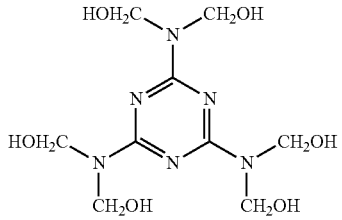

(C1-2)

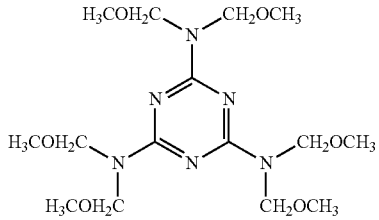

(C1-3)

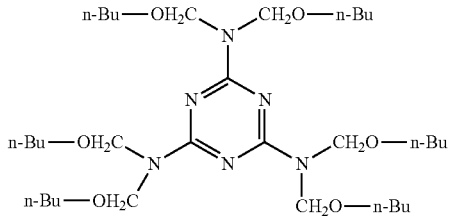

(C1-4)

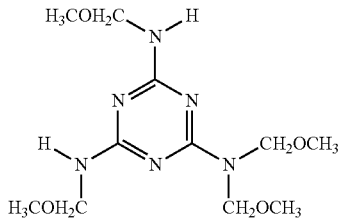

(C1-5)

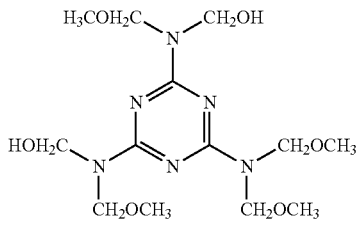

-continued
(C1-6)
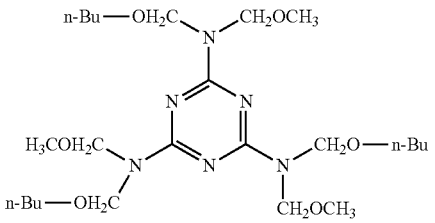
(C1-7)
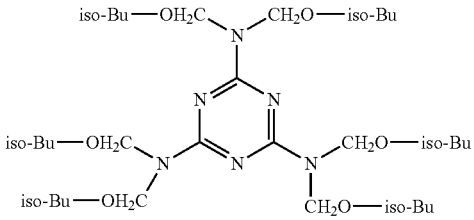
(C1-8)
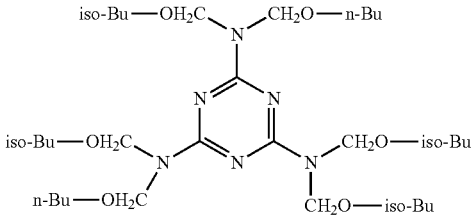
(C1-9)
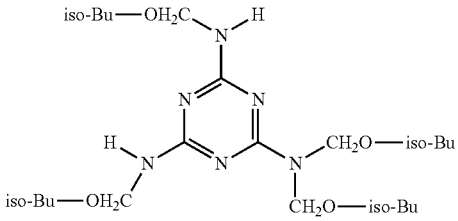
(C1-10)
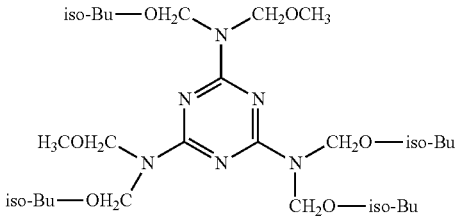
(C1-11)
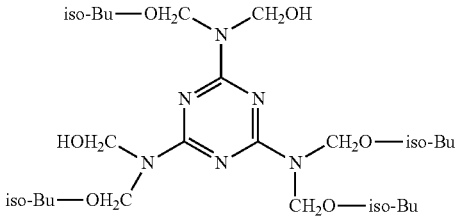
-continued
(C1-12)
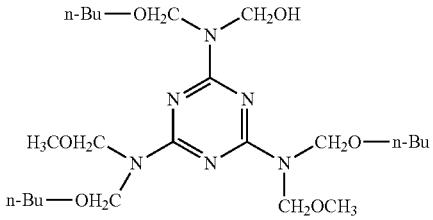
Hereinafter, specific examples of compounds of the formula (C2) will be described.
(C2-1)
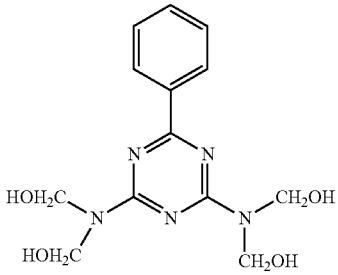
(C2-2)
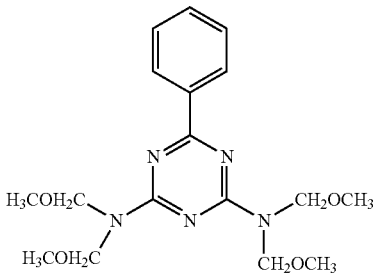
(C2-3)
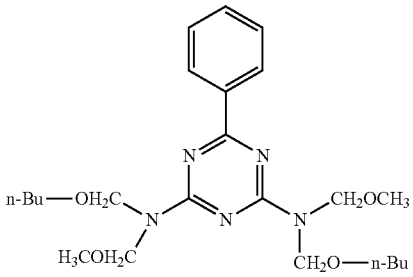
(C2-4)
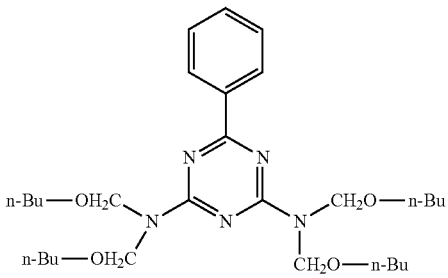

-continued
(C2-5)
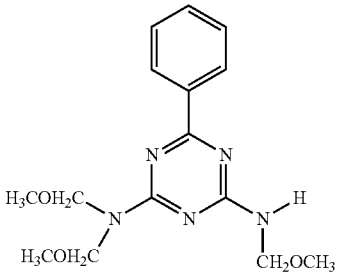
(C2-7)
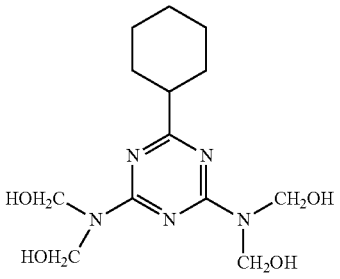
(C2-8)
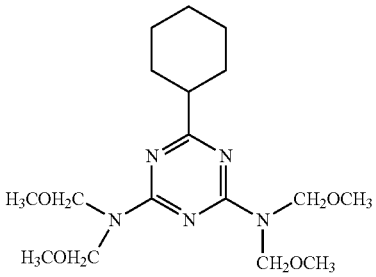
(C2-9)
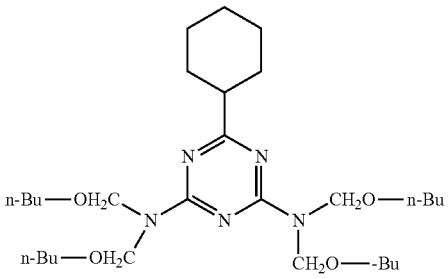
(C2-10)
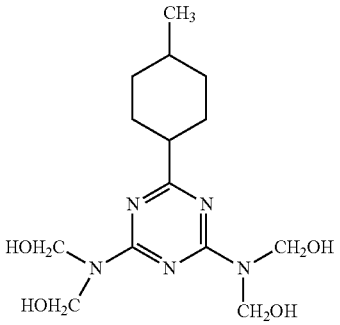
-continued
(C2-11)
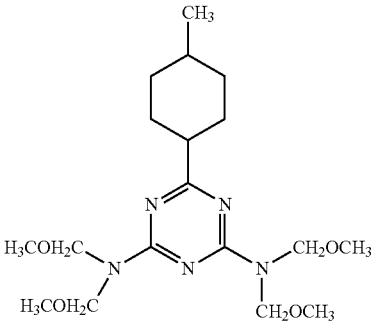
(C2-12)
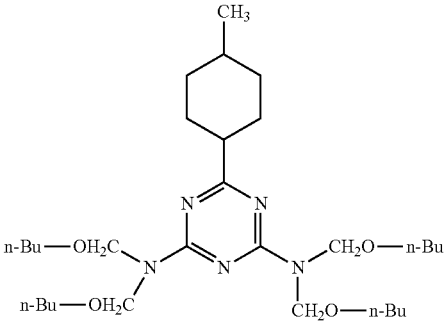
(C2-13)
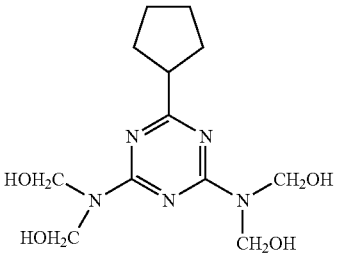
(C2-14)
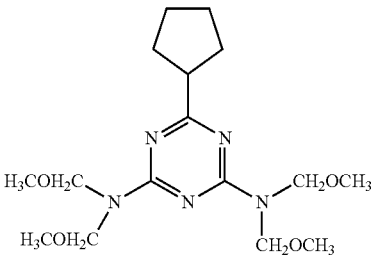
(C2-15)
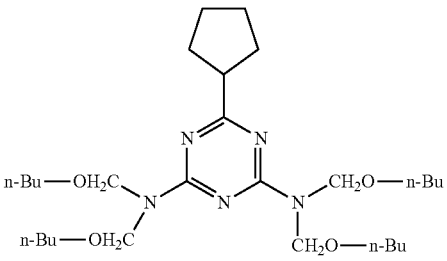

-continued
(C2-16)
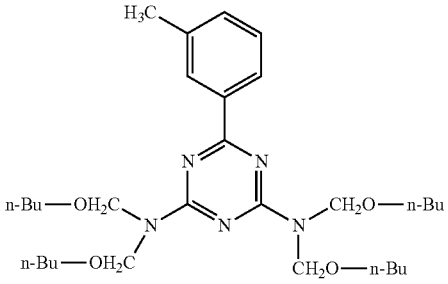
(C2-17)
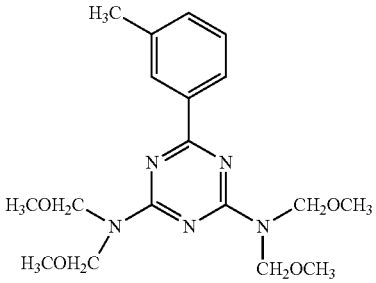
(C2-18)
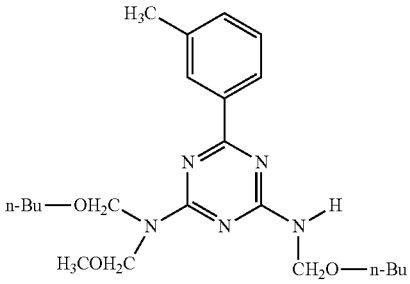
Hereinafter, specific examples of compounds of the formula (C3) will be described.
(C3-1)
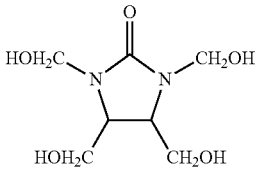
(C3-2)
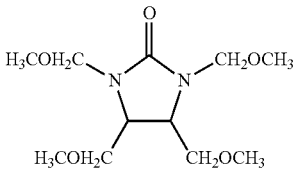
(C3-3)
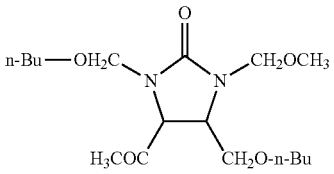
-continued
(C3-4)
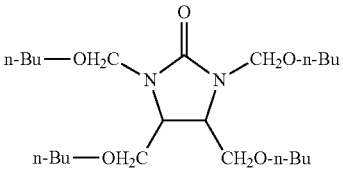
(C3-5)
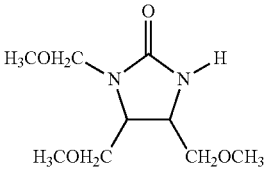
(C3-6)
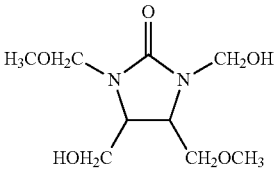
Hereinafter, specific examples of compounds of the formula (C4) will be described.
(C4-1)
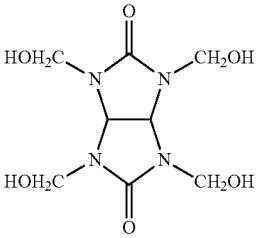
(C4-2)
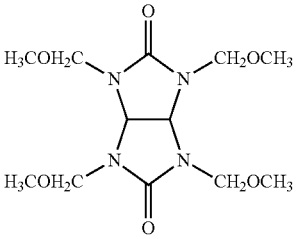
(C4-3)
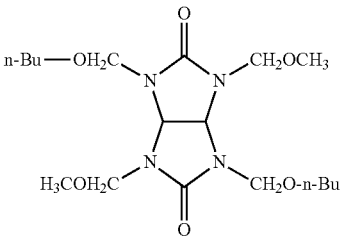

-continued (C4-4)

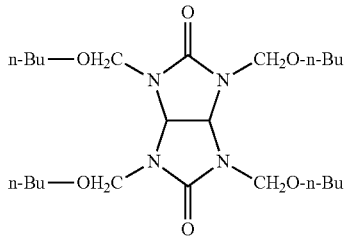

(C4-5)

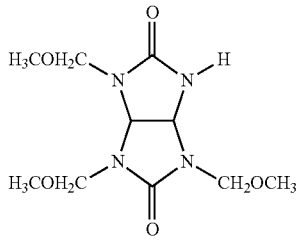

(C4-6)

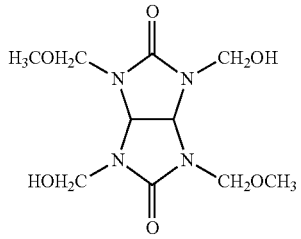

Hereinafter, specific examples of compounds of the formula (C5) will be described.

(C5-1)

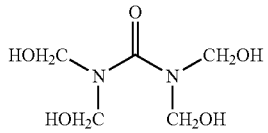

(C5-2)

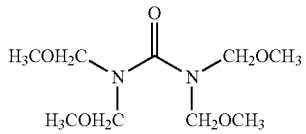

(C5-3)

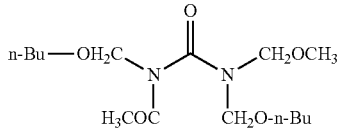

(C5-4)

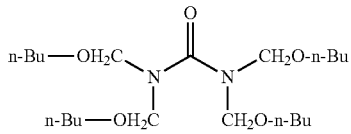

(C5-5)

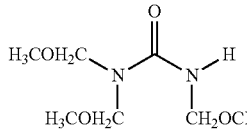

-continued (C5-6)

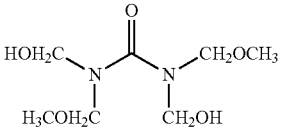

Resin

The thermoplastic resin having polymerizable functional groups will be described. The thermoplastic resin having polymerizable functional groups can be a thermoplastic resin having a structural unit represented by the following formula (D).

(D)

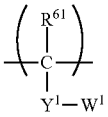

In the formula (D), $R^{61}$ represents a hydrogen atom or an alkyl group; $Y^1$ represents a single bond, an alkylene group or a phenylene group; and $W^1$ represents a hydroxy group, a thiol group, an amino group, a carboxyl group or a methoxy group.

A resin (hereinafter, also referred to as a resin D) having a structural unit represented by the formula (D) can be obtained by polymerizing, for example, a monomer commercially available from Sigma-Aldrich Japan Co., Ltd. and Tokyo Chemical Industry Co., Ltd. and having a polymerizable functional group (a hydroxy group, a thiol group, an amino group, a carboxyl group and a methoxy group).

The resins are usually commercially available. Examples of resins commercially available include polyether polyol-based resins such as AQD-457 and AQD-473 made by Nippon Polyurethane Industry Co., Ltd., and Sunnix GP-400, GP-700 and the like made by Sanyo Chemical Industries, Ltd., polyester polyol-based resins such as Phthalkid W2343 made by Hitachi Chemical Co., Ltd., Watersol S-118 and CD-520 and Beckolite M-6402-50 and M-6201-401M made by DIC Corporation, Haridip WH-1188 made by Harima Chemicals Group, Inc. and ES3604, ES6538 and the like made by Japan UPICA Co., Ltd., polyacryl polyol-based resins such as Burnock WE-300 and WE-304 made by DIC Corporation, polyvinylalcohol-based resins such as Kuraray Poval PVA-203 made by Kuraray Co., Ltd., polyvinyl acetal-based resins such as BX-1, BM-1, KS-1 and KS-5 made by Sekisui Chemical Co., Ltd., polyamide-based resins such as Toresin FS-350 made by Nagase ChemteX Corp., carboxyl group-containing resins such as Aqualic made by Nippon Shokubai Co., Ltd. and Finelex SG2000 made by Namariichi Co., Ltd., polyamine resins such as Rackamide made by DIC Corporation, and polythiol resins such as QE-340M made by Toray Industries, Inc. Above all, polyvinyl acetal-based resins, polyester polyol-based resins and the like are more preferable from the viewpoint of the polymerizability and the uniformity of an electron transporting layer.

The weight-average molecular weight (Mw) of a resin D can be in the range of 5,000 to 400,000, and is more preferably in the range of 5,000 to 300,000.

Examples of a method for quantifying a polymerizable functional group in the resin include the titration of a carboxyl group using potassium hydroxide, the titration of an amino group using sodium nitrite, the titration of a hydroxy group using acetic anhydride and potassium hydroxide, the titration of a thiol group using 5,5'-dithiobis(2-nitrobenzoic acid), and a calibration curve method using IR spectra of samples in which the incorporation ratio of a polymerizable functional group is varied.

In Table 10 hereinafter, specific examples of the resin D will be described.

TABLE 10

| | Structure | | | Mol Number per 1 g | | Molecular |
|---|---|---|---|---|---|---|
| | R61 | Y | W | of Functional | Another Site | Weight |
| D1 | H | single bond | OH | 3.3 mmol | butyral | $1 \times 10^5$ |
| D2 | H | single bond | OH | 3.3 mmol | butyral | $4 \times 10^4$ |
| D3 | H | single bond | OH | 3.3 mmol | butyral | $2 \times 10^4$ |
| D4 | H | single bond | OH | 1.0 mmol | polyolefin | $1 \times 10^5$ |
| D5 | H | single bond | OH | 3.0 mmol | ester | $8 \times 10^4$ |
| D6 | H | single bond | OH | 2.5 mmol | polyether | $5 \times 10^4$ |
| D7 | H | single bond | OH | 2.8 mmol | cellulose | $3 \times 10^4$ |
| D8 | H | single bond | COOH | 3.5 mmol | polyolefin | $6 \times 10^4$ |
| D9 | H | single bond | NH2 | 1.2 mmol | polyamide | $2 \times 10^5$ |
| D10 | H | single bond | SH | 1.3 mmol | polyolefin | $9 \times 10^3$ |
| D11 | H | phenylene | OH | 2.8 mmol | polyolefin | $4 \times 10^3$ |
| D12 | H | single bond | OH | 3.0 mmol | butyral | $7 \times 10^4$ |
| D13 | H | single bond | OH | 2.9 mmol | polyester | $2 \times 10^4$ |
| D14 | H | single bond | OH | 2.5 mmol | polyester | $6 \times 10^3$ |
| D15 | H | single bond | OH | 2.7 mmol | polyester | $8 \times 10^4$ |
| D16 | H | single bond | COOH | 1.4 mmol | polyolefin | $2 \times 10^5$ |
| D17 | H | single bond | COOH | 2.2 mmol | polyester | $9 \times 10^3$ |
| D18 | H | single bond | COOH | 2.8 mmol | polyester | $8 \times 10^2$ |
| D19 | CH3 | alkylene | OH | 1.5 mmol | polyester | $2 \times 10^4$ |
| D20 | C2H5 | alkylene | OH | 2.1 mmol | polyester | $1 \times 10^4$ |
| D21 | C2H5 | alkylene | OH | 3.0 mmol | polyester | $5 \times 10^4$ |
| D22 | H | single bond | OCH3 | 2.8 mmol | polyolefin | $7 \times 10^3$ |
| D23 | H | single bond | OH | 3.3 mmol | butyral | $2.7 \times 10^5$ |
| D24 | H | single bond | OH | 3.3 mmol | butyral | $4 \times 10^5$ |
| D25 | H | single bond | OH | 2.5 mmol | acetal | $4 \times 10^5$ |

An electron transporting substance having polymerizable functional groups can be 30% by mass or more and 70% by mass or less with respect to the total mass of a composition of the electron transporting substance having polymerizable functional groups, a crosslinking agent and a resin having polymerizable functional groups.

Support

A support can be a support having conductivity (conductive support), and for example, supports made of a metal or an alloy of aluminum, nickel, copper, gold, iron or the like can be used. The support includes supports in which a metal thin film of aluminum, silver, gold or the like is formed on an insulating support of a polyester resin, a polycarbonate resin, a polyimide resin, a glass or the like, and supports in which a conductive material thin film of indium oxide, tin oxide or the like is formed.

The surface of a support may be subjected to a treatment such as an electrochemical treatment such as anodic oxidation, a wet honing treatment, a blast treatment and a cutting treatment, in order to improve electric properties and suppress interference fringes.

A conductive layer may be provided between a support and an undercoating layer described later. The conductive layer is obtained by forming a coating film of a coating liquid for a conductive layer in which a conductive particle is dispersed in a resin, on the support, and drying the coating film. Examples of the conductive particle include carbon black, acetylene black, metal powders such as aluminum, nickel, iron, nichrome, copper, zinc and silver, and metal oxide powders such as conductive tin oxide and ITO.

Examples of the resin include polyester resins, polycarbonate resins, polyvinyl butyral resins, acryl resins, silicone resin, epoxy resins, melamine resins, urethane resins, phenol resins and alkid resins.

Examples of a solvent of a coating liquid for a conductive layer include etheric solvents, alcoholic solvents, ketonic solvents and aromatic hydrocarbon solvents. The thickness of a conductive layer can be 0.2 μm or more and 40 μm or less, is more preferably 1 μm or more and 35 μm or less, and still more preferably 5 μm or more and 30 μm or less.

Charge Generating Layer

A charge generating layer is provided on an undercoating layer (electron transporting layer).

A charge generating substance includes azo pigments, perylene pigments, anthraquinone derivatives, anthoanthrone derivatives, dibenzopyrenequinone derivatives, pyranthrone derivatives, violanthrone derivatives, isoviolanthrone derivatives, indigo derivatives, thioindigo derivatives, phthalocyanine pigments such as metal phthalocyanines and non-metal phthalocyanines, and bisbenzimidazole derivatives. Above all, at least one of azo pigments and phthalocyanine pigments can be used. Among phthalocyanine pigments, oxytitanium phthalocyanine, chlorogallium phthalocyanine and hydroxygallium phthalocyanine can be used.

Examples of a binder resin used for a charge generating layer include polymers and copolymers of vinyl compounds such as styrene, vinyl acetate, vinyl chloride, acrylic ester, methacrylic ester, vinylidene fluoride and trifluoroethylene, polyvinyl alcohol resins, polyvinyl acetal resins, polycarbonate resins, polyester resins, polysulfone resins, polyphenylene oxide resins, polyurethane resins, cellulosic resins, phenol resins, melamine resins, silicon resins and epoxy resins. Above all, polyester resins, polycarbonate resins and polyvinyl acetal resins can be used, and polyvinyl acetal is more preferable.

In a charge generating layer, the ratio (charge generating substance/binder resin) of a charge generating substance and a binder resin can be in the range of 10/1 to 1/10, and is more preferably in the range of 5/1 to 1/5. A solvent used for a coating liquid for a charge generating layer includes alcoholic solvents, sulfoxide-based solvents, ketonic solvents, etheric solvents, esteric solvents and aromatic hydrocarbon solvents.

The thickness of a charge generating layer can be 0.05 μm or more and 5 μm or less.

Hole Transporting Layer

A hole transporting layer is provided on a charge generating layer.

Examples of a hole transporting substance include polycyclic aromatic compounds, heterocyclic compounds, hydrazone compounds, styryl compounds, benzidine compounds, and triarylamine compounds, triphenylamine, and polymers having a group derived from these compounds in the main chain or side chain. Above all, triarylamine compounds, benzidine compounds and styryl compounds can be used.

Examples of a binder resin used for a hole transporting layer include polyester resins, polycarbonate resins, polymethacrylic ester resins, polyarylate resins, polysulfone resins and polystyrene resins. Above all, polycarbonate resins and polyarylate resins can be used. With respect to the molecular weight thereof, the weight-average molecular weight (Mw) can be in the range of 10,000 to 300,000.

In a hole transporting layer, the ratio (hole transporting substance/binder resin) of a hole transporting substance and a binder resin can be 10/5 to 5/10, and is more preferably 10/8 to 6/10.

The thickness of a hole transporting layer can be 3 μm or more and 40 μm or less. The thickness is more preferably 5 μm or more and 16 μm or less from the viewpoint of the thickness of the electron transporting layer. A solvent used for a coating liquid for a hole transporting layer includes alcoholic solvents, sulfoxide-based solvents, ketonic solvents, etheric solvents, esteric solvents and aromatic hydrocarbon solvents.

Another layer such as a second undercoating layer which does not contain a polymer according to the present invention may be provided between a support and the electron transporting layer and between the electron transporting layer and a charge generating layer.

A surface protecting layer may be provided on a hole transporting layer. The surface protecting layer contains a conductive particle or a charge transporting substance and a binder resin. The surface protecting layer may further contain additives such as a lubricant. The binder resin itself of the protecting layer may have conductivity and charge transportability; in this case, the protecting layer does not need to contain a conductive particle and a charge transporting substance other than the binder resin. The binder resin of the protecting layer may be a thermoplastic resin, and may be a curable resin capable of being polymerized by heat, light, radiation (electron beams) or the like.

A method for forming each layer such as an electron transporting layer, a charge generating layer and a hole transporting layer constituting an electrophotographic photosensitive member can be a method in which a coating liquid obtained by dissolving and/or dispersing a material constituting the each layer in a solvent is applied, and the obtained coating film is dried and/or cured. Examples of a method of applying the coating liquid include an immersion coating method, a spray coating method, a curtain coating method and a spin coating method. Above all, an immersion coating method can be used from the viewpoint of efficiency and productivity.

Process Cartridge and Electrophotographic Apparatus

Figure 6:
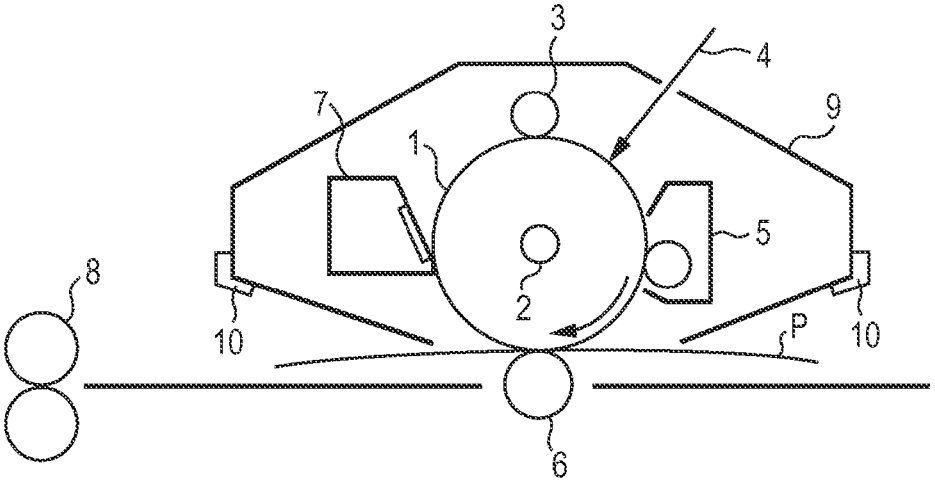
FIG. 6 is a diagram illustrating an outline constitution of an electrophotographic apparatus having a process cartridge having an electrophotographic photosensitive member.

FIG. 6 illustrates an outline constitution of an electrophotographic apparatus having a process cartridge having an electrophotographic photosensitive member.

In FIG. 6, reference numeral 1 denotes a cylindrical electrophotographic photosensitive member, which is rotationally driven at a predetermined peripheral speed in the arrow direction around a shaft 2 as a center. A surface (peripheral surface) of the rotationally driven electrophotographic photosensitive member 1 is uniformly charged at a predetermined positive or negative potential by a charging unit 3 (primary charging unit: charging roller or the like). Then, the surface is subjected to irradiation light (image-irradiation light) 4 from a light irradiation unit (not illustrated) such as slit light irradiation or laser beam scanning light irradiation. Electrostatic latent images corresponding to objective images are successively formed on the surface of the electrophotographic photosensitive member 1 in such a manner.

The electrostatic latent images formed on the surface of the electrophotographic photosensitive member 1 are developed with a toner contained in a developer of a developing unit 5 to thereby make toner images. Then, the toner images formed and carried on the surface of the electrophotographic photosensitive member 1 are successively transferred to a transfer material (paper or the like) P by a transferring bias from a transfer unit (transfer roller or the like) 6. The transfer material P is delivered from a transfer material feed unit (not illustrated) and fed to between the electrophotographic photosensitive member 1 and the transfer unit 6 (to a contacting part) synchronously with the rotation of the electrophotographic photosensitive member 1.

The transfer material P having the transferred toner images is separated from the surface of the electrophotographic photosensitive member 1, introduced to a fixing unit 8 to be subjected to image fixation, and printed out as an image-formed matter (print, copy) outside the apparatus.

The surface of the electrophotographic photosensitive member 1 after the toner image transfer is subjected to removal of the untransferred developer (toner) by a cleaning unit (cleaning blade or the like) 7 to be thereby cleaned. Then, the surface is subjected to a charge-neutralizing treatment with irradiation light (not illustrated) from a light irradiation unit (not illustrated), and thereafter used repeatedly for image formation. As illustrated in FIG. 6, in the case where the charging unit 3 is a contacting charging unit using a charging roller or the like, the light irradiation is not necessarily needed.

A plurality of some constituting elements out of constituting elements including the electrophotographic photosensitive member 1, the charging unit 3, the developing unit 5, the transfer unit 6 and the cleaning unit 7 described above may be selected and accommodated in a container and integrally constituted as a process cartridge; and the process cartridge may be constituted detachably from an electrophotographic apparatus body of a copying machine, a laser beam printer or the like. In FIG. 6, the electrophotographic photosensitive member 1, the charging unit 3, the developing unit 5 and the cleaning unit 7 are integrally supported and made as a cartridge to thereby make a process cartridge 9 attachable to and detachable from an electrophotographic apparatus body by using a guiding unit 10 such as rails of the electrophotographic apparatus body.

EXAMPLES

Then, the fabrication and evaluation of electrophotographic photosensitive members will be described.

Example 1

An aluminum cylinder (JIS-A3003, an aluminum alloy) of 260.5 mm in length and 30 mm in diameter was made to be a support (conductive support).

Then, 50 parts of a titanium oxide particle coated with an oxygen-deficient tin oxide (powder resistivity: 120 Ω·cm, coverage factor of tin oxide: 40%), 40 parts of a phenol resin (Plyophen J-325, made by DIC Corporation, resin solid content: 60%), and 50 parts of methoxypropanol as a solvent (dispersion solvent) were placed in a sand mill using a glass bead of 1 mm in diameter, and subjected to a dispersion treatment for 3 hours to thereby prepare a coating liquid (dispersion liquid) for a conductive layer. The coating liquid for a conductive layer was immersion coated on the support, and the obtained coating film was dried and heat polymerized for 30 min at 150° C. to thereby form a conductive layer having a thickness of 16 μm.

The average particle diameter of the titanium oxide particle coated with an oxygen-deficient tin oxide in the coating liquid for a conductive layer was measured by a centrifugal precipitation method using tetrahydrofuran as a dispersion medium at a rotation frequency of 5,000 rpm by using a particle size distribution analyzer (trade name: CAPA700) made by HORIBA Ltd. As a result, the average particle diameter was 0.31 μm.

Then, 4 parts of the electron transporting substance (A101), 7.3 parts of the crosslinking agent (B1:blocking group (H1)=5.1:2.2 (mass ratio)), 0.9 part of the resin (D1) and 0.05 part of dioctyltin laurate as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer (undercoating layer) having a thickness of 0.53 μm.

The content of the electron transporting substance with respect to the total mass of the electron transporting substance, the crosslinking agent and the resin was 33% by mass.

Then, 10 parts of a hydroxylgallium phthalocyanine crystal (charge generating substance) having a crystal form exhibiting strong peaks at Bragg angles (2θ±0.2°) of 7.5°, 9.9°, 12.5°, 16.3°, 18.6°, 25.1° and 28.3° in CuKα characteristic X-ray diffractometry, 5 parts of a polyvinyl butyral resin (trade name: Eslec BX-1, made by Sekisui Chemical Co., Ltd.) and 250 parts of cyclohexanone were placed in a sand mill using a glass bead of 1 mm in diameter, and subjected to a dispersion treatment for 1.5 hours. Then, 250 parts of ethyl acetate was added thereto to thereby prepare a coating liquid for a charge generating layer. The coating liquid for a charge generating layer was immersion coated on the electron transporting layer, and the obtained coating film was dried for 10 min at 100° C. to thereby form a charge generating layer having a thickness of 0.15 μm. A laminated body having the support, the conductive layer, the electron transporting layer, and the charge generating layer was formed in such a manner.

Then, 8 parts of a triarylamine compound (hole transporting substance) represented by the following structural formula (15), and 10 parts of a polyarylate having a repeating structural unit represented by the following formula (16-1) and a repeating structural unit represented by the following formula (16-2) in a proportion of 5/5 and having a weight-average molecular weight (Mw) of 100,000 were dissolved in a mixed solvent of 40 parts of dimethoxymethane and 60 parts of chlorobenzene to thereby prepare a coating liquid for a hole transporting layer. The coating liquid for a hole transporting layer was immersion coated on the charge generating layer, and the obtained coating film was dried for 40 min at 120° C. to thereby form a hole transporting layer having a thickness of 15 μm.

(15)

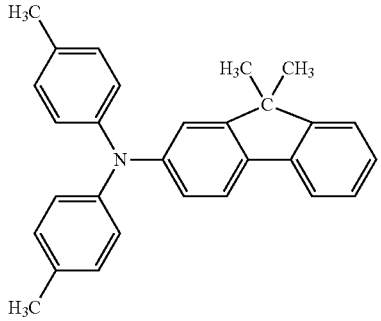

(16-1)

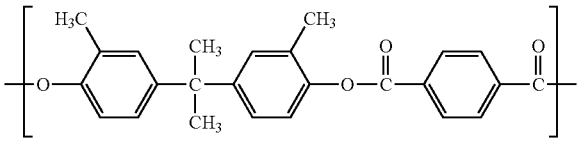

(16-2)

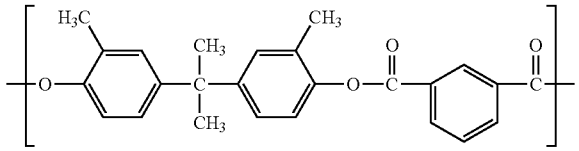

In such a manner, an electrophotographic photosensitive member having the laminated body and the hole transporting layer for evaluating the positive ghost and the potential variation was manufactured. Further as in the above, one more electrophotographic photosensitive member was manufactured, and made as an electrophotographic photosensitive member for determination.

(Determination Test)

The electrophotographic photosensitive member for determination was immersed for 5 min in a mixed solvent of 40 parts of dimethoxymethane and 60 parts of chlorobenzene; and the hole transporting layer was peeled off, and thereafter the resultant was dried for 10 min at 100° C. to thereby fabricate a laminated body having the support, the electron transporting layer and the charge generating layer in this order, and was made as a photosensitive member for the determination. The surface was confirmed to have no hole transporting layer by using an FTIR-ATR method.

Then, the electrophotographic photosensitive member for determination was allowed to stand under an environment of a temperature of 25° C. and a humidity of 50% RH for 24 hours; thereafter, by using the above-mentioned determination method, and as described above, Vd1 (the expression 1) and Vd2 (the expression 2) were calculated, and Vl1, Vl2 and Vl3 were measured, and |Vl2−Vl1| and |(Vd2−Vl3)/Vd2| were calculated. The measurement results are shown in Table 11.

(Evaluations of the Positive Ghost and the Potential Variation)

The electrophotographic photosensitive member for evaluating the positive ghost and the potential variation was mounted on a remodeled apparatus of a laser beam printer (trade name: LBP-2510) made by Canon Corp.; and the following process condition was set and the evaluation of the surface potential (potential variation) and the evaluation of the printed-out image (ghost) were carried out. The remodeling involved altering the process speed to 200 mm/s, making the dark area potential to be −700 V, and making the light intensity of the irradiation light (image-irradiation light) variable. Details are as follows.

1. Evaluation of the Positive Ghost

A process cartridge for a cyan color of the laser beam printer was remodeled, and a potential probe (model: 6000B-8, made by Trek Japan KK) was mounted on a development position; and the electrophotographic photosensitive member for evaluating the positive ghost and the potential variation was mounted, and the potential of the center portion of the electrophotographic photosensitive member was measured under an environment of a temperature of 23° C. and a humidity of 50% RH by using a surface electrometer (model: 344, made by Trek Japan KK). The irradiation light intensity was adjusted so that the dark area potential (Vd) of the surface potential of the electrophotographic photosensitive member became −700 V and the light area potential (Vl) thereof became −200 V.

Then, the electrophotographic photosensitive member was mounted on the process cartridge for a cyan color of the laser beam printer, and the process cartridge was mounted on a process cartridge station for cyan, and images were printed out. Images were continuously printed out in the order of one sheet of a solid white image, 5 sheets of an image for ghost evaluation, one sheet of a solid black image and 5 sheets of an image for ghost evaluation.

Figure 7A:
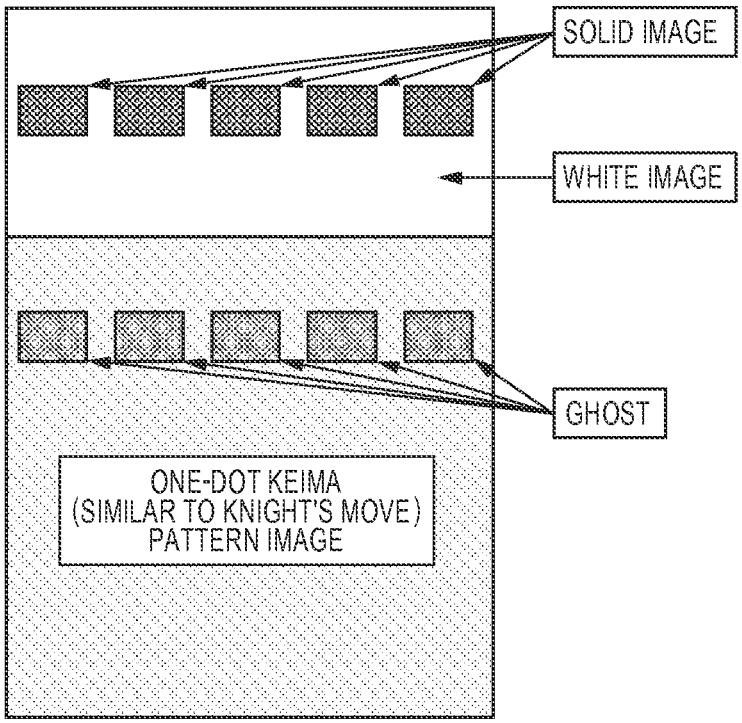
FIG. 7A is a diagram to describe an image for ghost evaluation used in ghost image evaluation.
Figure 7B:
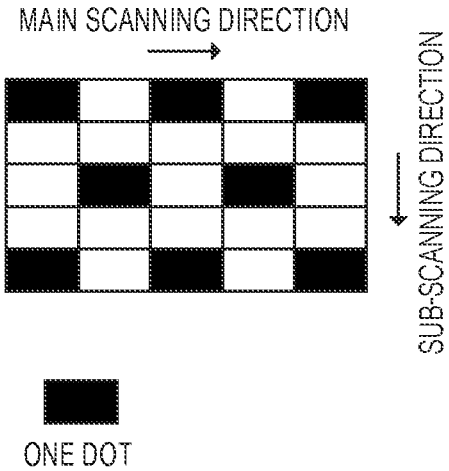
FIG. 7B is a diagram to describe a one-dot keima (similar to knight's move) pattern image.

The image for ghost evaluation, as illustrated in FIG. 7A, had a "white image" printed out in the lead part thereof in which square "solid images" were printed, and had a "halftone image of a one-dot keima pattern" illustrated in FIG. 7B, fabricated after the lead part. In FIG. 7A, "ghost" parts were parts where ghosts caused by the "solid images" may have emerged.

The evaluation of the positive ghost was carried out by measuring the density difference between the image density of a halftone image of a one-dot keima pattern and the image density of a ghost part. 10 points of the density differences were measured in one sheet of an image for ghost evaluation by a spectrodensitometer (trade name: X-Rite 504/508, made by X-Rite Inc.). This operation was carried out for all of 10 sheets of the image for ghost evaluation, and the average of 100 points in total was calculated. The results are shown in Table 11. It is found that a higher density of a ghost part caused a stronger positive ghost. It is meant that a smaller Macbeth density difference more suppressed the positive ghost. A ghost image density difference (Macbeth density difference) of 0.05 or more gave a level thereof having a visually obvious difference, and a ghost image density difference of less than 0.05 gave a level thereof having no visually obvious difference.

2. Potential Variation

A process cartridge for a cyan color of the laser beam printer was remodeled, and a potential probe (model: 6000B-8, made by Trek Japan KK) was mounted on the development position; and the potential of the center portion of the electrophotographic photosensitive member was measured under an environment of a temperature of 23° C. and a humidity of 5% RH by using a surface electrometer (model: 344, made by Trek Japan KK). The irradiation light intensity was adjusted so that the dark area potential (Vd) became −700 V and the light area potential (Vl) became −200 V. The electrophotographic photosensitive member was repeatedly used at the above irradiation light intensity in that state (the state in which the potential probe was at the place where a developing unit would have been) for 1,000 sheets continuously. Vd and Vl after the continuous 1,000-sheets repeated use thereof are shown in Table 11.

Examples 2 to 5

Electrophotographic photosensitive members were manufactured and evaluated as in Example 1, except for altering the thickness of the electron transporting layer from 0.53 μm to 0.38 μm (Example 2), 0.25 μm (Example 3), 0.20 μm (Example 4) and 0.15 μm (Example 5). The results are shown in Table 11.

Example 6

An electrophotographic photosensitive member was manufactured and evaluated as in Example 1, except for forming an electron transporting layer as follows. The results are shown in Table 11.

4 parts of the electron transporting substance (A101), 5.5 parts of the isocyanate compound (B1:blocking group (H1)=5.1:2.2 (mass ratio)), 0.3 part of the resin (D1) and 0.05 part of dioctyltin laurate as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.61 μm.

Examples 7 to 9

Electrophotographic photosensitive members were manufactured and evaluated as in Example 6, except for altering the thickness of the electron transporting layer from 0.61 μm to 0.52 μm (Example 7), 0.40 μm (Example 8) and 0.26 μm (Example 9). The results are shown in Table 11.

Example 10

An electrophotographic photosensitive member was manufactured and evaluated as in Example 1, except for forming an electron transporting layer as follows. The results are shown in Table 11.

5 parts of the electron transporting substance (A-101), 2.3 parts of the amine compound (C1-3), 3.3 parts of the resin (D1) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.51 μm.

Examples 11 and 12

Electrophotographic photosensitive members were manufactured and evaluated as in Example 10, except for altering the thickness of the electron transporting layer from 0.51 μm to 0.45 μm (Example 11) and 0.34 μm (Example 12). The results are shown in Table 11.

Example 13

An electrophotographic photosensitive member was manufactured and evaluated as in Example 1, except for forming an electron transporting layer as follows. The results are shown in Table 11.

5 parts of the electron transporting substance (A-101), 1.75 parts of the amine compound (C1-3), 2.0 parts of the resin (D1) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.70 μm.

Examples 14 to 16

Electrophotographic photosensitive members were manufactured and evaluated as in Example 13, except for altering the thickness of the electron transporting layer from 0.70 μm to 0.58 μm (Example 14), 0.50 μm (Example 15) and 0.35 μm (Example 16). The results are shown in Table 11.

Examples 17 to 32

Electrophotographic photosensitive members were manufactured and evaluated as in Example 9, except for altering the electron transporting substance of Example 9 from (A-101) to electron transporting substances shown in Table 11. The results are shown in Table 11.

Examples 33 to 47

Electrophotographic photosensitive members were manufactured and evaluated as in Example 16, except for altering the electron transporting substance of Example 16 from (A-101) to electron transporting substances shown in Tables 11 and 12. The results are shown in Tables 11 and 12.

Examples 48 to 53

Electrophotographic photosensitive members were manufactured and evaluated as in Example 9, except for altering the crosslinking agent (B1:blocking group (H1)=5.1:2.2 (mass ratio)) of Example 9 to crosslinking agents shown in Table 12. The results are shown in Table 12.

Examples 54 and 55

Electrophotographic photosensitive members were manufactured and evaluated as in Example 16, except for altering the crosslinking agent (C1-3) of Example 16 to crosslinking agents shown in Table 12. The results are shown in Table 12.

Example 56

An electrophotographic photosensitive member was manufactured and evaluated as in Example 1, except for forming an electron transporting layer as follows. The results are shown in Table 12.

4 parts of the electron transporting substance (A-101), 4 parts of the amine compound (C1-9), 1.5 parts of the resin (D1) and 0.2 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.35 μm.

Examples 57 and 58

Electrophotographic photosensitive members were manufactured and evaluated as in Example 56, except for altering the crosslinking agent (C1-9) of Example 56 to crosslinking agents shown in Table 12. The results are shown in Table 12.

Examples 59 to 62

Electrophotographic photosensitive members were manufactured and evaluated as in Example 9, except for altering the resin (D1) of Example 9 to resins shown in Table 12. The results are shown in Table 12.

Example 63

An electrophotographic photosensitive member was manufactured and evaluated as in Example 1, except for forming an electron transporting layer as follows. The results are shown in Table 12.

6 parts of the electron transporting substance (A-124), 2.1 parts of the amine compound (C1-3), 1.2 parts of the resin (D1) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.45 μm.

Examples 64 and 65

Electrophotographic photosensitive members were manufactured and evaluated as in Example 63, except for altering the electron transporting substance of Example 63 from (A-124) to electron transporting substances shown in Table 12. The results are shown in Table 12.

Example 66

An electrophotographic photosensitive member was manufactured and evaluated as in Example 1, except for forming an electron transporting layer as follows. The results are shown in Table 12.

6 parts of the electron transporting substance (A-125), 2.1 parts of the amine compound (C1-3), 0.5 part of the resin (D1) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.49 μm.

Example 67

An electrophotographic photosensitive member was manufactured and evaluated as in Example 1, except for forming an electron transporting layer as follows. The results are shown in Table 12.

6.5 parts of the electron transporting substance (A-125), 2.1 parts of the amine compound (C1-3), 0.4 part of the resin (D1) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.49 μm.

Example 68

An electrophotographic photosensitive member was manufactured and evaluated as in Example 66, except for altering the thickness of the electron transporting layer from 0.49 μm to 0.72 μm. The results are shown in Table 12.

Example 69

An electrophotographic photosensitive member was manufactured and evaluated as in Example 1, except for forming an electron transporting layer as follows. The results are shown in Table 12.

3.6 parts of the electron transporting substance (A101), 7 parts of the isocyanate compound (B1:blocking group (H1)=5.1:2.2 (mass ratio)), 1.3 parts of the resin (D1) and 0.05 part of dioctyltin laurate as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.32 μm.

Example 70

An electrophotographic photosensitive member was manufactured and evaluated as in Example 1, except for altering the thickness of the charge generating layer from 0.15 μm to 0.12 μm. The results are shown in Table 12.

Example 71

An electrophotographic photosensitive member was manufactured and evaluated as in Example 1, except for forming a charge generating layer as follows. The results are shown in Table 12.

10 parts of oxytitanium phthalocyanine exhibiting strong peaks at Bragg angles (2θ±0.2°) of 9.0°, 14.2°, 23.9° and 27.1° in CuKα X-ray diffractometry was used, and 166 parts of a solution was prepared in which a polyvinyl butyral (trade name: Eslec BX-1, made by Sekisui Chemical Co., Ltd.) was dissolved in a mixed solvent of cyclohexanone:water=97:3 to make a 5% by mass solution. The solution and 150 parts of the mixed solvent of cyclohexanone:water=97:3 were together dispersed for 4 hours in a sand mill apparatus using 400 parts of a glass bead of 1 mmϕ, and thereafter, 210 parts of the mixed solvent of cyclohexanone:water=97:3 and 260 parts of cyclohexanone were added thereto to thereby prepare a coating liquid for a charge generating layer. The coating liquid for a charge generating layer was immersion coated on the electron transporting layer, and the obtained coating film was dried for 10 min at 80° C. to thereby form a charge generating layer having a thickness of 0.20 μm.

Example 72

An electrophotographic photosensitive member was manufactured and evaluated as in Example 1, except for forming charge generating layer as follows. The results are shown in Table 12.

20 parts of a bisazo pigment represented by the following structural formula (17) and 10 parts of a polyvinyl butyral resin (trade name: Eslec BX-1, made by Sekisui Chemical Co., Ltd.) were mixed and dispersed in 150 parts of tetrahydrofuran to thereby prepare a coating liquid for a charge generating layer. The coating liquid was applied on a bare aluminum tube as a conductive substrate by a dip coat method, and dried by heating at 110° C. for 30 min to thereby form a charge generating layer having a thickness of 0.30 μm.

(17)

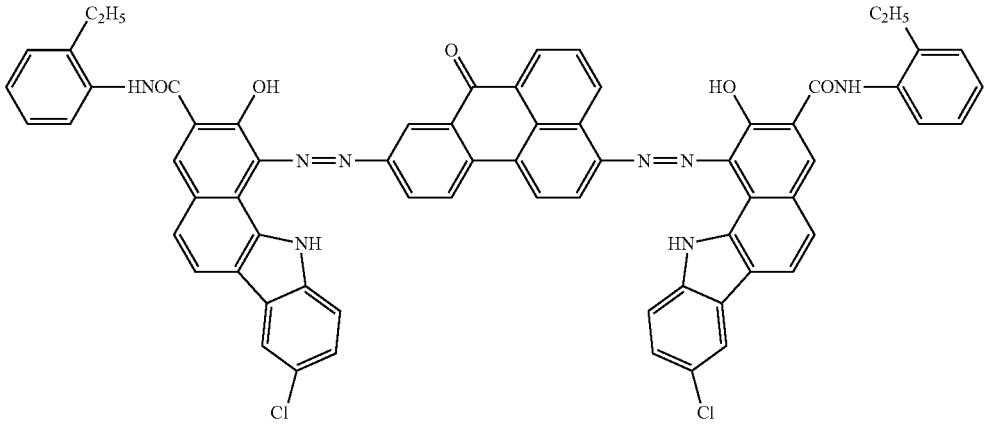

Example 73

An electrophotographic photosensitive member was manufactured and evaluated as in Example 1, except for altering the triarylamine compound (hole transporting substance) of Example 1 to a benzidine compound (hole transporting substance) represented by the following structural formula (18) to form a hole transporting layer. The results are shown in Table 12.

(18)

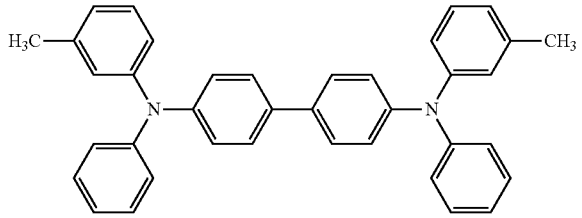

Example 74

An electrophotographic photosensitive member was manufactured and evaluated as in Example 1, except for altering the triarylamine compound (hole transporting substance) of Example 1 to a styryl compound (hole transporting substance) represented by the following structural formula (19) to form a hole transporting layer. The results are shown in Table 12.

(19)

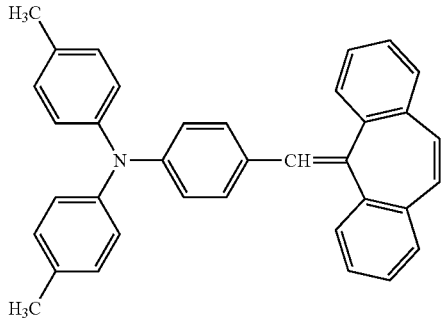

Examples 75 and 76

Electrophotographic photosensitive members were manufactured and evaluated as in Example 1, except for altering the thickness of the hole transporting layer from 15 μm to 10 μm (Example 75) and 25 μm (Example 76). The results are shown in Table 12.

Example 77

An aluminum cylinder (JIS-A3003, an aluminum alloy) of 260.5 mm in length and 30 mm in diameter was made to be a support (conductive support).

Then, 214 parts of a titanium oxide ($TiO_2$) particle coated with an oxygen-deficient tin oxide ($SnO_2$) as a metal oxide particle, 132 parts of a phenol resin (trade name: Plyophen J-325) as a binder resin, and 98 parts of 1-methoxy-2-propanol as a solvent were placed in a sand mill using 450 parts of a glass bead of 0.8 mm in diameter, and subjected to a dispersion treatment under the conditions of a rotation frequency of 2,000 rpm, a dispersion treatment time of 4.5 hours and a set temperature of a cooling water of 18° C. to thereby obtain a dispersion liquid. The glass bead was removed from the dispersion liquid by a mesh (mesh opening: 150 μm). A silicone resin particle (trade name: Tospearl 120, made by Momentive Performance Materials Inc., average particle diameter: 2 μm) as a surface-roughening material was added to the dispersion liquid after the removal of the glass bead so as to become 10% by mass with respect to the total mass of the metal oxide particle and the binder resin in the dispersion liquid; and a silicone oil (trade name: SH28PA, made by Dow Corning Toray Co., Ltd.) as a leveling agent was added to the dispersion liquid so as to become 0.01% by mass with respect to the total mass of the metal oxide particle and the binder resin in the dispersion liquid; and the resultant mixture was stirred to thereby prepare a coating liquid for a conductive layer. The coating liquid for a conductive layer was immersion coated on a support, and the obtained coating film was dried and heat cured for 30 min at 150° C. to thereby form a conductive layer having a thickness of 30 μm.

Then, 6.2 parts of the electron transporting substance (A157), 8.0 parts of the crosslinking agent (B1:blocking group (H5)=5.1:2.9 (mass ratio)), 1.1 parts of the resin (D25) and 0.05 part of dioctyltin laurate as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer (undercoating layer) having a thickness of 0.53 μm. The content of the electron transporting substance with respect to the total mass of the electron transporting substance, the crosslinking agent and the resin was 34% by mass.

Then, a charge generating layer having a thickness of 0.15 μm was formed as in Example 1.

9 parts of the triarylamine compound represented by the above structural formula (15), 1 part of a benzidine compound (hole transporting substance) represented by the following structural formula (18), 3 parts of a polyester resin E (weight-average molecular weight: 90,000) having a repeating structural unit represented by the following formula (24), and a repeating structural unit represented by the following formula (26) and a repeating structural unit represented by the following formula (25) in a ratio of 7:3, and 7 parts of a polyester resin F (weight-average molecular weight: 120,000) having a repeating structure represented by the following formula (27) and a repeating structure represented by the following formula (28) in a ratio of 5:5 were dissolved in a mixed solvent of 30 parts of dimethoxymethane and 50 parts of orthoxylene to thereby prepare a coating liquid for a hole transporting layer. Here, the content of the repeating structural unit represented by the following formula (24) in the polyester resin E was 10% by mass, and the content of the repeating structural units represented by the following formulae (25) and (26) therein was 90% by mass.

(18)

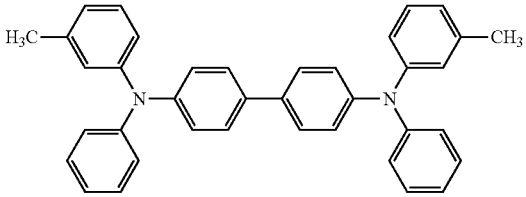

(24)

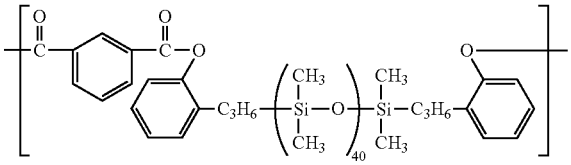

(25)

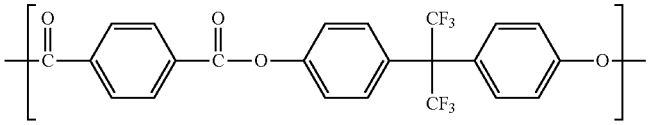

(26)

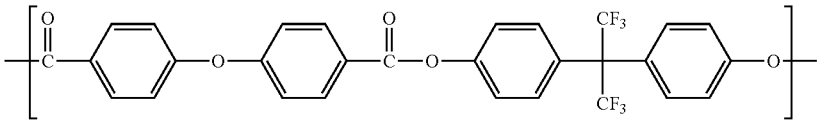

(27)

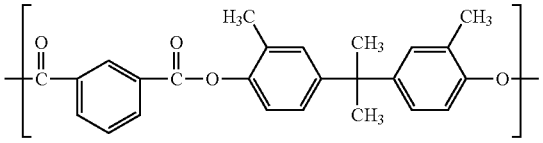

(28)

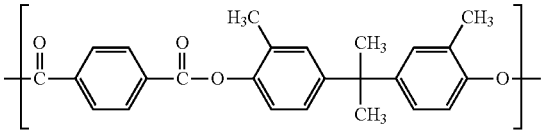

The coating liquid for a hole transporting layer was immersion coated on the charge generating layer, and dried for 1 hour at 120° C. to thereby form a hole transporting layer having a thickness of 16 μm. The formed hole transporting layer was confirmed to have a domain structure in which a matrix containing the hole transporting substance and the polyester resin F contained the polyester resin E.

The evaluation was carried out as in Example 1. The results are shown in Table 13.

Example 78

An electrophotographic photosensitive member was manufactured as in Example 1, except for forming a hole transporting layer as follows. The results are shown in Table 13.

9 parts of the triarylamine compound represented by the above structural formula (15), 1 part of the benzidine compound represented by the above structural formula (18), 10 parts of a polycarbonate resin G (weight-average molecular weight: 70,000) having a repeating structure represented by the following formula (29), and 0.3 part of a polycarbonate resin H (weight-average molecular weight: 40,000) having a repeating structure represented by the following formula (29), a repeating structure represented by the following formula (30) and a structure of at least one terminal represented by the following formula (31) were dissolved in a mixed solvent of 30 parts of dimethoxymethane and 50 parts of orthoxylene to thereby prepare a coating liquid for a hole transporting layer. Here, the total mass of the repeating structural units represented by the following formulae (30) and (31) in the polycarbonate resin H was 30% by mass. The coating liquid for a hole transporting layer was immersion coated on the charge generating layer, and dried for 1 hour at 120° C. to thereby form a hole transporting layer having a thickness of 16 μm.

(29)

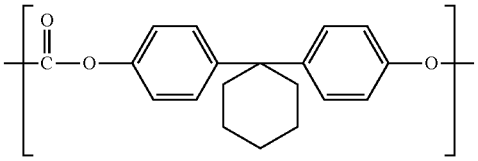

(30)

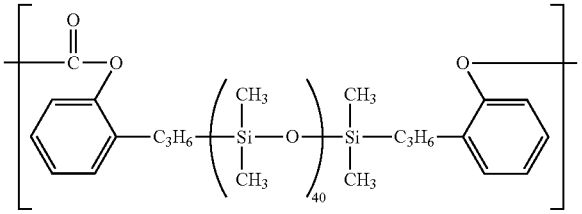

(31)

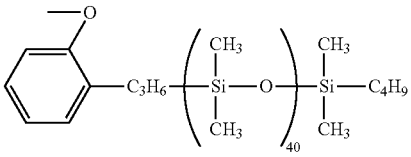

Example 79

An electrophotographic photosensitive member was manufactured and evaluated as in Example 78, except for altering 10 parts of the polycarbonate resin G (weight-average molecular weight: 70,000) in the coating liquid for a hole transporting layer of Example 78 to 10 parts of the polyester resin F (weight-average molecular weight: 120,000). The results are shown in Table 13.

Example 80

An electrophotographic photosensitive member was manufactured and evaluated as in Example 77, except for forming a conductive layer as follows. The results are shown in Table 13.

207 parts of a titanium oxide ($TiO_2$) particle coated with a tin oxide ($SnO_2$) doped with phosphorus (P) as a metal oxide particle, 144 parts of a phenol resin (trade name: Plyophen J-325) as a binder resin, and 98 parts of 1-methoxy-2-propanol as a solvent were placed in a sand mill using 450 parts of a glass bead of 0.8 mm in diameter, and subjected to a dispersion treatment under the conditions of a rotation frequency of 2,000 rpm, a dispersion treatment time of 4.5 hours and a set temperature of a cooling water of 18° C. to thereby obtain a dispersion liquid. The glass bead was removed from the dispersion liquid by a mesh (mesh opening: 150 μm).

A silicone resin particle (trade name: Tospearl 120) as a surface-roughening material was added to the dispersion liquid after the removal of the glass bead so as to become 15% by mass with respect to the total mass of the metal oxide particle and the binder resin in the dispersion liquid; and a silicone oil (trade name: SH28PA) as a leveling agent was added to the dispersion liquid so as to become 0.01% by mass with respect to the total mass of the metal oxide particle and the binder resin in the dispersion liquid; and the resultant mixture was stirred to thereby prepare a coating liquid for a conductive layer. The coating liquid for a conductive layer was immersion coated on a support, and the obtained coating film was dried and heat cured for 30 min at 150° C. to thereby form a conductive layer having a thickness of 30 μm.

Examples 81 to 99

Electrophotographic photosensitive members were manufactured and evaluated as in Example 77, except for altering the electron transporting substance of Example 77 from (A157) to electron transporting substances shown in Table 13. The results are shown in Table 13.

Comparative Example 1

An electrophotographic photosensitive member was manufactured and evaluated as in Example 1, except for forming an electron transporting layer as follows. As a result of carrying out the determination method, as illustrated in FIG. 4B, the surface potential could not decay by up to 20% with respect to Vd1 after light irradiation. The results are shown in Table 12.

2.4 parts of the electron transporting substance (A101), 4.2 parts of the isocyanate compound (B1:blocking group (H1)=5.1:2.2 (mass ratio)), 5.4 parts of the resin (D1) and 0.05 part of dioctyltin laurate as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.53 μm.

Comparative Example 2

An electrophotographic photosensitive member was manufactured and evaluated as in Example 1, except for forming an electron transporting layer as follows. The results are shown in Table 12.

3.2 parts of the electron transporting substance (A101), 5.0 parts of the isocyanate compound (B1:blocking group (H1)=5.1:2.2 (mass ratio)), 4.2 parts of the resin (D1) and 0.05 part of dioctyltin laurate as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.53 μm.

Comparative Examples 3 and 4

Electrophotographic photosensitive members were manufactured and evaluated as in Comparative Example 2, except for altering the thickness of the electron transporting layer from 0.53 μm to 0.40 μm (Comparative Example 3) and 0.32 μm (Comparative Example 4). The results are shown in Table 12.

Comparative Examples 5 to 8

Electrophotographic photosensitive members were manufactured and evaluated as in Example 1, except for altering the thickness of the electron transporting layer from 0.53 μm to 0.78 μm (Comparative Example 5), 1.03 μm (Comparative Example 6), 1.25 μm (Comparative Example 7) and 1.48 μm (Comparative Example 8). The results are shown in Table 12.

Comparative Example 9

An electrophotographic photosensitive member was manufactured and evaluated as in Example 1, except for forming an electron transporting layer as follows. The results are shown in Table 12.

4 parts of the electron transporting substance (A225), 3 parts of hexamethylene diisocyanate and 4.0 parts of the resin (D1) were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 1.00 μm.

Comparative Example 10

An electrophotographic photosensitive member was manufactured and evaluated as in Example 1, except for forming an electron transporting layer as follows. The results are shown in Table 12.

5 parts of the electron transporting substance (A124), 2.5 parts of 2,4-toluene diisocyanate and 2.5 parts by mass of a poly(p-hydroxystyrene) (trade name: Malkalinker, made by Maruzen Petrochemical Co., Ltd.) were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.40 μm.

Comparative Example 11

An electrophotographic photosensitive member was manufactured and evaluated as in Example 1, except for forming an electron transporting layer as follows. The results are shown in Table 12.

7.0 parts of the electron transporting substance (A124), 2.0 parts of 2,4-toluene diisocyanate and 1.0 part of a poly(p-hydroxystyrene) (trade name: Malkalinker, made by Maruzen Petrochemical Co., Ltd.) were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.40 μm.

TABLE 11

| Example | Electron Transportin | Crosslinking Agent | Resin | Ratio of Electron | Layer Thickness | \|Vl2 − Vl1\| | \|(Vd2 − Vl3)/Vd2\| | Ghost | Vd(V) | Vl(V) |
|---|---|---|---|---|---|---|---|---|---|---|
| 1 | A101 | B1: H1 | D1 | 33% | 0.53 | 0.32 | 0.13 | 0.03 | −700 | −200 |
| 2 | A101 | B1: H1 | D1 | 33% | 0.38 | 0.28 | 0.13 | 0.03 | −700 | −200 |
| 3 | A101 | B1: H1 | D1 | 33% | 0.25 | 0.26 | 0.12 | 0.03 | −700 | −200 |
| 4 | A101 | B1: H1 | D1 | 33% | 0.20 | 0.25 | 0.12 | 0.03 | −700 | −200 |
| 5 | A101 | B1: H1 | D1 | 33% | 0.15 | 0.20 | 0.10 | 0.04 | −700 | −200 |
| 6 | A101 | B1: H1 | D1 | 41% | 0.61 | 0.28 | 0.14 | 0.02 | −700 | −200 |
| 7 | A101 | B1: H1 | D1 | 41% | 0.52 | 0.23 | 0.14 | 0.02 | −700 | −200 |
| 8 | A101 | B1: H1 | D1 | 41% | 0.40 | 0.20 | 0.12 | 0.03 | −700 | −200 |
| 9 | A101 | B1: H1 | D1 | 41% | 0.26 | 0.20 | 0.11 | 0.03 | −700 | −200 |
| 10 | A101 | C1-3 | D1 | 47% | 0.51 | 0.26 | 0.15 | 0.02 | −700 | −200 |
| 11 | A101 | C1-3 | D1 | 47% | 0.45 | 0.18 | 0.15 | 0.01 | −700 | −200 |
| 12 | A101 | C1-3 | D1 | 47% | 0.34 | 0.10 | 0.13 | 0.02 | −700 | −200 |
| 13 | A101 | C1-3 | D1 | 57% | 0.70 | 0.27 | 0.15 | 0.03 | −700 | −200 |
| 14 | A101 | C1-3 | D1 | 57% | 0.58 | 0.20 | 0.15 | 0.02 | −700 | −200 |
| 15 | A101 | C1-3 | D1 | 57% | 0.50 | 0.15 | 0.15 | 0.02 | −700 | −200 |
| 16 | A101 | C1-3 | D1 | 57% | 0.35 | 0.12 | 0.13 | 0.03 | −700 | −200 |
| 17 | A106 | B1: H1 | D1 | 41% | 0.26 | 0.23 | 0.11 | 0.03 | −700 | −200 |
| 18 | A108 | B1: H1 | D1 | 41% | 0.26 | 0.24 | 0.11 | 0.03 | −700 | −200 |
| 19 | A116 | B1: H1 | D1 | 41% | 0.26 | 0.23 | 0.11 | 0.03 | −700 | −200 |
| 20 | A119 | B1: H1 | D1 | 41% | 0.26 | 0.21 | 0.11 | 0.03 | −700 | −200 |
| 21 | A120 | B1: H1 | D1 | 41% | 0.26 | 0.20 | 0.11 | 0.03 | −700 | −200 |
| 22 | A124 | B1: H1 | D1 | 41% | 0.26 | 0.24 | 0.11 | 0.03 | −700 | −200 |
| 23 | A130 | B1: H1 | D1 | 41% | 0.26 | 0.26 | 0.11 | 0.04 | −700 | −200 |
| 24 | A156 | B1: H1 | D1 | 41% | 0.26 | 0.25 | 0.11 | 0.04 | −700 | −200 |
| 25 | A214 | B1: H1 | D1 | 41% | 0.26 | 0.29 | 0.10 | 0.04 | −700 | −200 |
| 26 | A310 | B1: H1 | D1 | 41% | 0.26 | 0.30 | 0.10 | 0.04 | −700 | −200 |
| 27 | A423 | B1: H1 | D1 | 41% | 0.26 | 0.31 | 0.11 | 0.04 | −700 | −200 |
| 28 | A523 | B1: H1 | D1 | 41% | 0.26 | 0.34 | 0.10 | 0.04 | −700 | −200 |
| 29 | A618 | B1: H1 | D1 | 41% | 0.26 | 0.34 | 0.10 | 0.04 | −700 | −200 |
| 30 | A731 | B1: H1 | D1 | 41% | 0.26 | 0.33 | 0.11 | 0.04 | −700 | −200 |
| 31 | A819 | B1: H1 | D1 | 41% | 0.26 | 0.31 | 0.10 | 0.04 | −700 | −200 |
| 32 | A919 | B1: H1 | D1 | 41% | 0.26 | 0.30 | 0.10 | 0.04 | −700 | −200 |
| 33 | A106 | C1-3 | D1 | 57% | 0.35 | 0.14 | 0.12 | 0.01 | −700 | −200 |
| 34 | A113 | C1-3 | D1 | 57% | 0.35 | 0.15 | 0.11 | 0.01 | −700 | −200 |
| 35 | A116 | C1-3 | D1 | 57% | 0.35 | 0.16 | 0.12 | 0.01 | −700 | −200 |
| 36 | A120 | C1-3 | D1 | 57% | 0.35 | 0.14 | 0.12 | 0.01 | −700 | −200 |
| 37 | A124 | C1-3 | D1 | 57% | 0.35 | 0.14 | 0.11 | 0.01 | −700 | −200 |
| 38 | A136 | C1-3 | D1 | 57% | 0.35 | 0.16 | 0.12 | 0.01 | −700 | −200 |
| 39 | A201 | C1-3 | D1 | 57% | 0.35 | 0.17 | 0.11 | 0.03 | −700 | −200 |
| 40 | A306 | C1-3 | D1 | 57% | 0.35 | 0.18 | 0.12 | 0.03 | −700 | −200 |
| 41 | A306 | C1-3 | D1 | 57% | 0.35 | 0.17 | 0.12 | 0.02 | −700 | −200 |
| 42 | A404 | C1-3 | D1 | 57% | 0.35 | 0.16 | 0.11 | 0.02 | −700 | −200 |
| 43 | A510 | C1-3 | D1 | 57% | 0.35 | 0.15 | 0.12 | 0.02 | −700 | −200 |
| 44 | A602 | C1-3 | D1 | 57% | 0.35 | 0.18 | 0.11 | 0.03 | −700 | −200 |

TABLE 12

| Example | Electron Transporting Substance | Crosslinking Agent | Resin | Ratio of Electron Transporting Substance | Layer Thickness (μm) | \| Vl2 − Vl1 \| | \| (Vd2 − Vl3)/Vd2 \| | Ghost | Vd(V) | Vl(V) |
|---|---|---|---|---|---|---|---|---|---|---|
| 45 | A709 | C1-3 | D1 | 57% | 0.35 | 0.19 | 0.11 | 0.03 | −700 | −200 |
| 46 | A807 | C1-3 | D1 | 57% | 0.35 | 0.18 | 0.12 | 0.02 | −700 | −200 |
| 47 | A902 | C1-3 | D1 | 57% | 0.35 | 0.16 | 0.12 | 0.02 | −700 | −200 |
| 48 | A101 | B1: H2 | D1 | 41% | 0.26 | 0.20 | 0.11 | 0.03 | −700 | −200 |
| 49 | A101 | B1: H3 | D1 | 41% | 0.26 | 0.20 | 0.11 | 0.03 | −700 | −200 |
| 50 | A101 | B4: H1 | D1 | 41% | 0.26 | 0.20 | 0.11 | 0.03 | −700 | −200 |
| 51 | A101 | B5: H1 | D1 | 41% | 0.26 | 0.20 | 0.11 | 0.03 | −700 | −200 |
| 52 | A101 | B7: H1 | D1 | 41% | 0.26 | 0.20 | 0.11 | 0.03 | −700 | −200 |
| 53 | A101 | B12: H1 | D1 | 41% | 0.26 | 0.20 | 0.11 | 0.03 | −700 | −200 |
| 54 | A101 | C1-1 | D1 | 57% | 0.35 | 0.12 | 0.13 | 0.02 | −700 | −200 |
| 55 | A101 | C1-7 | D1 | 57% | 0.35 | 0.12 | 0.13 | 0.02 | −700 | −200 |
| 56 | A101 | C1-9 | D1 | 42% | 0.35 | 0.19 | 0.13 | 0.02 | −700 | −200 |
| 57 | A101 | C2-1 | D1 | 42% | 0.35 | 0.19 | 0.13 | 0.02 | −700 | −200 |
| 58 | A101 | C3-3 | D1 | 42% | 0.35 | 0.19 | 0.13 | 0.02 | −700 | −200 |
| 59 | A101 | B1: H1 | D3 | 41% | 0.26 | 0.20 | 0.11 | 0.03 | −700 | −200 |
| 60 | A101 | B1: H1 | D5 | 41% | 0.26 | 0.19 | 0.11 | 0.03 | −700 | −200 |
| 61 | A101 | B1: H1 | D19 | 41% | 0.26 | 0.18 | 0.11 | 0.03 | −700 | −200 |
| 62 | A101 | B1: H1 | D20 | 41% | 0.26 | 0.18 | 0.11 | 0.03 | −700 | −200 |
| 63 | A124 | C1-3 | D1 | 65% | 0.40 | 0.12 | 0.14 | 0.01 | −700 | −200 |
| 64 | A130 | C1-3 | D1 | 65% | 0.40 | 0.13 | 0.15 | 0.01 | −700 | −200 |
| 65 | A156 | C1-3 | D1 | 65% | 0.40 | 0.11 | 0.14 | 0.01 | −700 | −200 |
| 66 | A125 | C1-3 | D1 | 70% | 0.49 | 0.11 | 0.16 | 0.01 | −700 | −200 |
| 67 | A125 | C1-3 | D1 | 72% | 0.49 | 0.13 | 0.15 | 0.02 | −700 | −200 |
| 68 | A125 | C1-3 | D1 | 70% | 0.72 | 0.26 | 0.15 | 0.02 | −700 | −200 |
| 69 | A101 | B1: H1 | D1 | 30% | 0.32 | 0.35 | 0.11 | 0.04 | −700 | −200 |
| 70 | A101 | B1: H1 | D1 | 33% | 0.53 | 0.32 | 0.14 | 0.03 | −700 | −200 |
| 71 | A101 | B1: H1 | D1 | 33% | 0.53 | 0.32 | 0.12 | 0.04 | −700 | −200 |
| 72 | A101 | B1: H1 | D1 | 33% | 0.53 | 0.32 | 0.14 | 0.03 | −700 | −200 |
| 73 | A101 | B1: H1 | D1 | 33% | 0.53 | 0.32 | 0.14 | 0.03 | −700 | −200 |
| 74 | A101 | B1: H1 | D1 | 33% | 0.53 | 0.32 | 0.14 | 0.03 | −700 | −200 |
| 75 | A101 | B1: H1 | D1 | 33% | 0.53 | 0.32 | 0.14 | 0.03 | −700 | −200 |
| 76 | A101 | B1: H1 | D1 | 33% | 0.53 | 0.32 | 0.14 | 0.04 | −700 | −200 |
| Comparative Example 1 | A101 | B1: H1 | D1 | 20% | 0.53 | — | — | 0.1 | −700 | −230 |
| Comparative Example 2 | A101 | B1: H1 | D1 | 25% | 0.53 | 0.42 | 0.04 | 0.07 | −700 | −200 |
| Comparative Example 3 | A101 | B1: H1 | D1 | 25% | 0.40 | 0.35 | 0.04 | 0.07 | −700 | −200 |
| Comparative Example 4 | A101 | B1: H1 | D1 | 25% | 0.32 | 0.32 | 0.04 | 0.07 | −700 | −200 |
| Comparative Example 5 | A101 | B1: H1 | D1 | 33% | 0.78 | 0.52 | 0.14 | 0.07 | −700 | −200 |
| Comparative Example 6 | A101 | B1: H1 | D1 | 33% | 1.03 | 0.86 | 0.14 | 0.08 | −700 | −205 |
| Comparative Example 7 | A101 | B1: H1 | D1 | 33% | 1.25 | 1.61 | 0.13 | 0.09 | −700 | −210 |
| Comparative Example 8 | A101 | B1: H1 | D1 | 33% | 1.48 | 2.13 | 0.13 | 0.1 | −700 | −215 |
| Comparative Example 9 | A225 | hexamethylene diisocyanate | D1 | 36% | 1.00 | 0.82 | 0.08 | 0.07 | −700 | −200 |
| Comparative Example 10 | A124 | 2,4-toluene diisocyanate | poly(p-hydroxystyrene | 50% | 0.40 | 0.37 | 0.05 | 0.07 | −700 | −200 |
| Comparative Example 11 | A124 | 2,5-toluene diisocyanate | poly(p-hydroxystyrene | 50% | 0.40 | 0.39 | 0.03 | 0.07 | −700 | −200 |

TABLE 13

| Example | Electron Transporting Substance | Crosslinking Agent | Resin | Ratio of Electron Transporting Substance | Layer Thickness (μm) | \| Vl2 − Vl1 \| | \| (Vd2 − Vl3)/Vd2 \| | Ghost | Vd | Vl |
|---|---|---|---|---|---|---|---|---|---|---|
| 77 | A157 | B1: H5 | D25 | 41% | 0.47 | 0.29 | 0.11 | 0.03 | −700 | −200 |
| 78 | A157 | B1: H5 | D25 | 41% | 0.47 | 0.30 | 0.12 | 0.03 | −700 | −200 |
| 79 | A157 | B1: H5 | D25 | 41% | 0.47 | 0.30 | 0.12 | 0.03 | −700 | −200 |
| 80 | A157 | B1: H5 | D25 | 41% | 0.47 | 0.31 | 0.13 | 0.04 | −700 | −200 |
| 81 | A124 | B1: H5 | D25 | 41% | 0.47 | 0.30 | 0.12 | 0.04 | −700 | −200 |
| 82 | A125 | B1: H5 | D25 | 41% | 0.47 | 0.30 | 0.12 | 0.03 | −700 | −200 |
| 83 | A152 | B1: H5 | D25 | 41% | 0.47 | 0.32 | 0.12 | 0.04 | −700 | −200 |
| 84 | A159 | B1: H5 | D25 | 41% | 0.47 | 0.30 | 0.12 | 0.03 | −700 | −200 |
| 85 | A164 | B1: H5 | D25 | 41% | 0.47 | 0.30 | 0.13 | 0.03 | −700 | −200 |
| 86 | A166 | B1: H5 | D25 | 41% | 0.47 | 0.28 | 0.12 | 0.04 | −700 | −200 |

TABLE 13-continued

| Example | Electron Transporting Substance | Crosslinking Agent | Resin | Ratio of Electron Transporting Substance | Layer Thickness (μm) | \| Vl2 − Vl1 \| | \| (Vd2 − Vl3)/Vd2 \| | Ghost | Vd | Vl |
|---|---|---|---|---|---|---|---|---|---|---|
| 87 | A167 | B1: H5 | D25 | 41% | 0.47 | 0.30 | 0.12 | 0.04 | −700 | −200 |
| 88 | A168 | B1: H5 | D25 | 41% | 0.47 | 0.31 | 0.13 | 0.03 | −700 | −200 |
| 89 | A172 | B1: H5 | D25 | 41% | 0.47 | 0.30 | 0.12 | 0.03 | −700 | −200 |
| 90 | A177 | B1: H5 | D25 | 41% | 0.47 | 0.30 | 0.12 | 0.03 | −700 | −200 |
| 91 | A178 | B1: H5 | D25 | 41% | 0.47 | 0.29 | 0.13 | 0.03 | −700 | −200 |
| 92 | A207 | B1: H5 | D25 | 41% | 0.47 | 0.32 | 0.12 | 0.04 | −700 | −200 |
| 93 | A315 | B1: H5 | D25 | 41% | 0.47 | 0.32 | 0.14 | 0.04 | −700 | −200 |
| 94 | A402 | B1: H5 | D25 | 41% | 0.47 | 0.33 | 0.16 | 0.03 | −700 | −200 |
| 95 | A509 | B1: H5 | D25 | 41% | 0.47 | 0.34 | 0.13 | 0.03 | −700 | −200 |
| 96 | A602 | B1: H5 | D25 | 41% | 0.47 | 0.33 | 0.14 | 0.04 | −700 | −200 |
| 97 | A707 | B1: H5 | D25 | 41% | 0.47 | 0.35 | 0.16 | 0.03 | −700 | −200 |
| 98 | A819 | B1: H5 | D25 | 41% | 0.47 | 0.32 | 0.16 | 0.03 | −700 | −200 |
| 99 | A908 | B1: H5 | D25 | 41% | 0.47 | 0.33 | 0.15 | 0.03 | −700 | −200 |

Comparative Example 12

An electrophotographic photosensitive member was manufactured and evaluated as in Example 1, except for forming an electron transporting layer as follows. As a result of carrying out the determination method, as illustrated in FIG. 4B, the surface potential could not decay by up to 20% with respect to Vd1 after light irradiation. The results are shown in Table 14.

5 parts of the electron transporting substance (A922), 13.5 parts of an isocyanate compound (Sumidule 3173, made by Sumitomo Bayer Urethane Co., Ltd.), 10 parts of a butyral resin (BM-1, made by Sekisui Chemical Co., Ltd.) and 0.005 part by mass of dioctyltin laurate as a catalyst were dissolved in a solvent of 120 parts by mass of methyl ethyl ketone to thereby prepare a coating liquid for an electron transporting layer. The coating liquid for an electron transporting layer was immersion coated on the conductive layer, and the obtained coating film was heated for 40 min at 170° C. to be polymerized to thereby form an electron transporting layer having a thickness of 1.00 μm.

Comparative Example 13

An electrophotographic photosensitive member was manufactured and evaluated as in Example 1, except for forming an electron transporting layer as follows. The results are shown in Table 13.

5 parts of the electron transporting substance (A101) and 2.4 parts of a melamine resin (Yuban 20HS, made by Mitsui Chemicals Inc.) were dissolved in a mixed solvent of 50 parts of THF (tetrahydrofuran) and 50 parts of methoxypropanol to thereby prepare a coating liquid for an electron transporting layer. The coating liquid for an electron transporting layer was immersion coated on the conductive layer, and the obtained coating film was heated for 60 min at 150° C. to be polymerized to thereby form an electron transporting layer having a thickness of 1.00 μm.

Comparative Example 14

An electrophotographic photosensitive member was manufactured and evaluated as in Comparative Example 12, except for altering the thickness of the electron transporting layer from 1.00 μm to 0.50 μm. The results are shown in Table 14.

Comparative Example 15

An electrophotographic photosensitive member was manufactured and evaluated as in Comparative Example 12, except for altering the melamine resin (Yuban 20HS, made by Mitsui Chemicals Inc.) of the electron transporting layer to the phenol resin (Plyophen J-325, made by DIC Corporation). The results are shown in Table 14.

Comparative Example 16

An electrophotographic photosensitive member was manufactured and evaluated as in Example 1, except for forming an electron transporting layer as follows. The results are shown in Table 14.

10 parts of a mixture of two compounds having structures represented by the following formulae (20-1) and (20-2) was dissolved in a mixed solvent of 30 parts of N-methyl-2-pyrrolidone and 60 parts of cyclohexanone to thereby prepare a coating liquid for an electron transporting layer. The coating liquid for an electron transporting layer was immersion coated on the conductive layer, and the obtained coating film was heated for 30 min at 150° C. to be polymerized to thereby form an electron transporting layer having a structural unit represented by the following formula (20-3) and having a thickness of 0.20 μm.

(20-1)

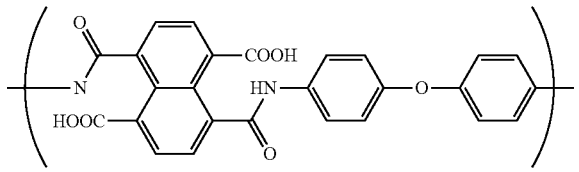

(20-2)

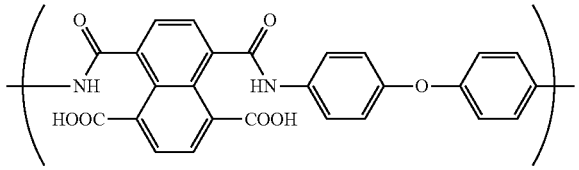

(20-3)

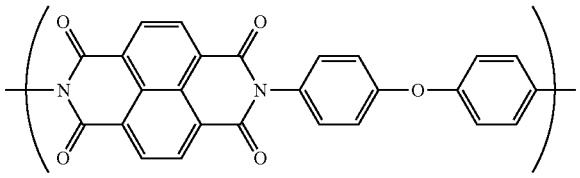

Comparative Examples 17 and 18

Electrophotographic photosensitive members were manufactured and evaluated as in Comparative Example 16, except for altering the thickness of the electron transporting layer from 0.20 μm to 0.30 μm (Comparative Example 17) and 0.60 μm (Comparative Example 18). The results are shown in Table 14.

Comparative Example 19

An electrophotographic photosensitive member was manufactured and evaluated as in Example 1, except for forming an electron transporting layer as follows. The results are shown in Table 14.

10 parts of an electron transporting substance represented by the following formula (21) was dissolved in a mixed solvent of 60 parts of toluene to thereby prepare a coating liquid for an electron transporting layer. The coating liquid for an electron transporting layer was immersion coated on the conductive layer, and the obtained coating film was irradiated with electron beams under the conditions of an acceleration voltage of 150 kV and an irradiation dose of 10 Mrad to be polymerized to thereby form an electron transporting layer having a thickness of 1.00 μm.

(21)

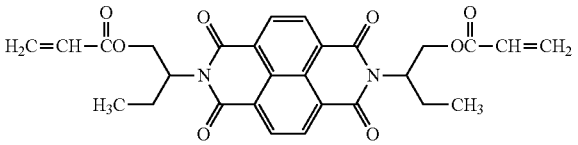

Comparative Example 20

An electrophotographic photosensitive member was manufactured and evaluated as in Example 1, except for forming an electron transporting layer as follows. The results are shown in Table 14.

5 parts of the electron transporting substance represented by the above formula (19), 5 parts of trimethylolpropane triacrylate (Kayarad TMPTA, Nippon Kayaku Co., Ltd.) and 0.1 part of AIBN (2,2-azobisisobutyronitrile) were dissolved in 190 parts of tetrahydrofuran (THF) to thereby prepare a coating liquid for an electron transporting layer. The coating liquid for an electron transporting layer was immersion coated on the conductive layer, and the obtained coating film was heated for 30 min at 150° C. to be polymerized to thereby form an electron transporting layer having a thickness of 0.80 μm.

Comparative Example 21

An electrophotographic photosensitive member was manufactured and evaluated as in Example 1, except for forming an electron transporting layer as follows. The results are shown in Table 14.

5 parts of the electron transporting substance represented by the above formula (19) and 5 parts of a compound represented by the following formula (22) were dissolved in a mixed solvent of 60 parts of toluene to thereby prepare a coating liquid for an electron transporting layer. The coating liquid for an electron transporting layer was immersion coated on the conductive layer, and the obtained coating film was irradiated with electron beams under the conditions of an acceleration voltage of 150 kV and an irradiation dose of 10 Mrad to be polymerized to thereby form an electron transporting layer having a thickness of 1.00 μm.

(22)

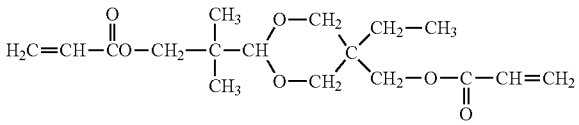

Comparative Example 22

An electrophotographic photosensitive member was manufactured and evaluated as in Example 1, except for forming an electron transporting layer as follows. The results are shown in Table 14.

An electron transporting layer (undercoating layer) (a constitution of example 1 of National Publication of International Patent Application No. 2009-505156) was formed using a block copolymer represented by the following structure, a blocked isocyanate compound and a vinyl chloride-vinyl acetate copolymer to thereby form an electron transporting layer of 0.32 μm.

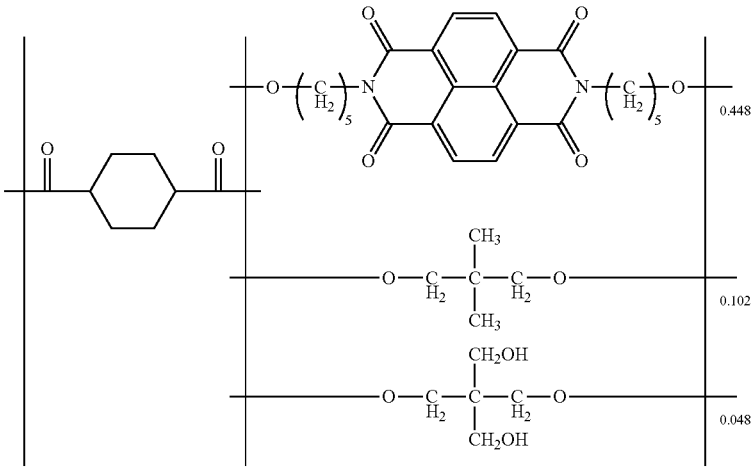

Comparative Example 23

An electrophotographic photosensitive member was manufactured and evaluated as in Example 1, except for forming an electron transporting layer as follows. The results are shown in Table 14.

5 parts of the electron transporting substance (A101) and 5 parts of a polycarbonate resin (Z200, made by Mitsubishi Gas Chemical Co., Inc.) were dissolved in a mixed solvent of 50 parts by mass of dimethylacetoamide and parts by mass of chlorobenzene to thereby prepare a coating liquid for an electron transporting layer. The coating liquid for an electron transporting layer was immersion coated on the conductive layer, and the obtained coating film was heated for 30 min at 120° C. to thereby form an electron transporting layer having a thickness of 1.00 μm.

Comparative Example 24

An electrophotographic photosensitive member was manufactured and evaluated as in Example 1, except for forming an electron transporting layer as follows. As a result of carrying out the determination method, as illustrated in FIG. 4A, the electrophotographic photosensitive member could not be charged at Vd1. The results are shown in Table 14.

5 parts of an electron transporting substance (pigment) having the following structural formula (23) was added to a liquid in which 5 parts of the resin (D1) was dissolved in a mixed solvent of 200 parts of methyl ethyl ketone, and was subjected to a dispersion treatment for 3 hours using a sand mill to thereby prepare a coating liquid for an electron transporting layer. The coating liquid for an electron transporting layer was immersion coated on the conductive layer, and the obtained coating film was heated for 10 min at 100° C. to thereby form an electron transporting layer having a thickness of 1.50 μm.

(23)

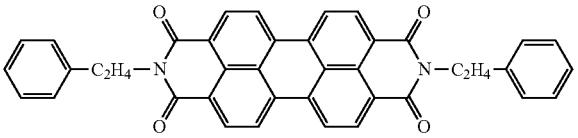

Comparative Example 25

An electrophotographic photosensitive member was manufactured and evaluated as in Example 1, except for forming an electron transporting layer as follows. The results are shown in Table 14.

An electron transporting layer (undercoating layer) was formed by using a coating liquid for an electron transporting layer in which a polymer of an electron transporting substance described in example 1 of Japanese Patent Application Laid-Open No. 2004-093801 was dissolved in a solvent, to thereby form an electron transporting layer having a thickness of 2.00 μm.

Comparative Example 26

An electrophotographic photosensitive member was manufactured and evaluated as in Example 1, except for forming an electron transporting layer as follows. The results are shown in Table 14.

An electron transporting layer (undercoating layer) was formed by using a particle of a copolymer containing an electron transporting substance described in example 1 of Japanese Patent No. 4,594,444, to thereby form an electron transporting layer having a thickness of 1.00 μm.

Comparative Example 27

An electrophotographic photosensitive member was manufactured and evaluated as in Example 1, except for forming an electron transporting layer as follows. As a result of carrying out the determination method, as illustrated in FIG. 4A, the electrophotographic photosensitive member could not be charged at Vd1. The results are shown in Table 14.

(Electron Transporting Layer)

An electron transporting layer (undercoating layer) (a constitution described in example 1 of Japanese Patent Application Laid-Open No. 2006-030698) was formed by using a zinc oxide pigment having been subjected to a surface treatment with a silane coupling agent, alizarin (A922), a blocked isocyanate compound and a butyral resin, to thereby form an electron transporting layer of 25 μm.

Comparative Example 28

An electrophotographic photosensitive member was manufactured and evaluated as in Example 1, except for forming an electron transporting layer as follows. As a result of carrying out the determination method, as illustrated in FIG. 4A, the electrophotographic photosensitive member could not be charged at Vd1. The results are shown in Table 14.

An electron transporting layer (undercoating layer using an electron transporting pigment, a polyvinyl butyral resin, and a curable electron transporting substance having an alkoxysilyl group) described in example 25 of Japanese Patent Application Laid-Open No. H11-119458 was formed.

TABLE 14

| | UCL Thickness (μm) | \| Vl2 − Vl1 \| | \| Vd2 − Vl3/Vd2 \| | Ghost | Vd(V) | Vl(V) |
|---|---|---|---|---|---|---|
| Comparative Example 12 | 1.00 | — | — | 0.10 | −700 | −240 |
| Comparative Example 13 | 1.00 | 0.62 | 0.07 | 0.07 | −700 | −205 |
| Comparative Example 14 | 0.50 | 0.41 | 0.08 | 0.06 | −700 | −200 |
| Comparative Example 15 | 1.00 | 0.76 | 0.07 | 0.08 | −700 | −210 |
| Comparative Example 16 | 0.20 | 0.2 | 0.04 | 0.07 | −700 | −200 |
| Comparative Example 17 | 0.30 | 0.3 | 0.05 | 0.07 | −700 | −200 |
| Comparative Example 18 | 0.60 | 0.35 | 0.04 | 0.08 | −700 | −200 |
| Comparative Example 19 | 1.00 | 0.43 | 0 | 0.09 | −700 | −200 |
| Comparative Example 20 | 0.80 | 0.47 | 0.01 | 0.09 | −700 | −200 |
| Comparative Example 21 | 1.00 | 0.62 | 0 | 0.10 | −700 | −200 |
| Comparative Example 22 | 0.32 | 0.42 | 0.13 | 0.07 | −700 | −200 |
| Comparative Example 23 | 1.00 | 0.85 | 0.05 | 0.09 | −700 | −200 |

TABLE 14-continued

| | UCL Thickness (μm) | \| Vl2 − Vl1 \| | \| Vd2 − Vl3/Vd2 \| | Ghost | Vd(V) | Vl(V) |
|---|---|---|---|---|---|---|
| Comparative Example 24 | 1.50 | — | — | 0.10 | −670 | −200 |
| Comparative Example 25 | 2.00 | 1.2 | 0.02 | 0.10 | −700 | −200 |
| Comparative Example 26 | 1.00 | 1.52 | 0.01 | 0.11 | −700 | −200 |
| Comparative Example 27 | 25.00 | — | — | 0.11 | −680 | −200 |
| Comparative Example 28 | 3.00 | — | — | 0.06 | −665 | −200 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-147159, filed Jun. 29, 2012, Japanese Patent Application No. 2013-093091, filed Apr. 25, 2013, and Japanese Patent Application No. 2013-130015, filed Jun. 20, 2013 which are hereby incorporated by reference herein in their entirety.

What is claimed is:

1. An electrophotographic photosensitive member comprising:

a laminated body, and a hole transporting layer formed on the laminated body, wherein the laminated body comprises:

a support, an electron transporting layer having a thickness of d1 [μm], formed on the support, and a charge generating layer having a thickness of d2 [μm], formed on the electron transporting layer, wherein the electron transporting layer comprises a polymer obtained by polymerizing a composition comprising:

an electron transporting substance having a polymerizable functional group, a crosslinking agent, and a thermoplastic resin having a polymerizable funcational group, wherein the polymerizable functional group is a hydroxy group, a thiol group, an amino group, a carboxyl group, or a methoxy group, wherein the content of the electron transporting substance in the composition is 30% by mass or more and 70% by mass or less with respect to the total mass of the composition, and wherein the laminated body satisfies the following expressions (2) and (4):

$$|Vl2-Vl1|\leq 0.35 \quad (2),$$

and $$0.10\leq|(Vd2-Vl3)/Vd2|\leq 0.20 \quad (4),$$

where, in the expressions (2) and (4),

Vl1 represents a potential of a surface of the charge generating layer when charging the surface of the charge generating layer so that the surface has a potential of Vd1 [V] represented by the following expression (1):

$$Vd1=-50\times(d1+d2) \quad (1),$$

and irradiating the surface of the charge generating layer having a potential of Vd1 with a light, followed by an interval of 0.18 seconds after the irradiation, wherein the intensity of the light is adjusted so that the potential of the surface decays by 20% with respect to Vd1 [V] when irradiating the surface of the charge generation layer, followed by an interval of 0.20 seconds after the irradiation, Vl2 represents a potential of a surface of the charge generating layer when charging the surface of the charge generating layer so that a potential of the surface is the Vd1 [V], and irradiating the surface of the charge generating layer having a potential of Vd1 with the light, followed by an interval of 0.22 seconds after the irradiation, and Vl3 represents a potential of a surface of the charge generating layer when charging the surface of the charge generating layer so that the surface has a potential of Vd2 [V] represented by the following expression (3):

$$Vd2=-30\times(d1+d2) \quad (3),$$

and irradiating the surface of the charge generating layer having a potential of Vd2 with the light, followed by an interval of 0.20 seconds after the irradiation.

2. The electrophotographic photosensitive member according to claim 1, wherein the electron transporting layer has a thickness d1 of 0.2 μm or more and 0.7 μm or less.

3. The electrophotographic photosensitive member according to claim 1, wherein in the expression (2), |Vl2−Vl1| satisfies the following expression (9):

$$|Vl2-Vl1|\leq 0.28 \quad (9).$$

4. The electrophotographic photosensitive member according to claim 1, wherein in the expression (4), |(Vd2−Vl3)/Vd2| satisfies the following expression (10):

$$0.10\leq|(Vd2-Vl3)/Vd2|\leq 0.16 \quad (10).$$

5. The electrophotographic photosensitive member according to claim 1, wherein the crosslinking agent has 3 to 6 groups of an isocyanate group, a blocked isocyanate group or a monovalent group represented by —$CH_2$—$OR^1$ ($R^1$ represents an alkyl group).

6. The electrophotographic photosensitive member according to claim 1, wherein the charge generating layer comprises at least one charge generating substance selected from the group consisting of phthalocyanine pigments and azo pigments.

7. The electrophotographic photosensitive member according to claim 1, wherein the hole transporting layer comprises at least one charge transporting substance selected from the group consisting of triarylamine compounds, benzidine compounds and styryl compounds.

8. A process cartridge comprising an electrophotographic photosensitive member according to claim 1 and at least one unit selected from the group consisting of a charging unit, a developing unit, a transfer unit and a cleaning unit, integrally supported therein, wherein the process cartridge is attachable to and detachable from an electrophotographic apparatus body.

9. An electrophotographic apparatus comprising an electrophotographic photosensitive member according to claim 1, a charging unit, a light irradiation unit, a developing unit and a transfer unit.

* * * * *

UNITED STATES PATENT AND TRADEMARK OFFICE

CERTIFICATE OF CORRECTION

PATENT NO. : 9,063,505 B2
APPLICATION NO. : 13/930341
DATED : June 23, 2015
INVENTOR(S) : Michiyo Sekiya et al.

It is certified that error appears in the above-identified patent and that said Letters Patent is hereby corrected as shown below:

In the specification

COLUMN 2
Line 34, “generation” should read --generating--.

In the claims

COLUMN 137
Line 42 (Claim 1), “funcational” should read --functional--.

COLUMN 138
Line 18 (Claim 1), “eration” should read --erating--.

Signed and Sealed this
Fifteenth Day of December, 2015

Michelle K. Lee

Michelle K. Lee
*Director of the United States Patent and Trademark Office*